US008545343B2

(12) United States Patent
Boyd et al.

(10) Patent No.: US 8,545,343 B2
(45) Date of Patent: Oct. 1, 2013

(54) GOLF CLUB HEAD OR OTHER BALL STRIKING DEVICE WITH SLOTTED FACE MASK

(75) Inventors: Robert Boyd, Flower Mound, TX (US); Sander J. Raymond, Benbrook, TX (US); David S. Lee, Wenham, MA (US)

(73) Assignee: Nike, Inc., Beaverton, OR (US)

( * ) Notice: Subject to any disclaimer, the term of this patent is extended or adjusted under 35 U.S.C. 154(b) by 61 days.

(21) Appl. No.: 13/269,271

(22) Filed: Oct. 7, 2011

(65) Prior Publication Data

US 2013/0090181 A1 Apr. 11, 2013

(51) Int. Cl.
*A63B 53/04* (2006.01)

(52) U.S. Cl.
USPC ..... 473/288; 473/324; 473/331; 473/342; 473/349; 473/409

(58) Field of Classification Search
USPC ..... 473/287–292, 324–350, 409
See application file for complete search history.

(56) References Cited

U.S. PATENT DOCUMENTS

| | | | | |
|---|---|---|---|---|
| 1,253,700 | A * | 1/1918 | McLaughlin | 473/288 |
| 1,289,553 | A | 12/1918 | Sanders | |
| 1,336,671 | A * | 4/1920 | Backus | 473/327 |
| 1,567,248 | A * | 12/1925 | Dahlman | 473/342 |
| 3,368,812 | A * | 2/1968 | Baldwin, Sr. | 473/330 |
| 3,975,023 | A | 8/1976 | Inamori | |
| 4,768,787 | A | 9/1988 | Shira | |
| 4,884,808 | A * | 12/1989 | Retzer | 473/288 |
| 5,342,812 | A | 8/1994 | Niskanen et al. | |
| 5,620,382 | A | 4/1997 | Cho et al. | |
| 5,681,227 | A * | 10/1997 | Sayrizi | 473/327 |
| 6,699,140 | B1 * | 3/2004 | Sun | 473/252 |
| 7,413,517 | B2 * | 8/2008 | Butler et al. | 473/288 |
| 7,691,006 | B1 * | 4/2010 | Burke | 473/288 |
| 7,794,333 | B2 * | 9/2010 | Wallans et al. | 473/331 |
| 8,075,420 | B2 * | 12/2011 | Rick | 473/342 |
| 8,216,081 | B2 * | 7/2012 | Snyder et al. | 473/251 |
| 2004/0009829 | A1 * | 1/2004 | Kapilow | 473/342 |
| 2004/0053704 | A1 * | 3/2004 | Gilbert | 473/290 |
| 2006/0194645 | A1 | 8/2006 | Sugimoto | |
| 2008/0194355 | A1 | 8/2008 | Liu | |
| 2008/0207351 | A1 | 8/2008 | Wallans et al. | |
| 2008/0293511 | A1 | 11/2008 | Gilbert | |
| 2010/0087269 | A1 | 4/2010 | Snyder et al. | |

FOREIGN PATENT DOCUMENTS

| | | |
|---|---|---|
| GB | 2281040 | 2/1995 |

OTHER PUBLICATIONS

ISR & WO mailed Dec. 12, 2012, from PCT Application No. PCT/US2012/057572.

* cited by examiner

*Primary Examiner* — Sebastiano Passaniti
(74) *Attorney, Agent, or Firm* — Banner & Witcoff, Ltd.

(57) ABSTRACT

A ball striking device, such as a golf club head, includes a head that includes a face having an outer surface located at a front of the head, a body connected to the face and extending rearward from the face, and a face mask connected to the outer surface of the face, the face mask having a first surface configured for forming at least a portion of a ball striking surface of the head configured for striking a ball, a second surface opposite the first surface and confronting the outer surface of the face, and a plurality of elongated slots extending completely through the face mask, from the first surface to the second surface. The slots combine with the outer surface of the face to form a plurality of face grooves on the ball striking surface.

34 Claims, 42 Drawing Sheets

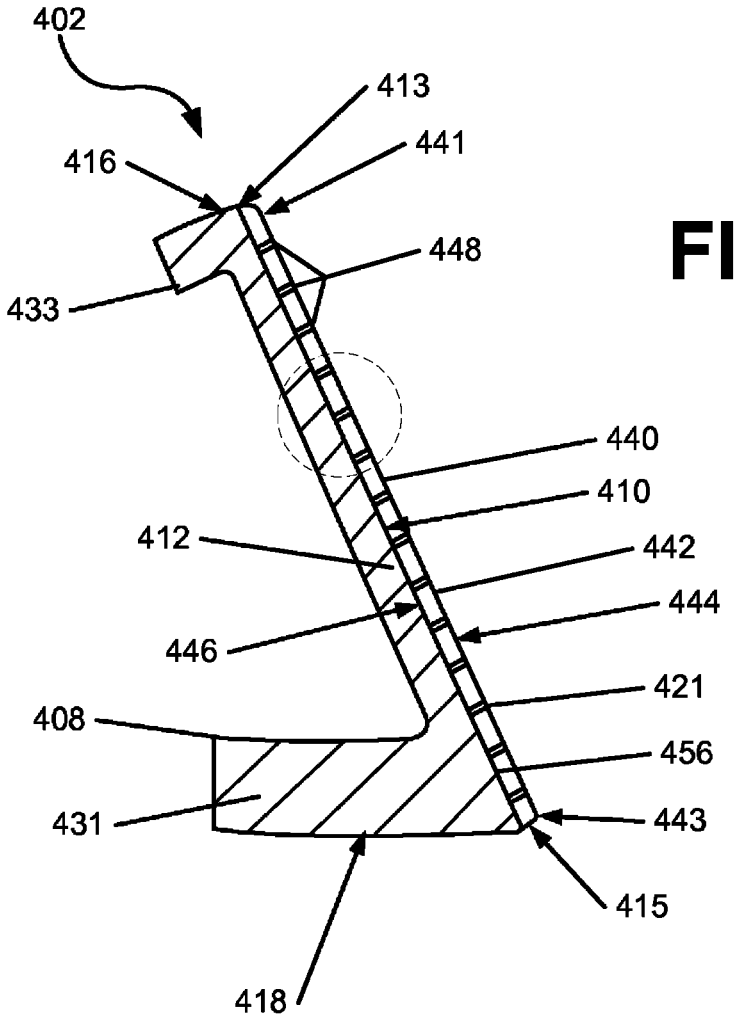
FIG. 19
FIG. 19A
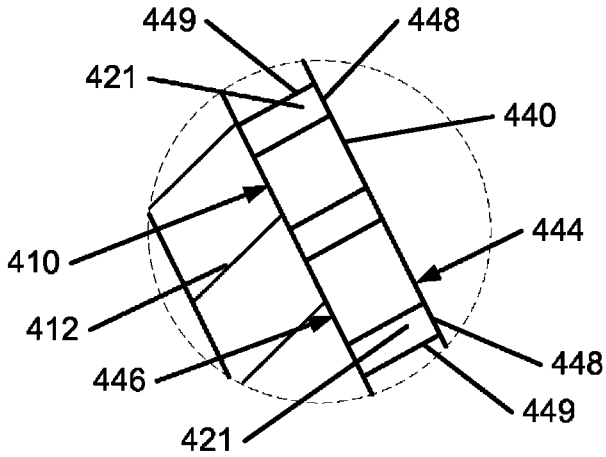

GOLF CLUB HEAD OR OTHER BALL STRIKING DEVICE WITH SLOTTED FACE MASK

TECHNICAL FIELD

The invention relates generally to ball striking devices, such as golf clubs and heads. Certain aspects of this invention relate to golf clubs and golf club heads having at least one face mask having slots to create grooves on the ball striking face of the head.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. The energy or velocity transferred to the ball by a golf club also may be related, at least in part, to the "coefficient of restitution" (or "COR") of the club face at the point of contact. The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the desired ball contact location, usually at the center of the face.

The distance and direction of ball flight can also be significantly affected by the spin imparted to the ball by the impact with the club head. While the ball is in the air, aerodynamic forces caused by the speed and direction of ball spin can cause the trajectory of the ball to be higher or lower, or to curve, and create "pulls," "pushes," "draws," "fades," "hooks," "slices," etc. Additionally, the spin of the ball can change the behavior of the ball as it rolls and bounces after impact with the ground. For example, a high degree of backspin can cause the ball to slow, stop, or even roll backward upon impact, and conversely, topspin or lesser degrees of backspin will cause the ball to travel a greater distance after impact with the ground. Various speeds and directions of spin on the ball can be a product of many factors, including the point of impact, the direction of the club head upon impact, the degree of twisting of the club head upon impact, and the location of the center of gravity of the club head. The interaction between the ball and the club face at the point of impact, including traction, friction, etc., can also have a significant influence on the degree of spin imparted to the ball upon impact.

The cover of a golf ball is typically made of a polymer such as an ionomer or urethane, among other materials. The cover material comes into physical contact with the club face during a golf shot. In order to generate desired backspin or other spin on the ball, a shearing force must be exerted on the ball by the face of the club. Many club heads have grooves on the ball striking face of the club that can aid this interaction by creating areas into which the ball cover can deform during impact, increasing the traction between the ball and the face, to more effectively transmit torque to the ball. The configurations of these grooves, including the widths, depths, shapes, directions, cross-sectional or profile shapes, and distribution of the grooves, among other characteristics, can influence the amount and direction of spin imparted to the ball upon impact. In some circumstances, it may be desirable to impart as little spin as possible to the ball, such as to achieve a straighter and longer ball flight with lower or more boring trajectory and greater rolling distance. For example, many driver-type clubs are designed to impart less spin to the ball upon impact. In other circumstances, it may be desirable to impart a high degree of backspin on the ball, to achieve a higher trajectory and a minimal amount of rolling, or even to draw the ball backward after impacting the ground. For example, many iron-type clubs, hybrid clubs, and fairway wood clubs are designed to impart a greater amount of spin to the ball upon impact. Further, a golfer may wish to have the ability to impart hooking or slicing spin on a ball, such as by altering the form and/or mechanics of the golfer's swing. The grooves in the ball striking face of the golf club head can assist in achieving some or all of these performance characteristics.

The grooves in the face of a golf club head are typically formed in the material of the face through a process such as cutting, machining, forging, molding, etc. Since the face is typically made from a metal material that has some degree of resilience and flexibility and is not excessively hard, the edges defining the grooves can be susceptible to wear after repeated use. Contact with ground detritus, rocks, sand, gravel, and other hard materials in the course of play can become sandwiched b between the ball and the face during impact, causing the club face and the grooves in the face to become worn, such as by chipping or wearing away the edges of the grooves, gouging the face, or otherwise deteriorating the club face. As the grooves become worn, the ability of the golfer to effectively control the ball flight trajectory and roll of the golf ball, through the amount and axis of spin on the ball, can be compromised. Accordingly, club head features that can increase the wear resistance of the edges of the grooves can be helpful in consistently and reliably producing the desired spin on the ball. Additionally, club head features that can provide customizability for the features and configurations of the grooves on the face can further increase the potential options for club performance.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a face mask connected to the outer surface of the face, the face mask having a first surface configured for forming at least a portion of a ball striking surface of the head configured for striking a ball, a second surface opposite the first surface and confronting the outer surface of the face, and a plurality of elongated slots extending completely through the face mask, from the first surface to the second surface. The slots combine with the outer surface of the face to form a plurality of face grooves on the ball striking surface. In one embodiment, the outer surface of the face is substantially flat, and the second surface of the face mask is positioned in surface-to-surface engagement with the outer surface of the face. In another embodiment, the face mask covers the entire outer surface of the face and forms the entire ball striking surface. In a further embodiment, the face mask is a face plate or plate member.

According to one aspect, the face has a recess in the outer surface, wherein at least a portion of the face mask is received within the recess. In one embodiment, the face mask has a projecting portion projecting from the second surface of the face mask, the projecting portion being received in the recess when the face mask is connected to the face. In another embodiment, the projecting portion is located proximate a center of the face mask, and the face mask further comprises two thinned portions extending from opposed sides of the projecting portion, the thinned portions having a smaller thickness than the projecting portion. In a further embodiment, the recess is defined by a peripheral boundary, and wherein the entire face mask is received within the peripheral boundary of the recess.

According to another aspect, the face mask further comprises a coating of a hard material having a hardness greater than a material of the face mask, the coating covering at least a portion of the first surface of the face mask.

According to yet another aspect, the face mask is connected to the outer surface of the face by a bonding material bonded to the outer surface of the face and the second surface of the face mask.

According to a further aspect, the head further comprises an edge recess extending around at least a portion of a peripheral edge of the face, and the face mask further comprises a peripheral wall extending rearward from at least a portion of an outer periphery of the face mask, and wherein the peripheral wall of the face mask is received within the edge recess when the face mask is connected to the face. In one embodiment, the edge recess extends around a majority of the peripheral edge of the face, and the peripheral wall extends from a majority of the outer periphery of the face mask.

According to a still further aspect, one of the face and the face mask has a projection and the other of the face and the face mask has a receiver. The projection and the receiver have complementary mating structure, and the projection is received in the receiver when the face mask is connected to the face.

According to an additional aspect, the face mask is connected to the face by at least one removable fastener.

Additional aspects of the invention relate to a member configured for connection to a face of a head for a ball striking device. The member includes a plate member comprising a first surface, a second surface opposite the first surface, and a peripheral edge extending between the first and second surfaces. The plurality of elongated slots extend completely through the plate member, from the first surface to the second surface. The plate member is configured for connection to the face, such that the second surface of the plate member is configured to confront an outer surface of the face and the first surface of the plate member is configured to form at least a portion of the ball striking surface on the head configured for striking a ball.

According to one aspect, the member further includes a projecting portion projecting from the second surface of the plate member, and the projecting portion is configured to be received in a recess in the outer surface of the face when the plate member is connected to the face.

According to another aspect, the projecting portion is located proximate the center of the plate member, and the member further comprises two thinned portions extending from opposed sides of the projecting portion, with the thinned portions having a smaller thickness than the projecting portion.

According to a further aspect, the member further including a coating of a hard material having a hardness greater than the material of the plate member, with the coating covering at least a portion of the first surface of the plate member.

According to yet another aspect, the member further includes a peripheral wall extending rearward from at least a portion of the peripheral edge of the plate member, and wherein the peripheral edge is configured to be received within an edge recess around at least a portion of a periphery of the face when the face plate is connected to the face. In one embodiment, the peripheral wall extends from a majority of the outer periphery of the plate member.

According to an additional aspect, the member further includes a passage extending through the plate member, the passage configured to receive a removable fastener therethrough to connect the member to the face.

Further aspects of the invention relate to a head for a ball striking device that includes a face having an outer surface located at a front of the head, a body connected to the face and extending rearward from the face, a first plate member is connected to the outer surface of the face, and a second plate member connected to the first plate member. The first plate member has a first surface and a second surface opposite the first surface and confronting the outer surface of the face, and a first plurality of elongated slots extending completely through the first plate member, from the first surface to the second surface thereof, a first slot of the first plurality of slots having a first width. The second plate member has a first surface and a second surface opposite the first surface, the second plate member being stacked upon the first plate member such that the second surface of the second plate member confronts the first surface of the first plate member and the first surface of the second plate member forms at least a portion of a ball striking surface of the head configured to strike a ball. The second plate member further includes a second plurality of elongated slots extending completely through the second plate member, from the first surface to the second surface thereof, and a second slot of the second plurality of slots has a second width that is greater than the first width. The first slot is aligned with the second slot when the second plate member is stacked upon the first plate member, such that the first slot and the second slot combine to form a face groove on the ball striking surface.

According to one aspect, the outer surface of the face, the first and second surfaces of the first plate member, and the first and second surfaces of the second plate member are each substantially flat. The second surface of the first plate member is positioned in surface-to-surface engagement with the outer surface of the face and the first surface of the first plate member is positioned in surface-to-surface engagement with the second surface of the second plate member.

According to another aspect, the face has a recess in the outer surface, and at least a portion of the first plate member and at least a portion of the second plate member are positioned within the recess.

According to a further aspect, the first plate member has a recess in the first surface, and at least a portion of the second plate member is positioned within the recess.

According to yet another aspect, the second plate member further includes a coating of a hard material having a hardness greater than the material of the second plate member, the coating covering at least a portion of the first surface of the second plate member.

According to still a further aspect, the first plate member is connected to the outer surface of the face and the second plate member is connected to the first plate member by a bonding material.

Still further aspects of the invention relate to a kit that includes a head for a ball striking device, the head including a face having an outer surface located at a front of the head and a body connected to the face and extending rearward from the face, and a plurality of face plates each configured for connection to the outer surface of the face. Each face plate has a first surface configured for forming at least a portion of the ball striking surface of the head, a second surface opposite the first surface and confronting the outer surface of the face, and a plurality of elongated slots extending completely through the face plate, from the first surface to the second surface. When each of the face plates is connected to the head, the slots of the respective face plate combine with the outer surface of the face to form a plurality of face grooves on the ball striking surface. Each of the plurality of face plates has an arrangement of the slots that is different from the arrangement of the slots of each other face plate of the plurality of face plates.

According to one aspect, each of the plurality of face plates is configured for alternate connection to the head, and the plurality of face plates are configured to be removable from the head and interchangeable with each other.

According to another aspect, the kit further includes a shaft configured to be connected to the head.

Yet additional aspects of the invention relate to a method for use with a head for a ball striking device, the head including a face having an outer surface located at a front of the head and a body connected to the face and extending rearward from the face. A face plate is connected to the outer surface of the face, the face plate having a first surface, a second surface opposite the first surface, and a plurality of elongated slots extending completely through the face plate, from the first surface to the second surface. When the face plate is connected to the face, the first surface forms at least a portion of the ball striking surface of the head, the second surface confronts the outer surface of the face, and the slots combine with the outer surface of the face to form a plurality of face grooves on the ball striking surface.

According to one aspect, the method further includes, prior to connecting the face plate to the face, selecting the face plate from a plurality of face plates each configured for connection to the face, based on a characteristic of a prospective user of the ball striking device.

According to another aspect, the method further includes removing the face plate from the face, and connecting a second face plate to the outer surface of the face. The second face plate has a first surface, a second surface opposite the first surface, and a plurality of elongated slots extending completely through the second face plate, from the first surface to the second surface. The slots of the second face plate are arranged differently from the slots of the face plate. When the second face plate is connected to the face, the first surface forms at least a portion of the ball striking surface of the head, the second surface confronts the outer surface of the face, and the slots combine with the outer surface of the face to form a plurality of face grooves on the ball striking surface.

Other aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 19 is a cross-section view of the head of FIG. 18, taken along lines 19-19 of FIG. 18;

FIG. 19A is a magnified view of a portion of the head as shown in FIG. 19;

DETAILED DESCRIPTION

Figure 1:
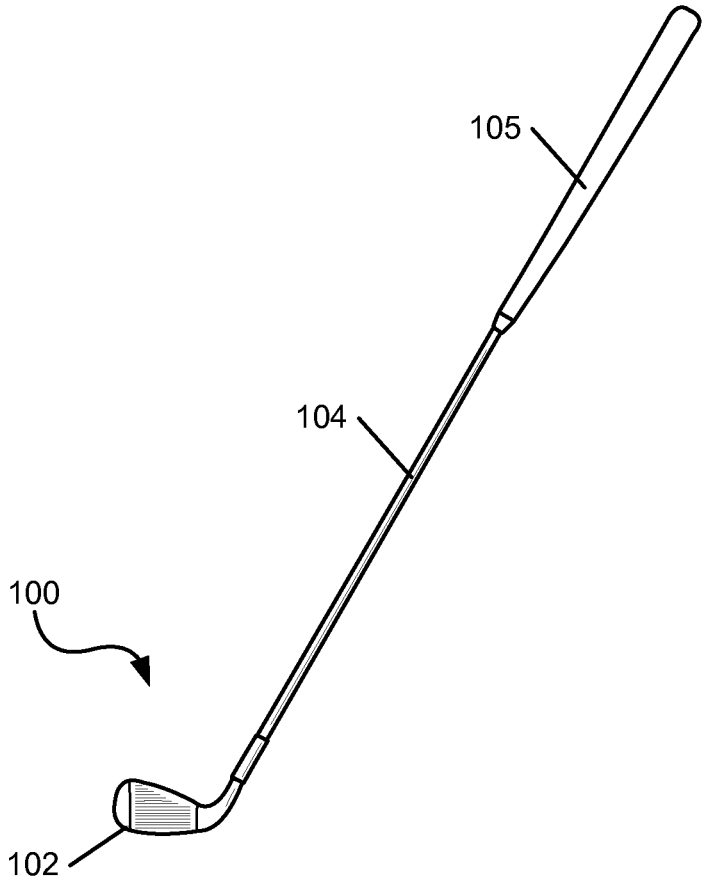
FIG. 1 is a front view of an illustrative embodiment of an iron-type ball striking device according to aspects of the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Substantially flush" means that a surface of one article is level and aligned with the surface of an adjacent article, such that the two surfaces form a substantially flat single surface, within a tolerance of +/−0.005 inches.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to iron-type golf clubs and golf club heads, including long irons, short irons, wedges, etc. Alternately, some aspects of this invention may be practiced with hybrid clubs, chippers, and the like, or wood-type golf clubs and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, as well as long iron clubs (e.g., driving irons, zero irons through five irons), short iron clubs (e.g., six irons through pitching wedges, as well as sand wedges, lob wedges, gap wedges, and/or other wedges), hybrid clubs, and putters. Such devices may include a one-piece construction or a multiple-piece construction. Example structures of ball striking devices according to this invention will be described in detail below in conjunction with FIG. 1, which illustrates an example of a ball striking device 100 in the form of an iron-type golf club, and FIG. 40, which illustrates an example of a ball striking device 1800 in the form of a wood-type golf club, in accordance with at least some examples of this invention.

Figure 2:
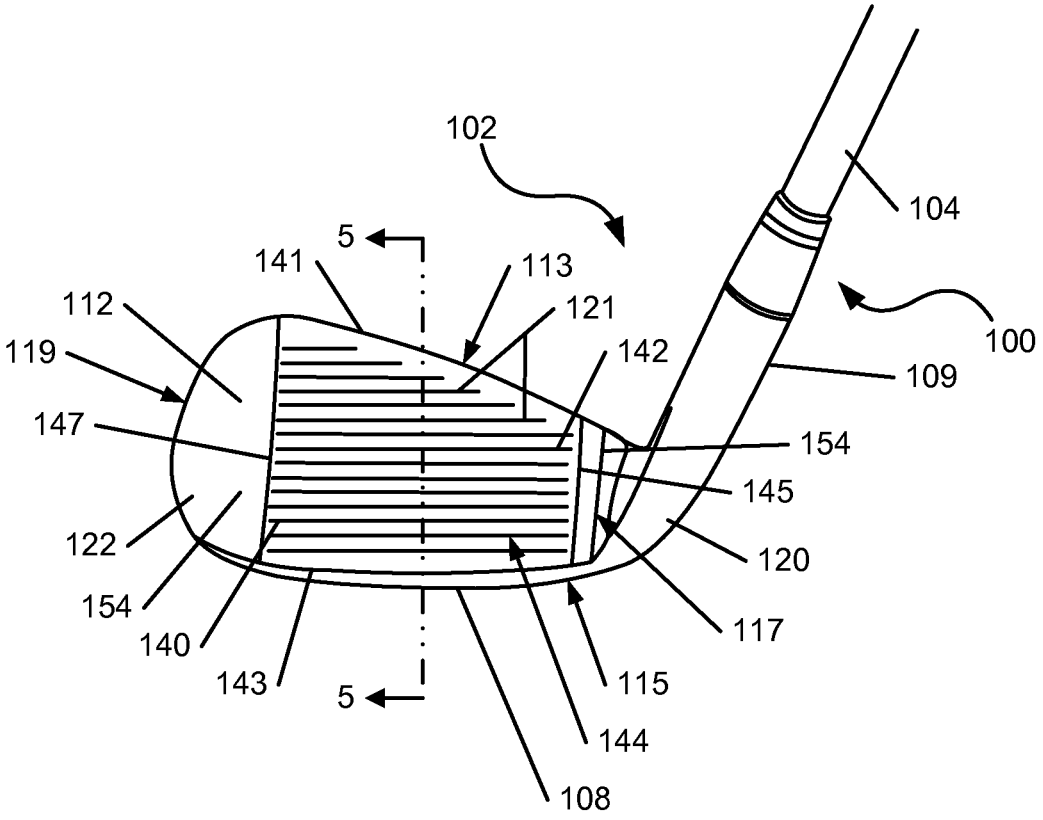
FIG. 2 is a front view of an illustrative embodiment of a head of the ball striking device of FIG. 1.
Figure 3:
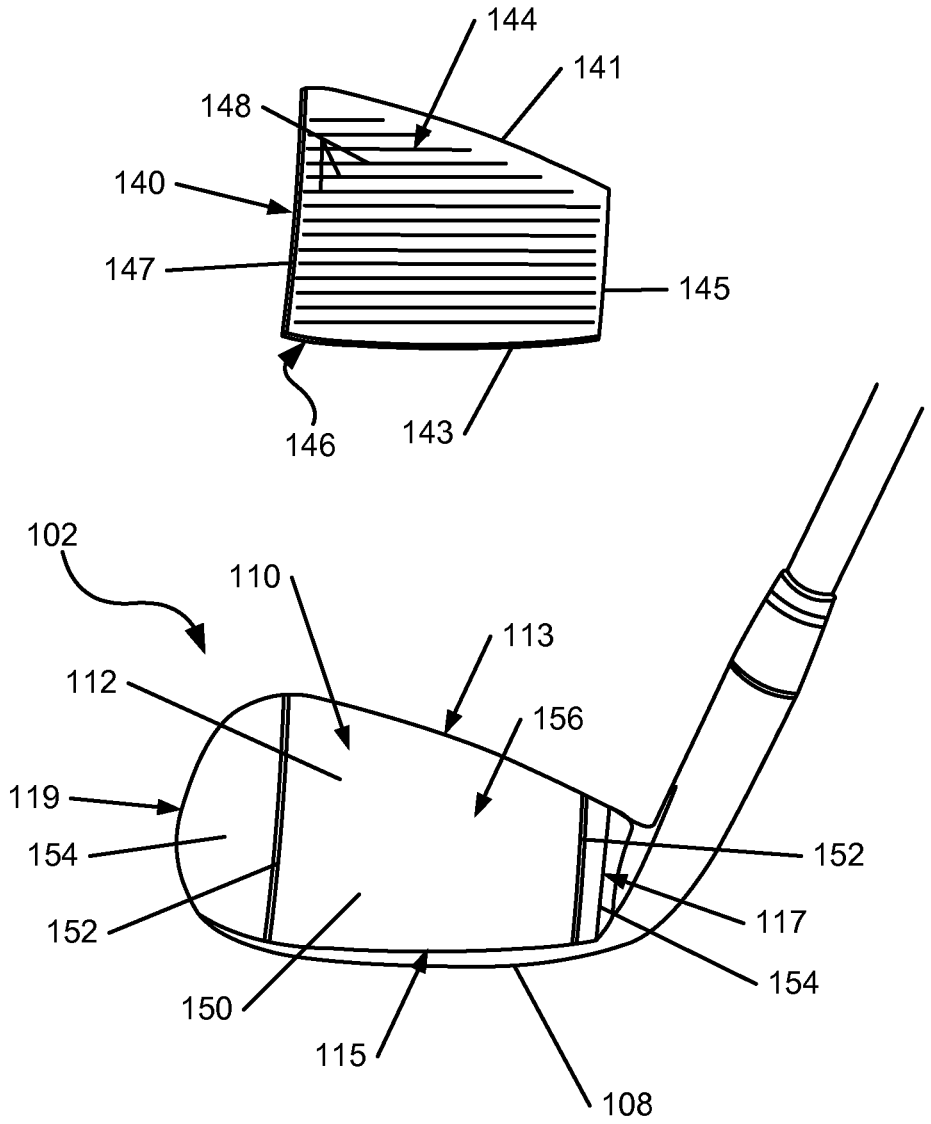
FIG. 3 is an exploded front view of the head of FIG. 2.
Figure 4:
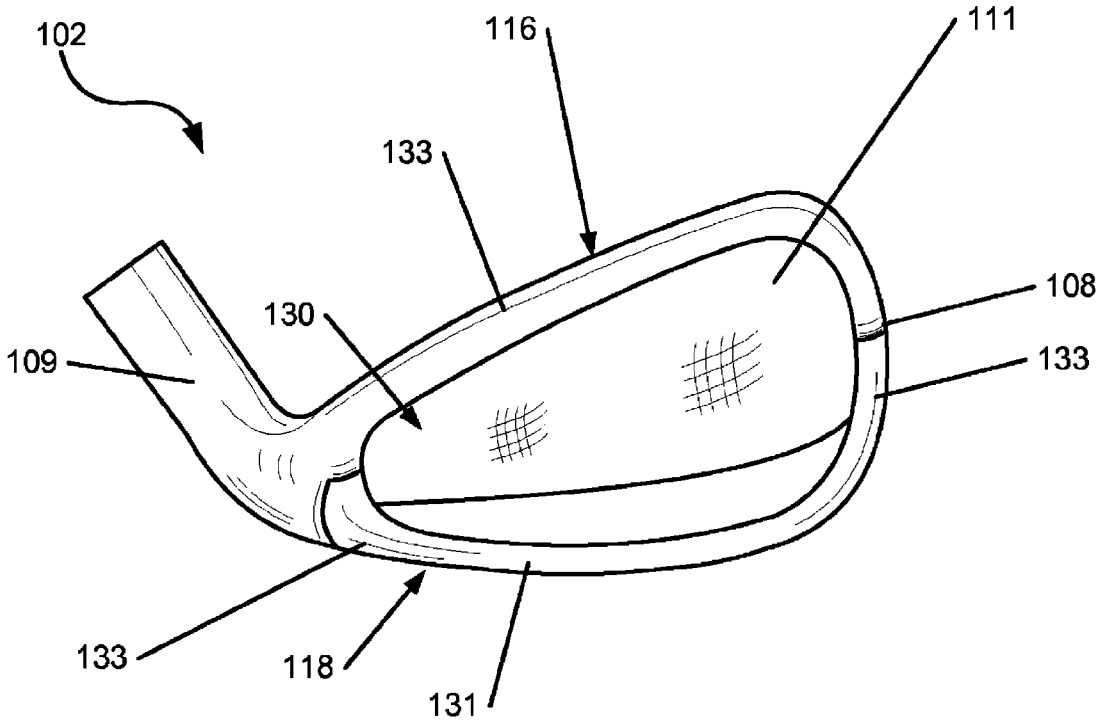
FIG. 4 is a rear view of the head of FIG. 2.

FIG. 1 illustrates a ball striking device 100 in the form of a golf iron, in accordance with at least some examples of this invention, and illustrative embodiments of heads 102, et seq., of ball striking devices 100 of this type are shown in FIGS. 2-39. The golf club head 102 of FIG. 1 may be representative of any iron-type golf club head in accordance with examples of the present invention. As shown in FIGS. 1-2, the ball striking device 100 includes a ball striking head 102 and a shaft 104 connected to the ball striking head 102 and extending therefrom. The ball striking head 102 of the ball striking device 100 of FIGS. 1-2 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

As shown in FIGS. 2-6, the golf club head 102 includes a body member 108 having a face 112 and a hosel 109 extending from the body 108 for attachment of the shaft 104. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. The heel portion 120 is attached to and/or extends from the hosel 109 (e.g., as a unitary or integral one piece construction, as separate connected elements, etc.). In the embodiment shown in FIGS. 2-6, the body 108 and the hosel 109 are formed as a single, integral piece, such as by casting, forging, etc. The face 112 may also be formed of the same single, integral piece with the body 108 and the hosel 109. In another embodiment, the face 112, the body 108, and/or the hosel 109 may be formed of two or more separate pieces that are connected together by an integral joining technique or another joining technique. In other applications, such as for a different type of golf club, the head may be designed to have different dimensions and configurations.

The face 112 is located at the front 124 of the head 102, and has an outer surface 110, as well as a rear surface 111 located opposite the outer surface 110, which may be considered an inner surface of the face 112. The face 112 is defined by a plurality of peripheral edges, including a top edge 113, a bottom edge 115, a heel edge 117, and a toe edge 119.

As described in greater detail below, the head 102 further includes a face mask 140 connected to the face 112 and positioned in confronting relation to the outer surface 110 of the face 112. The face mask has an outer surface 144 forming at least part of a ball striking surface 142 on the head 102 and an inner surface 146 opposite the outer surface 142. The ball striking surface 142 is typically an outer surface of the head 102 configured to face a ball (not shown) in use, and is adapted to strike the ball when the device 100 is set in motion, such as by swinging. As shown, the ball striking surface 142 is relatively flat, occupying most of the front 124 of the head 102. In the illustrated embodiment, the ball striking surface 142 includes a plurality of grooves 121 in the form of generally horizontal grooves 121 extending across the ball striking surface 142. In other embodiments, any number of grooves, desired groove patterns, and/or groove constructions may be provided (or even no groove pattern, if desired), including conventional groove patterns and/or constructions, without departing from this invention.

For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the face mask 140 may occupy a different proportion of the face 112, or the head 102 may have multiple ball striking surfaces thereon. As seen in the illustrative embodiments in FIGS. 2-5B, the ball striking surface 142 is inclined (i.e., at a loft angle), to give the ball an appreciable degree of lift and spin when struck. In other illustrative embodiments, the ball striking surface 142 may have a different incline or loft angle, to affect the trajectory of the ball.

The body 108 and the face 112 of the golf club head 102 may be constructed from a wide variety of different materials, including materials conventionally known and used in the art, such as steel, titanium, aluminum, tungsten, graphite, polymers, or composites, or combinations thereof. Also, if desired, the club head 102 may be made from any number of pieces (e.g., having a separate face mask, etc.) and/or by any construction technique, including, for example, casting, forging, welding, and/or other methods known and used in the art.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

Figure 39:
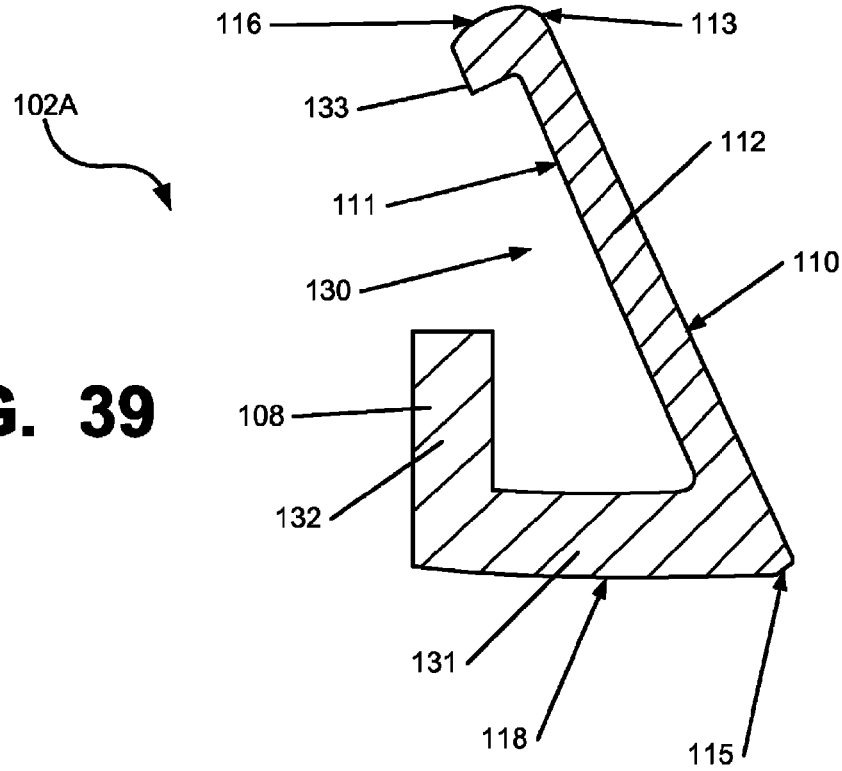
FIG. 39 is a cross-section view of the head of FIG. 38, taken along lines 39-39 of FIG. 38.
Figure 38:
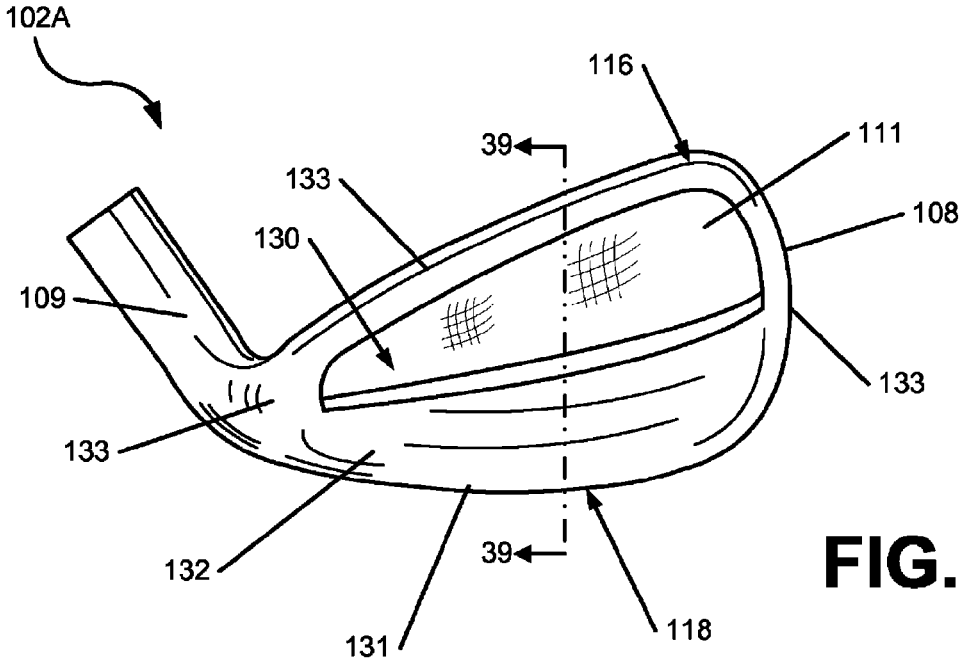
FIG. 38 is a rear view of a sixteenth illustrative embodiment of a head of an iron-type ball striking device according to aspects of the present invention.

In one exemplary embodiment, shown in FIGS. 2-6, the body 108 of the head 102 includes a rear cavity 130 located behind the face 112, which is defined at least partially by the rear surface 111. As shown in FIGS. 2-6, the body 108 further includes a sole body member 131 extending rearward from the bottom edge 115 of the face 112 and defining a portion of the rear cavity 130. The rear cavity 130 may also be partially defined by peripheral or perimeter walls 133 extending rearward from the peripheral edges of the face 112, including the top edge 113, the heel edge 117, and the toe edge 119 of the face 112. It is understood that the sole member 131, or a portion thereof, may be considered to be a peripheral wall 133 as defined herein. The peripheral walls 133 follow the curvilinear contour of the body 108, and form an opening to the rear cavity 130 defined by the peripheral walls 133, including the sole member 131. In another embodiment of the head 102A, the rear cavity 130 may also be partially defined by a rear wall 132 extending upward from the rear of the sole member 131, such as in the embodiment of FIGS. 38-39. As shown in FIGS. 38-39, the rear wall 132 partially defines the rear cavity 130, in combination with the sole member 131, the rear surface 111 of the face 112, and the peripheral walls 133 of the head 102. In the embodiment of FIGS. 2-6, the sole member 131 forms at least part of the sole 118 of the head 102, and the mass of the sole member 131 lowers the center of gravity of the head 102, which in turn, can produce greater loft on balls hit on the face 112. In additional embodiments, such as the embodiments illustrated in FIGS. 38-39, the head 102 may have a differently configured sole member and/or a rear wall, or may not contain some of these components. For example, in another embodiment, the head 102 may have a traditional blade-type iron configuration, containing no rear cavity.

In general, the head 102 has a ball striking face 142 configured for striking a ball in play. The head 102 also has at least one face mask 140 that is connected to the face 112, forming at least a portion of the ball striking surface 142. In one embodiment, the face mask 140 has an outer surface 144 forming at least a portion of the ball striking surface 142 and an inner surface 146 opposite the outer surface 144, with a plurality of slots 148 in the outer surface 144. Additionally, in one embodiment, the slots 148 extend completely through the face mask 140, from the inner surface 146 to the outer surface 144. However, in another embodiment, at least some of the slots 148 may extend through only a portion of the thickness of the face mask 140. For example, FIG. 5C illustrates an embodiment of a head 102A with a face 112 as described above, having a face mask 140A with a plurality of slots 148A extending inward from the outer surface 144A to form grooves 121A. In this embodiment, the slots 140A extend through only a portion of the thickness of the face mask 140A, and do not extend to the inner surface 146A of the face mask 140A. The walls 149A of the slots 148A meet to form a curved bottom of each slot 148A. Other aspects and features of the head 102A are similar to those described above, and it is understood that this configuration can be used in connection with the other embodiments described herein. The face mask 140 may have a variety of different configurations, and may be connected to the face 112 in a variety of different ways. Additionally, the head 102 may contain more than one face mask 140. A number of different embodiments illustrating a variety of examples of such different configurations are shown in FIGS. 2-43 and described below. Each of the face masks 140, et seq. described below is formed as a plate member or face plate, however the face mask 140 may have a different configuration in other embodiments.

FIGS. 2-6 illustrate one example embodiment of a head 102 in accordance with the present invention. As described above, the head 102 has a body 108 with a face 112 connected to the body 108, and the head 102 also has a single face mask 140 connected to the face 112. In this embodiment, the outer surface 110 of the face 112 has a recess 150 therein, and the face mask 140 is received at least partially within the recess 150 when the face mask 140 is mounted to the face 112. The recess 150 is defined by a peripheral boundary that extends from the top edge 113 to the bottom edge 115 of the face 112, and is further defined by substantially vertical edges 152 extending proximate the heel 120 and toe 122 of the head 102. As a result, the outer surface 110 of the face 112 has a recessed surface 156 within the recess 150 and raised portions 154 located proximate the heel 120 and toe 122 that are raised with respect to the recessed surface 156.

The face mask 140 is formed as a plate member or face plate defined by a top side 141, a bottom side 143, a heel side 145, and a toe side 147, as illustrated in FIGS. 2-6. In this embodiment, the face mask 140 is received in the recess 150 such that the entire face mask 140 is received within the peripheral boundary of the recess 150. The top side 141 and the bottom side 143 of the face mask are contoured similarly to the top edge 113 and bottom edge 115 of the face 112, respectively, so that the top and bottom sides 141, 143 of the face mask 140 are substantially flush with the top and bottom edges 113, 115 of the face 112. Additionally, both the inner surface 146 of the face mask 140 and the recessed surface 156 are substantially flat, and the inner surface 146 of the face mask 140 is arranged in confronting relation to the recessed surface 156 and engages the recessed surface 156 in surface-to-surface contact. In this arrangement, the outer surface 144 of the face mask 140 is substantially flush with the raised portions 154 of the outer surface 110 of the face 112, and forms at least a portion of the ball striking surface 142 of the head 102. In this embodiment, the outer surface 144 of the face mask 140 forms the area of the ball striking surface 142 at and around the "hot zone" or "sweet spot," which has the greatest COR response and energy transfer to the ball upon impact. It is understood that the face mask 140, while shown as a single piece, may be constructed of multiple pieces. Further, in one embodiment, more than one face mask 140 may be connected to the face 112, and more than one face mask 140 may be received in the recess 150 in the face 112.

Figure 5:
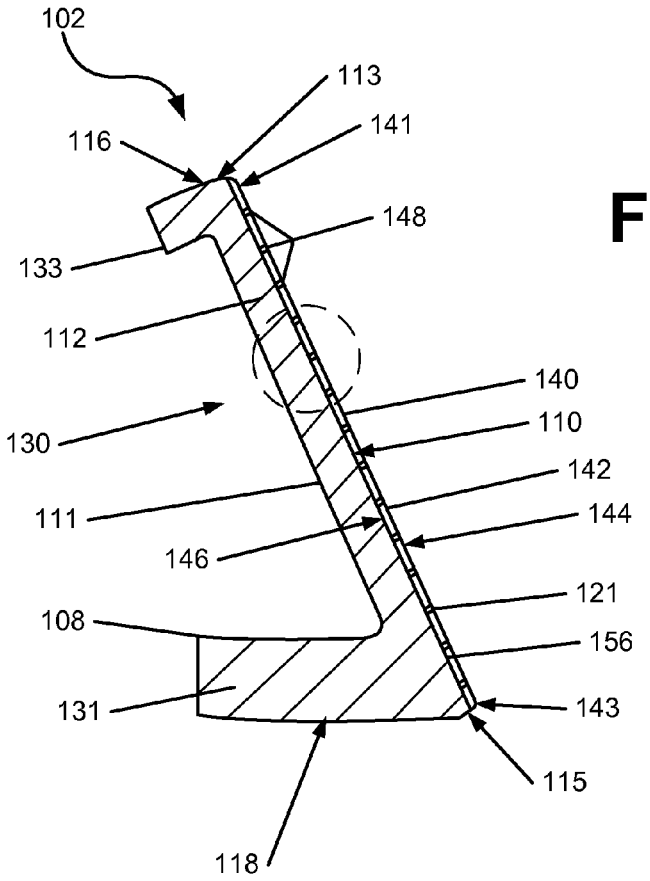
FIG. 5 is a cross-section view of the head of FIG. 2, taken along lines 5-5 of FIG. 2.
Figure 5A:
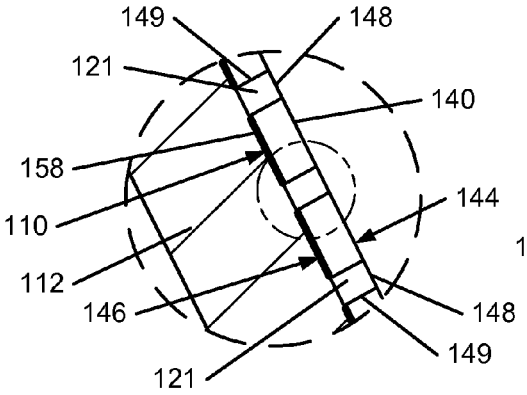
FIG. 5A is a magnified view of a portion of the head as shown in FIG. 5.
Figure 5B:
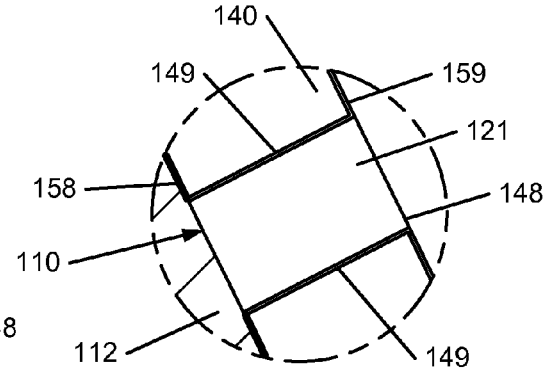
FIG. 5B is a magnified view of a portion of the head as shown in FIG. 5A.
Figure 5C:
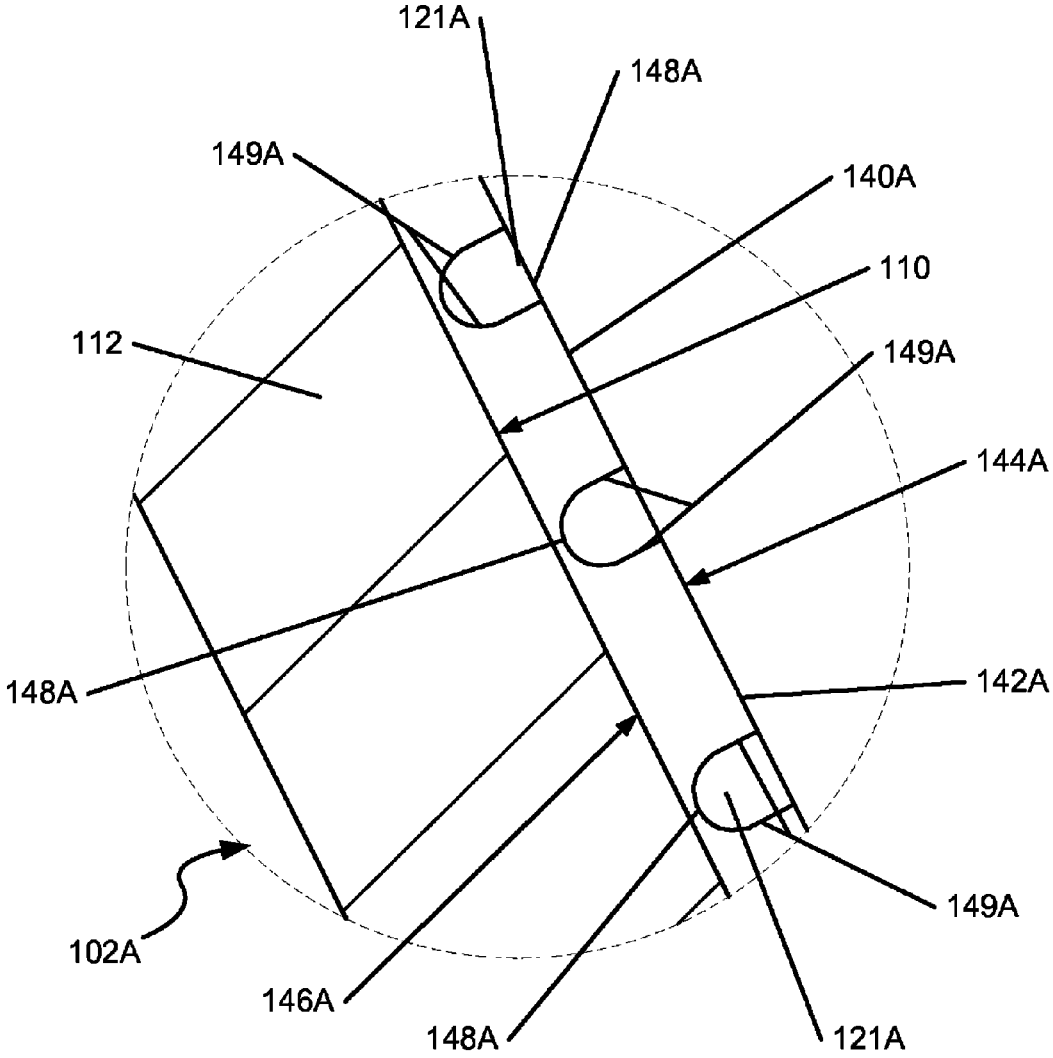
FIG. 5C is a magnified view of a portion of another embodiment the head as shown in FIG. 5.
Figure 6:
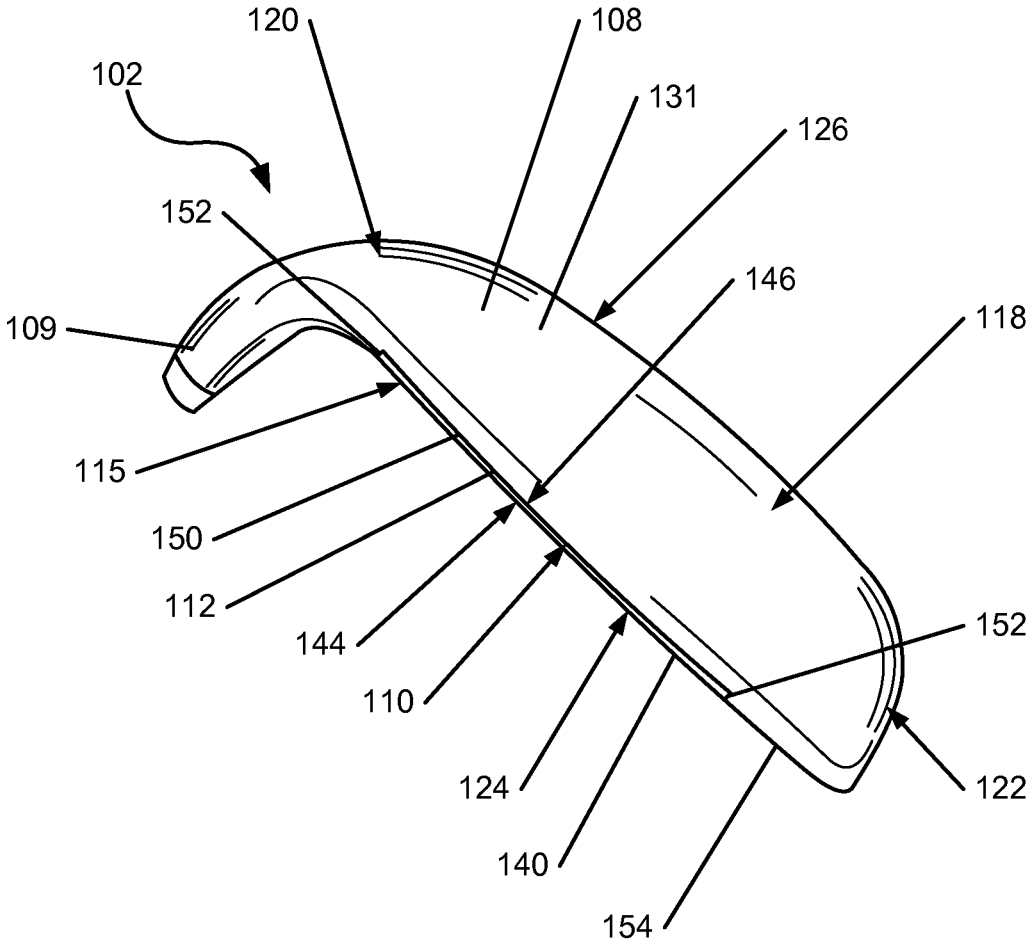
FIG. 6 is a bottom view of the head of FIG. 2.
Figure 30:
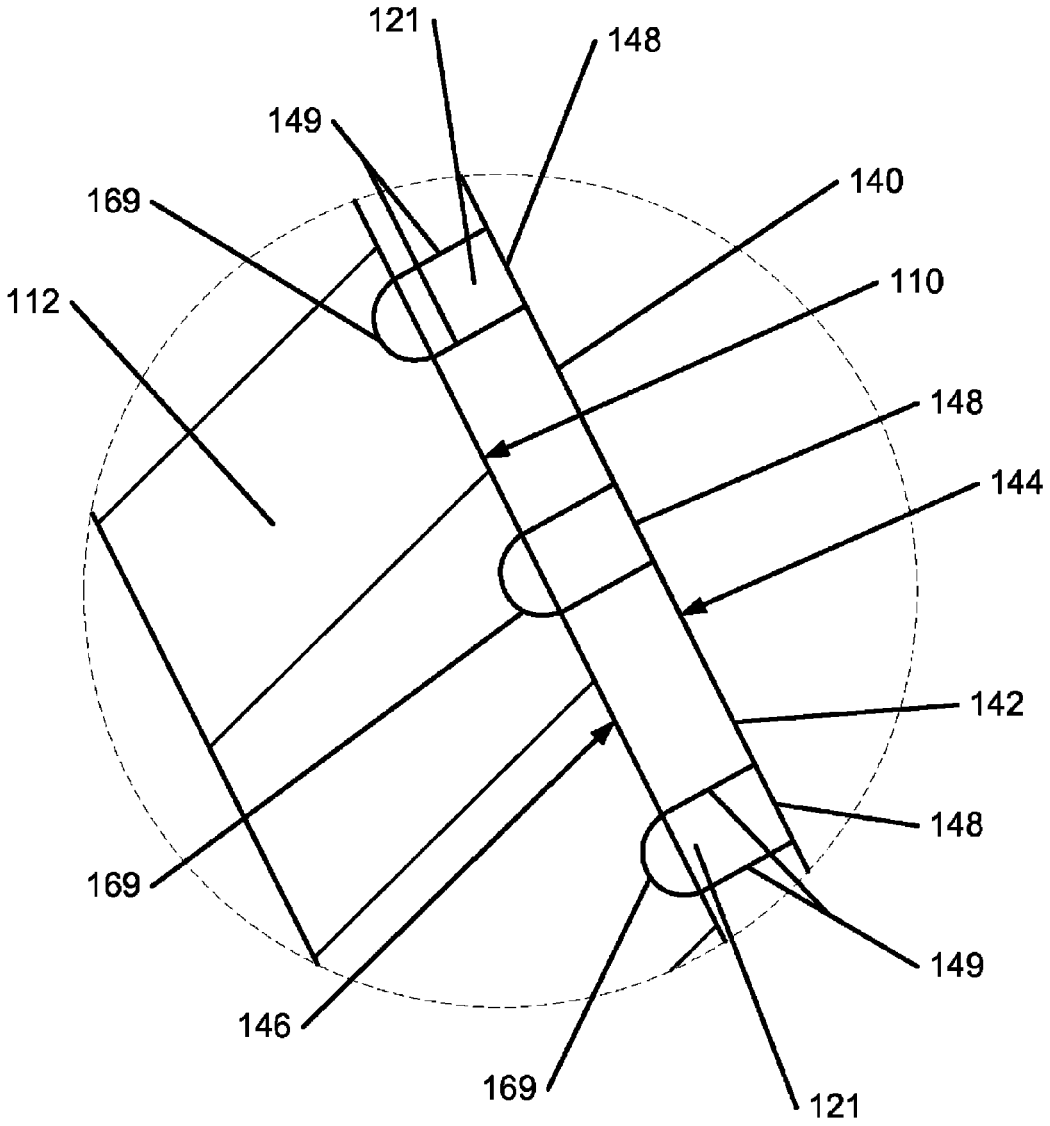
FIG. 30 is a magnified cross-section view of an eleventh illustrative embodiment of a head of an iron-type ball striking device according to aspects of the present invention.

As shown in FIGS. 5-5B, the slots 148 extend completely through the face mask 140, from the inner surface 146 to the outer surface 144. In this embodiment, the slots 148 have side walls 149 that extend from the inner surface 146 to the outer surface 144, and the side walls 149 are generally parallel to each other and generally perpendicular to the outer and inner surfaces 144, 146, as shown in FIG. 5B. In other embodiments, the side walls 149 of the slots 148 may be angled differently, and the widths of the slots 148 may be tapered or irregular in shape. The slots 148 of the face mask 140 form the grooves 121 on the ball striking surface 142, such that the grooves are defined by the side walls 149 of the slots 148 and portions of the outer surface 110 of the face 112, as also shown in FIGS. 5A and 5B. In another embodiment, as illustrated in FIG. 30, the outer surface 110 of the face 112 may have secondary grooves 169 positioned in alignment with some or all of the slots 148 of the face mask 140 to further define the grooves 121 by forming rounded troughs. It is understood that the secondary grooves 169 shown in FIG. 30 may be used in connection with any of the embodiments described herein, and that the secondary grooves 169 may be differently configured in other embodiments. In a further embodiment, the face 112 may have at least some grooves 121 that are not formed in any part by the face mask 140. It is understood that the depth of the grooves 121 may be designed to conform with applicable USGA standards regarding the depth of face grooves 121, and that the depth of the slots 148 and/or the thickness of the face mask 140 may be dimensioned accordingly to conform with such standards.

In one embodiment, the face mask 140 has a coating material on at least a portion of the outer surface 144 of the face mask 140. In the embodiment shown in FIGS. 2-6, the face mask 140 has a coating material 159 on the outer surface 144, as well as along the side walls 149 of the slots 148. The coating 159 may be selected to create various surface properties on the face mask 140. For example, the coating 159 may be a hardened coating to further increase the hardness of the face mask 140, such as a titanium nitride coating, a diamond or diamond-like coating, a zirconium carbo-nitride coating, or other such hardened coating. As another example, the coating 159 may be hydrophobic (including super-hydrophobic coatings) or hydrophilic. As a further example, the coating 159 may be a high-friction or low-friction coating. Still other coatings 159 may be used with the face mask 140 to create additional properties and characteristics. The coating 159 may be applied by a variety of techniques, including plating, painting, atomic deposition techniques such as PVD, CVD, etc. or other coating techniques. In other embodiments, the face mask 140 may contain multiple coatings 159, and one coating 159 may impart multiple properties or characteristics to the face mask 140. Further, the coating 159 may be distributed in a different configuration on the face mask 140, such as being disposed only on the outer surface 144 or portions of the outer surface 144, or being distributed over the entire exterior of the face mask 140. It is understood that other embodiments of face masks may include one or more coating materials, including any of the face masks 240 et seq. described below and shown in FIGS. 8-43.

The face mask 140 may additionally or alternately have a surface texture that can impart properties to the outer surface 144 and the slots. For example, the outer surface 144 of the face mask 140 may have a rough surface texture that imparts greater spin to the ball upon impact. As another example, the outer surface 144 may have a smooth surface texture that imparts less spin to the ball upon impact. Other types of surface textures may be used as well. It is understood that other embodiments of face masks may include such surface textures, including any of the face masks 240 et seq. described below and shown in FIGS. 8-43.

The face mask 140 may be connected to the face 112 in a variety of manners. In one embodiment, the face mask 140 can be connected to the surface by a bonding material bonded between the face 112 and the face mask 140. The bonding material may be an adhesive or cement material (such as epoxy), or a welding, brazing, or soldering material or other material used in an integral joining technique. The type of bonding material used may depend on the nature of the material of the face 112 and/or the material of the face mask 140. In the embodiment of FIGS. 2-6, the face mask 140 is joined to the face 112 by a bonding material 158 contacting the inner surface 146 of the face mask 140 and the recessed surface 156 of the face 112, as shown in FIGS. 5A and 5B. In this embodiment, the bonding material 158 is intermittently present on the recessed surface 156, and is only present in areas of contact with the inner surface 146 of the face mask 140, as also shown in FIGS. 5A and 5B. Other techniques and configurations for joining the face mask 140 to the face 112 are described below and shown in FIGS. 8-37.

In one embodiment, the head 102 may be provided with a plurality of different face masks 140 having different patterns or arrangements of slots 148, with each of the face masks 140 being configured for alternate connection to the head 102. In the embodiment illustrated in FIG. 7, a head 102 as shown in FIGS. 2-6 is configured for alternate connection to three face masks 140, 140', 140". The first face mask 140 is identical to the face mask 140 in FIGS. 2-6. The second face mask 140' has a smaller number of slots 148' having greater widths than the slots 140 of the first face mask 140. The third face mask 140" has slots 148" that are similar in width to the slots 148 of the first face mask 140, and the slots 148" are arranged in a pattern to provide a circular pattern around the hot zone of the face 112 to provide a visual indication to the user for aiding alignment with the ball during play. It is understood that a variety of other face masks with different patterns of slots may be used, and that further variations in the configuration of the face mask may exist. For example, the slots 148 may have different shapes or cross-sectional shapes, or may otherwise be differently configured.

FIGS. 8-11 illustrate another embodiment of a head 202 in accordance with the present invention. Many features of the head 202 of FIGS. 8-11 are similar to the features of the head 102 shown in FIGS. 2-6, and such similar features are identified by similar reference numerals in FIGS. 8-11 using the "2xx" series of reference numerals. Accordingly, certain features of the head 202 of FIGS. 8-11 that are already described above may described below using less detail, or may not be described at all.

Figure 10:
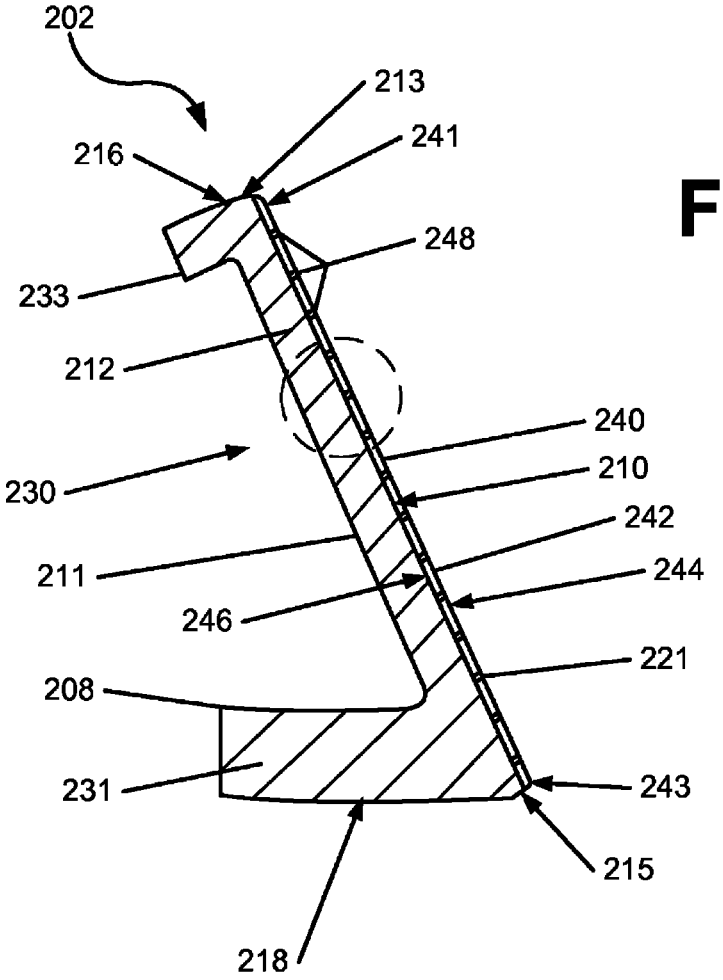
FIG. 10 is a cross-section view of the head of FIG. 8, taken along lines 10-10 of FIG. 8.
Figure 10A:
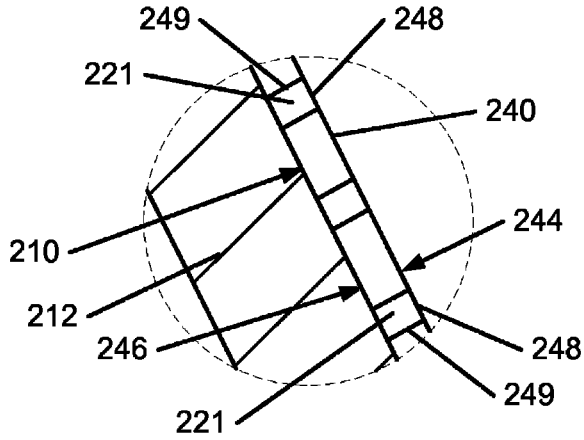
FIG. 10A is a magnified view of a portion of the head as shown in FIG. 10.
Figure 11:
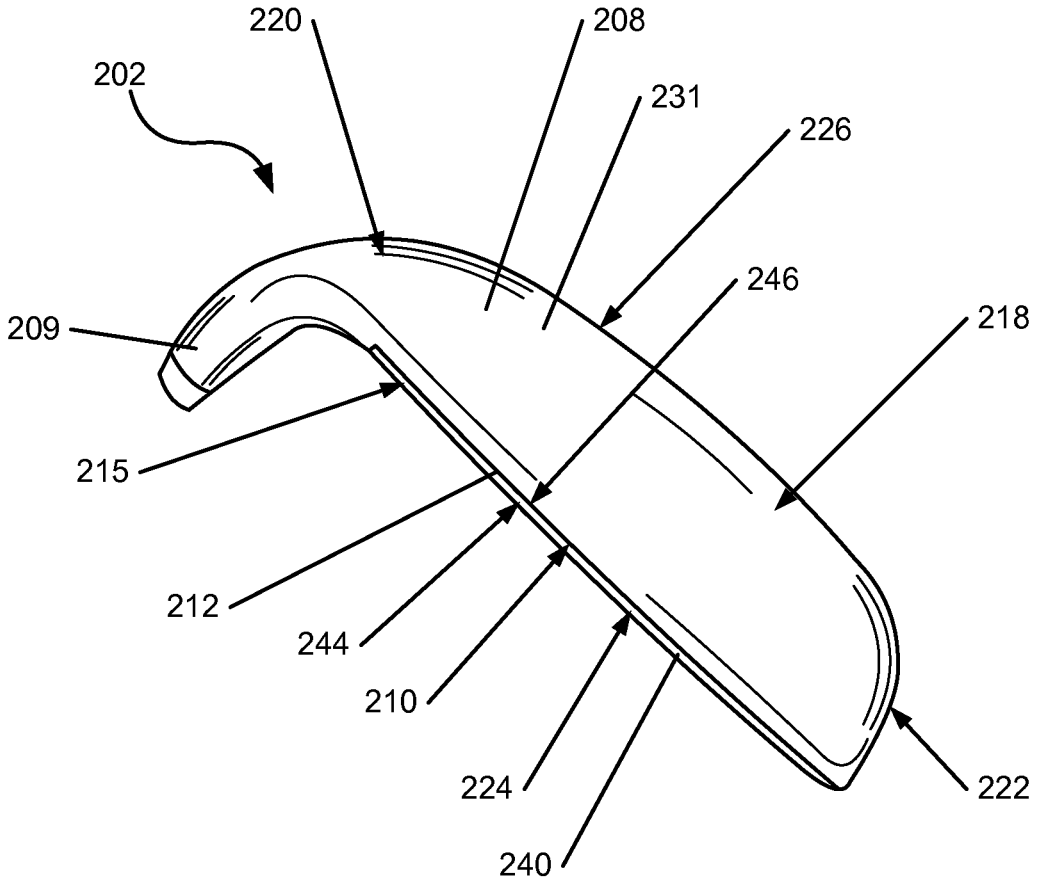
FIG. 11 is a bottom view of the head of FIG. 8.

The head 202 of FIGS. 8-11 has a face 212 with a substantially flat outer surface 210 that contains no recess as in the head 102 in FIGS. 2-6. The head 202 also includes a face mask 240 that is configured for attachment to the face 212. The face mask is formed as a plate member or face plate defined by a top side 241, a bottom side 243, a heel side 245, and a toe side 247, as illustrated in FIGS. 8-11. In this embodiment, the face mask 240 is positioned to cover all or substantially all of the outer surface 210 of the face 212. The top side 241, the bottom side 243, the heel side 245, and the toe side 247 of the face mask 240 are contoured similarly to the top edge 213, the bottom edge 215, the heel edge 217, and the toe edge 219 of the face 212, respectively, and are substantially flush with the top, bottom, heel, and toe edges 213, 215, 217, 219 of the face 212. Additionally, both the inner surface 246 of the face mask 240 and the outer surface 210 of the face 212 are substantially flat, and the inner surface 246 of the face mask 240 is arranged in confronting relation to the outer surface 210 of the face 212 and engages the outer surface 210 in surface-to-surface contact. In this arrangement, the outer surface 244 of the face mask 240 forms the entire ball striking surface 242 of the head 202. As shown in FIG. 10A, the slots 248 extend completely through the face mask 240, from the inner surface 246 to the outer surface 244. In this embodiment, the slots 248 have side walls 249 configured similarly to the slots 148 of FIGS. 2-6, extending from the inner surface 246 to the outer surface 244. The slots 248 of the face mask 240 form the grooves 221 on the ball striking surface 242, such that the grooves are defined by the side walls 249 of the slots 248 and portions of the outer surface 210 of the face, as also shown in FIG. 10A. The face mask 240 can be connected to the face 212 in any manner described above. In the embodiment shown, the face mask 240 is connected to the face 212 by a bonding material, as described above.

Figure 7:
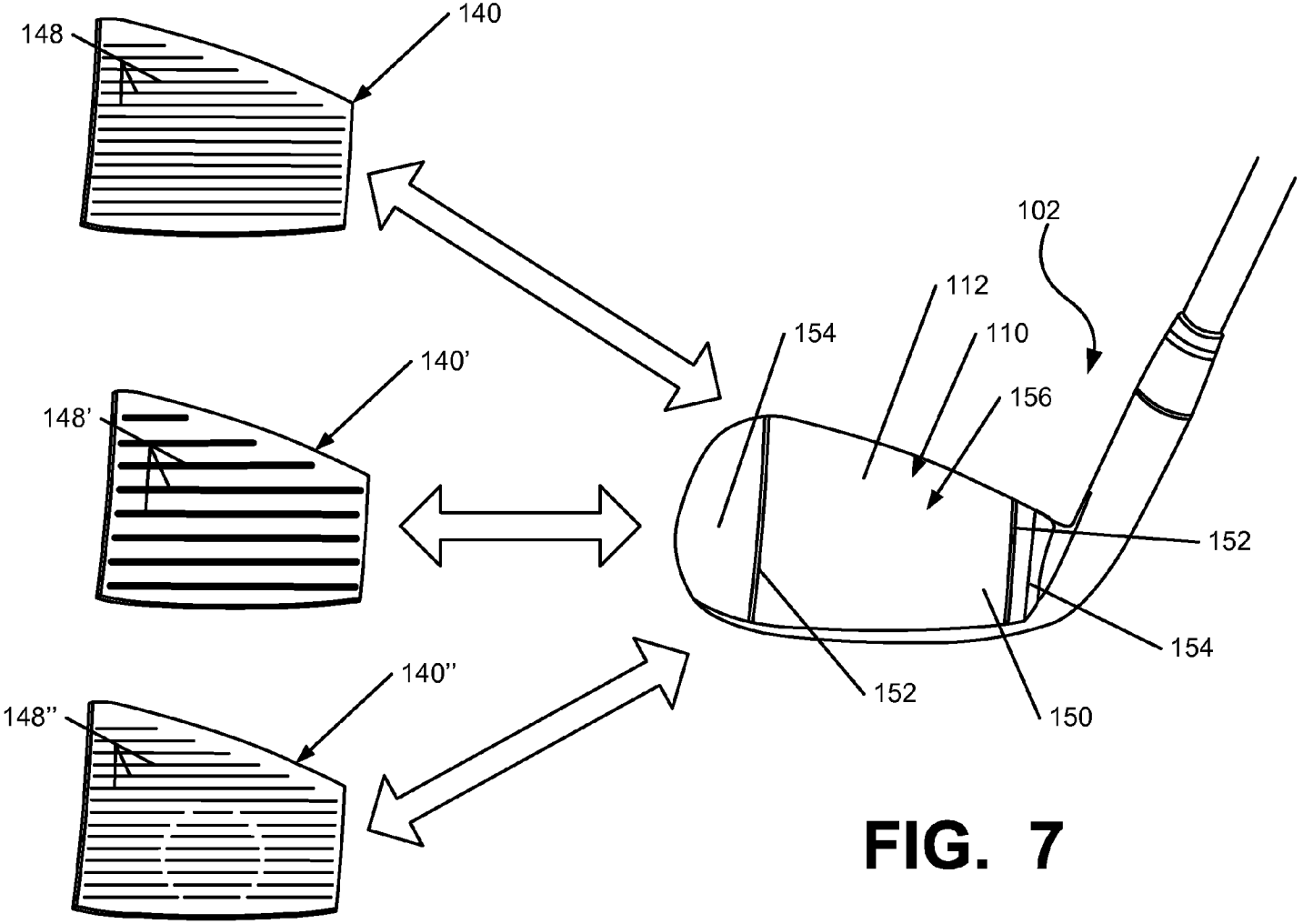
FIG. 7 is a front view of a portion of the head of FIG. 2 and a plurality of face masks configured for connection to the head.
Figure 8:
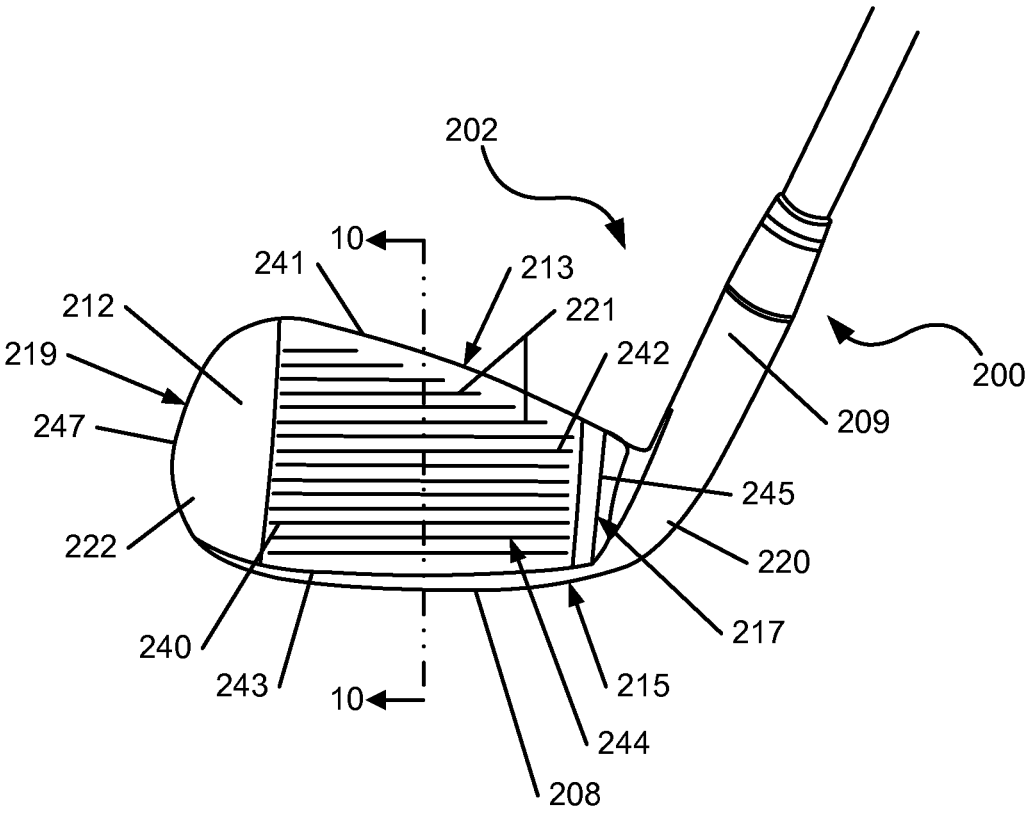
FIG. 8 is a front view of a second illustrative embodiment of a head of an iron-type ball striking device according to aspects of the present invention.
Figure 9:
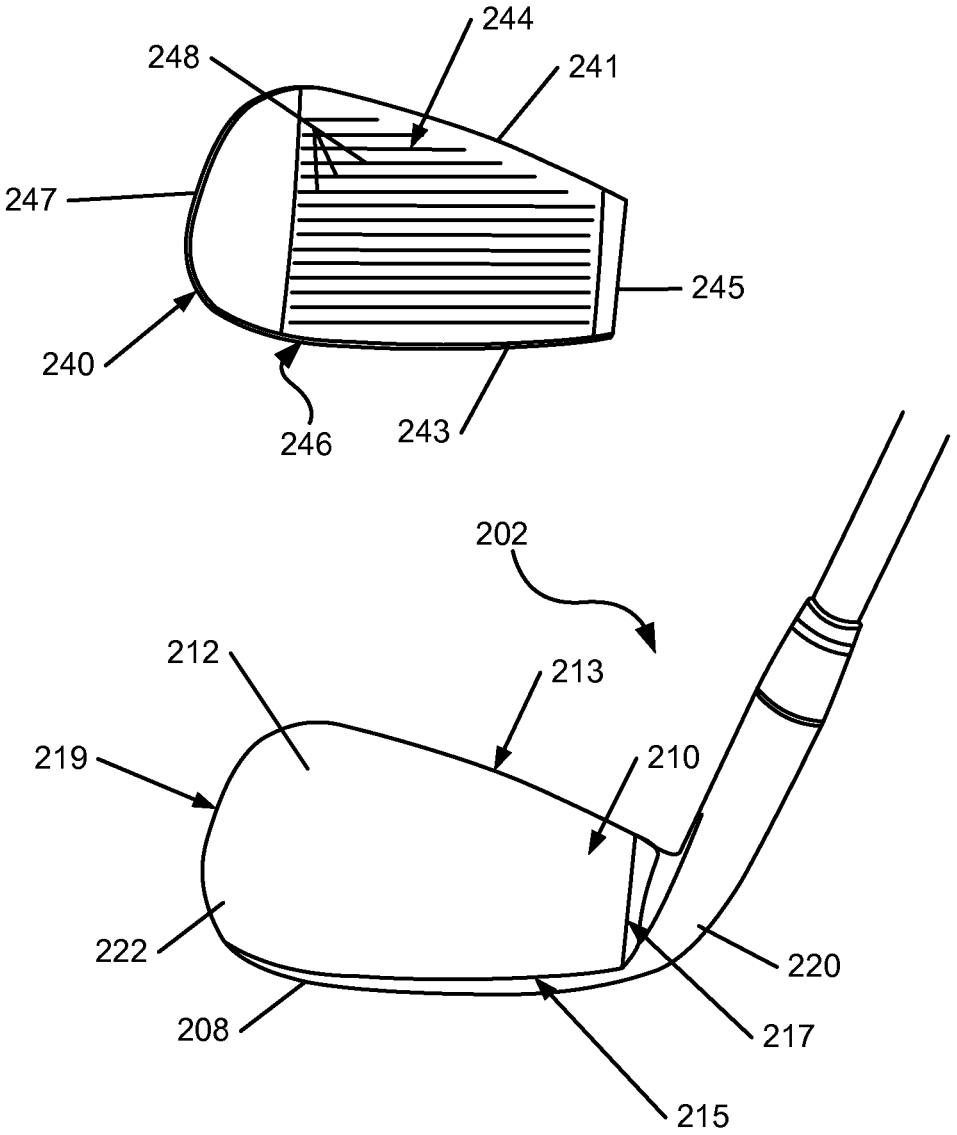
FIG. 9 is an exploded front view of the head of FIG. 8.
Figure 12:
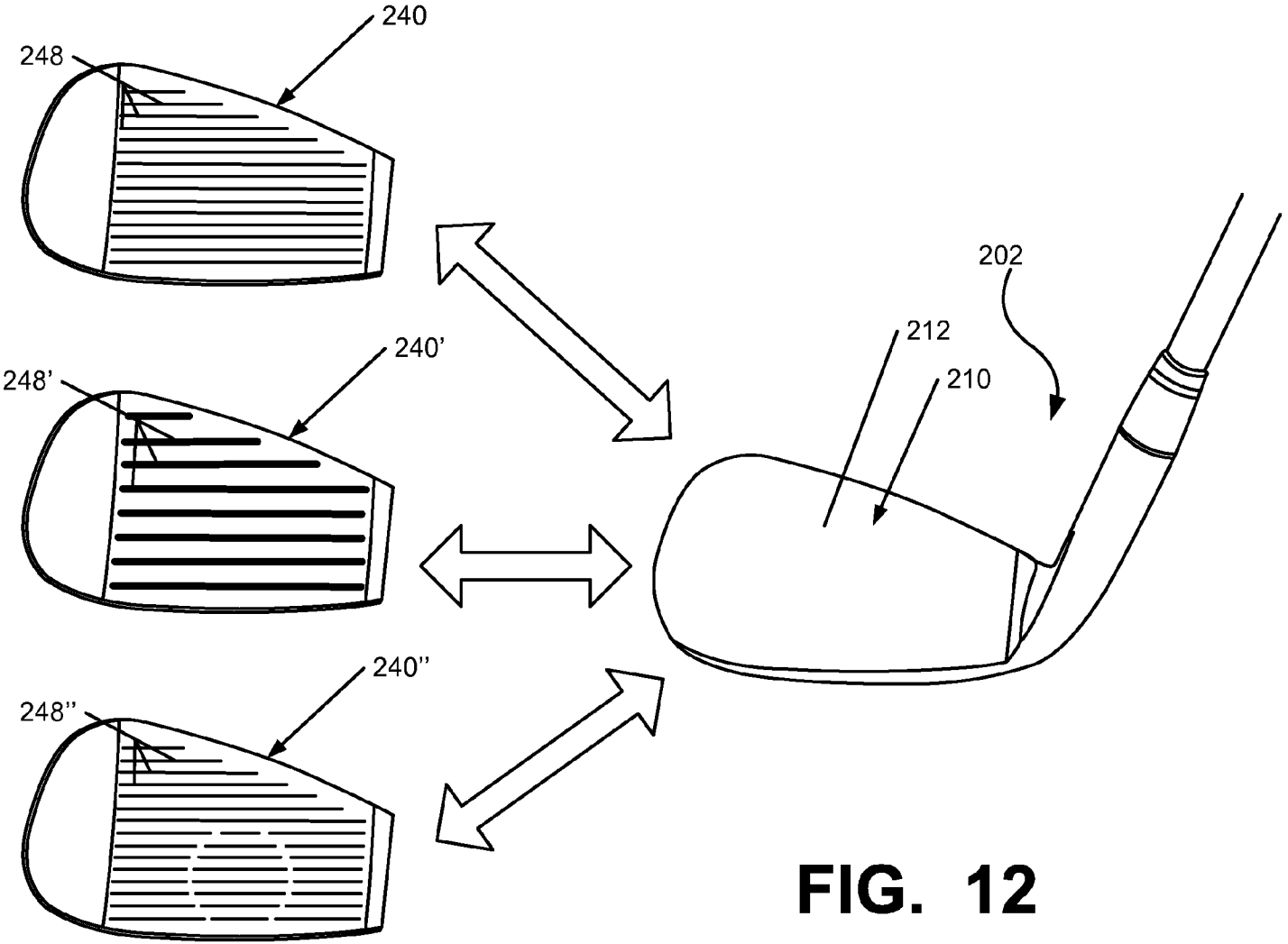
FIG. 12 is a front view of a portion of the head of FIG. 8 and a plurality of face masks configured for connection to the head.
Figure 13:
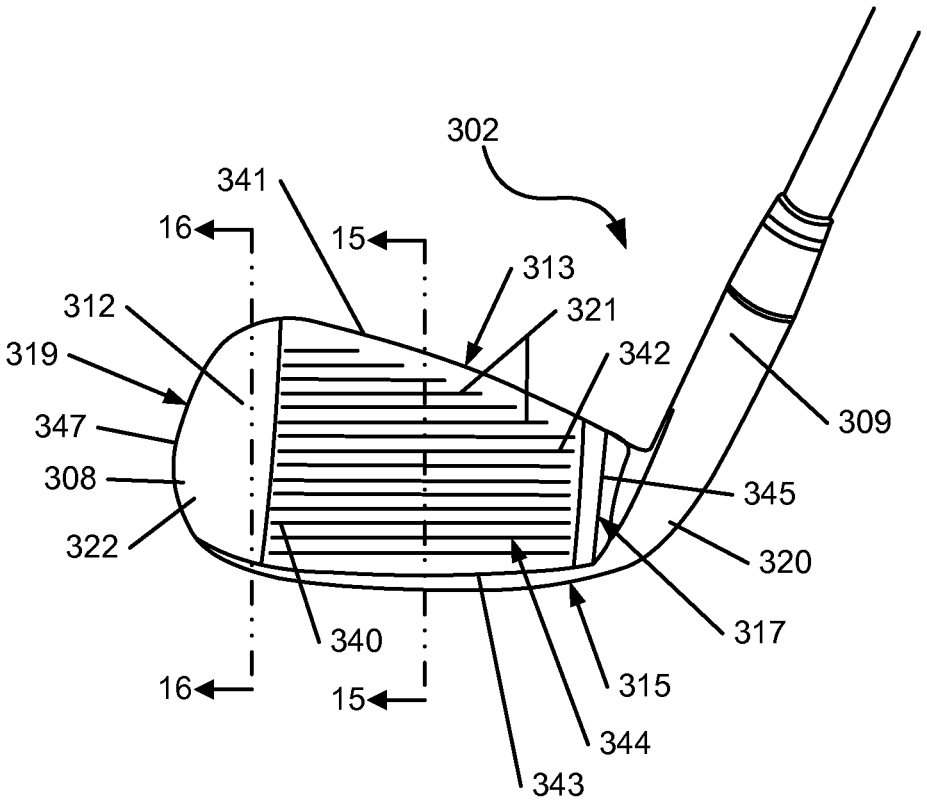
FIG. 13 is a front view of a third illustrative embodiment of a head of an iron-type ball striking device according to aspects of the present invention.
Figure 14:
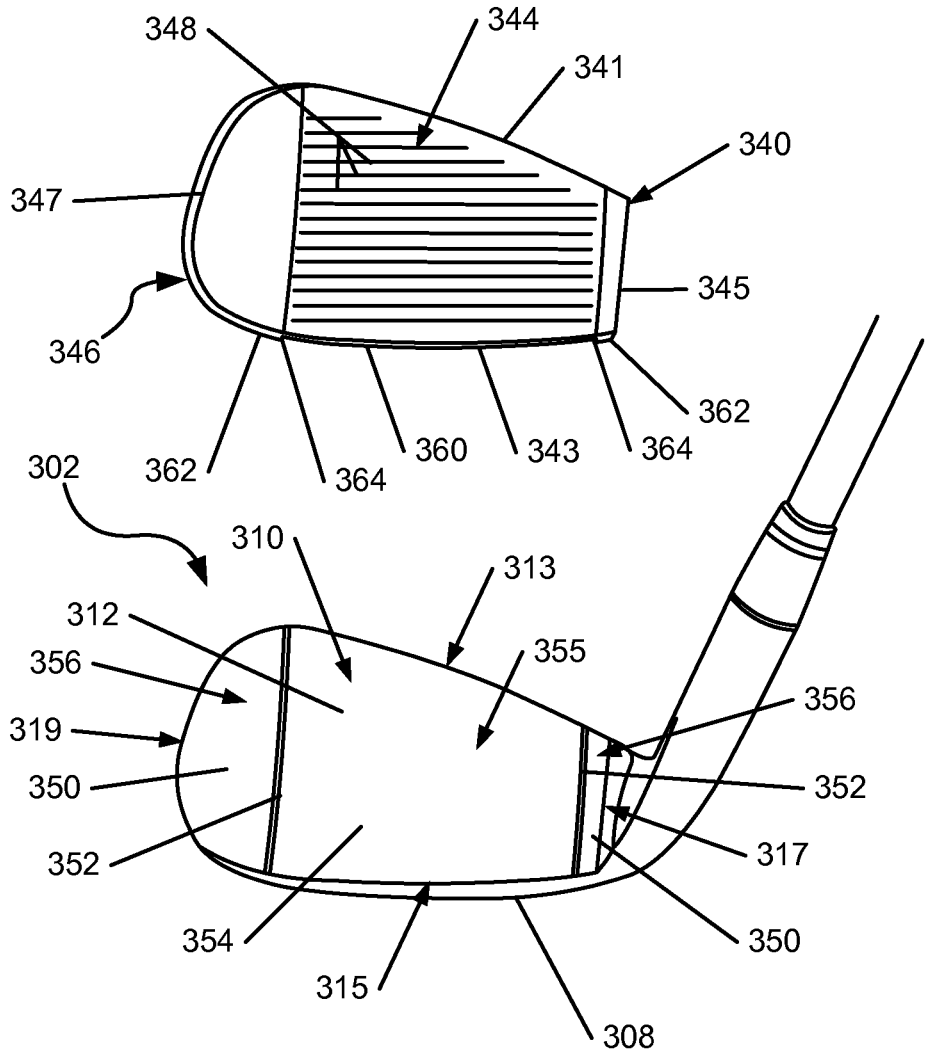
FIG. 14 is an exploded front view of the head of FIG. 13.

As also similarly described above with respect to FIG. 7, the head 202 may be configured for connection to a plurality of different face masks 240. FIG. 12 illustrates a head 202 as shown in FIGS. 8-11, with three different face masks 240, 240', 240" configured for connection thereto. The first face mask 240 is identical to the face mask 240 described above and shown in FIGS. 8-11. The second and third face masks 240', 240" have patterns and arrangements of slots 248', 248" that are similar to the face masks 140', 140" described above and shown in FIG. 7. It is also understood that interchangeable face masks 140, 240 as shown in FIGS. 7 and 12 may be used in connection with any of the embodiments described herein, and that the interchangeable face masks 140, 240 may be differently configured in other embodiments.

FIGS. 13-17 illustrate another embodiment of a head 302 in accordance with the present invention. Many features of the head 302 of FIGS. 13-17 are similar to the features of the head 102 shown in FIGS. 2-6, and such similar features are identified by similar reference numerals in FIGS. 13-17 using the "3xx" series of reference numerals. Accordingly, certain features of the head 302 of FIGS. 13-17 that are already described above may described below using less detail, or may not be described at all.

The head 302 of FIGS. 13-17 has a face 312 and a face mask 340 that have complementary interlocking shapes for connection of the face mask 340 to the face 312. The outer surface 310 of the face 312 has a raised portion 354 proximate the center of the face 312 with recesses 350 located proximate the heel 320 and toe 322 of the head 302, and portions of the face mask 340 are received within the recesses 350 when the face mask 340 is mounted to the face 312. The raised portion 354 is defined by a peripheral boundary that extends from the top edge 313 to the bottom edge 315 of the face 312, and is further defined by substantially vertical edges 352 separating the raised portion 354 from the recessed portions 350. As a result, the outer surface 310 of the face 312 has recessed surfaces 356 within the recesses 350 and a raised surface 355 on the raised portion 354 that is raised with respect to the recessed surfaces 356.

Figure 15:
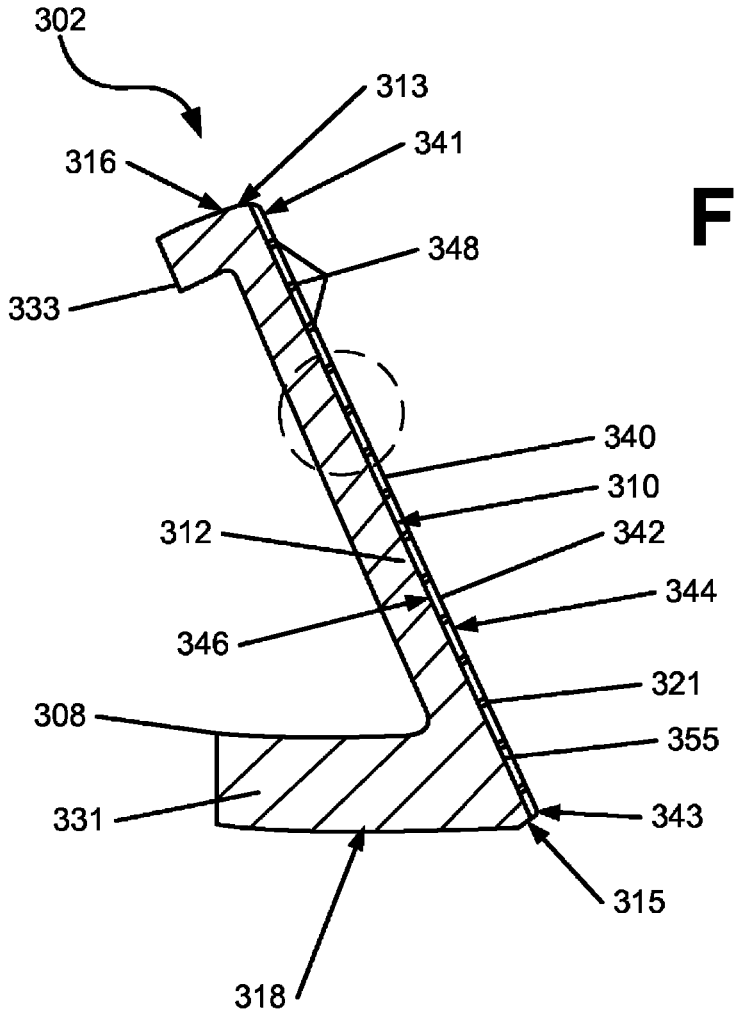
FIG. 15 is a cross-section view of the head of FIG. 13, taken along lines 15-15 of FIG. 13.
Figure 16:
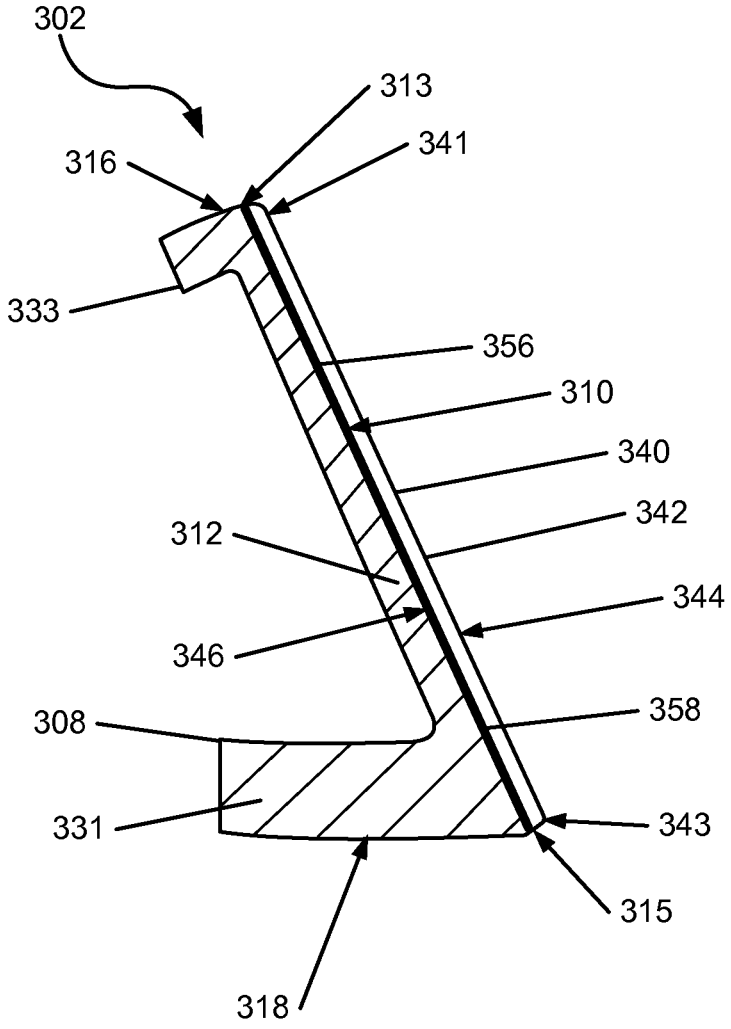
FIG. 16 is a cross-section view of the head of FIG. 13, taken along lines 16-16 of FIG. 13.
Figure 17:
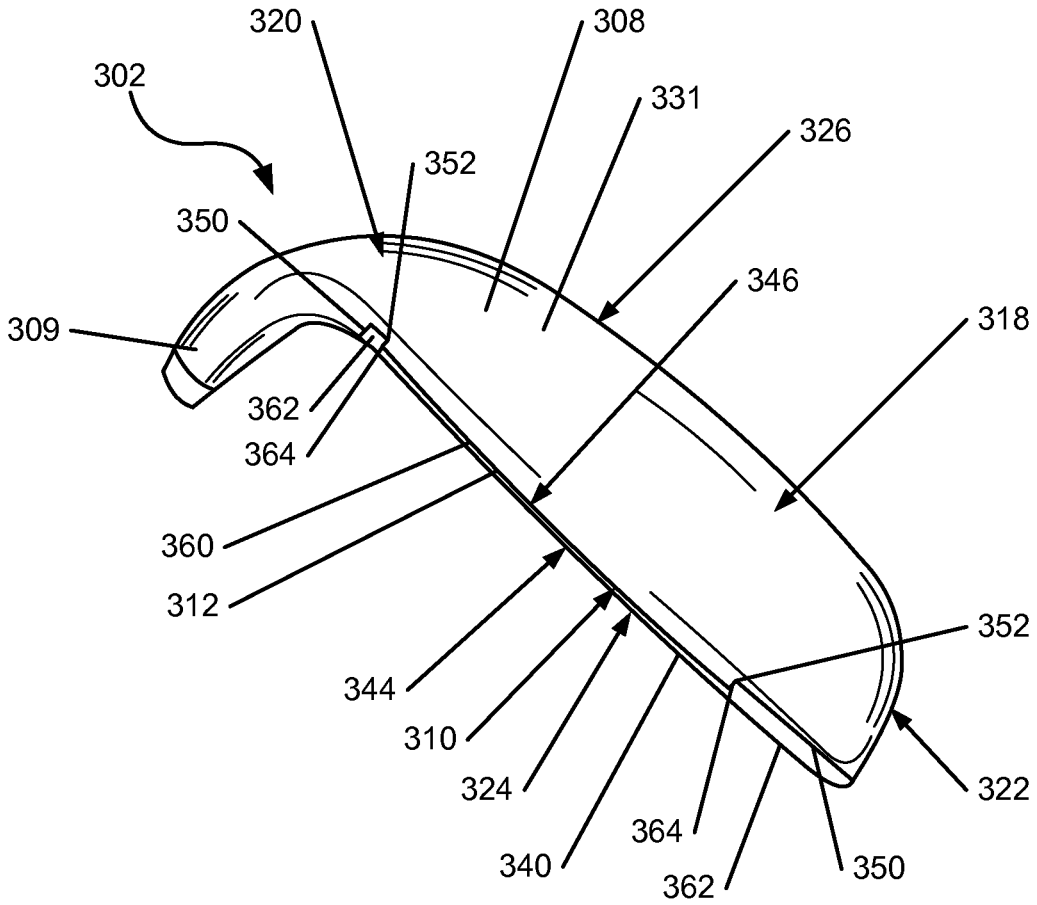
FIG. 17 is a bottom view of the head of FIG. 13.

The head 302 also includes a face mask 340 that is configured for attachment to the face 312, and is defined by a top side 341, a bottom side 343, a heel side 345, and a toe side 347, as illustrated in FIGS. 13-17. In this embodiment, the inner surface 346 of the face mask 340 has a recessed portion 360 with raised portions 362 proximate the heel side 345 and toe side 347, with substantially vertical edges 364 separating the recessed portion 360 from the raised portions 362. The thickness of the face mask 340 is smaller at the recessed portion 360 than at the raised portions 362. In this embodiment, the face mask 340 is positioned to cover all or substantially all of the outer surface 310 of the face 312. The top side 341, the bottom side 343, the heel side 345, and the toe side 347 of the face mask 340 are contoured similarly to the top edge 313, the bottom edge 315, the heel edge 317, and the toe edge 319 of the face 312, respectively, and are substantially flush with the top, bottom, heel, and toe edges 313, 315, 317, 319 of the face 312. Additionally, the raised portions 362 of the face mask 340 are received in the recesses 350 on the face 312, and the raised portion 354 of the face 312 is received within the recessed portion 360 of the face mask 340. The inner surface 346 of the face mask 340 is arranged in confronting relation to the outer surface 310 and engages the outer surface 310 of the face 312 in surface-to-surface contact. FIGS. 15-16 illustrate the engagement of the inner surface 346 of the face mask 340 and the outer surface 310 of the face 312, and also illustrate the difference in thickness of the face mask 340 at the recessed portion 360 and the raised portions 362.

Figure 15A:
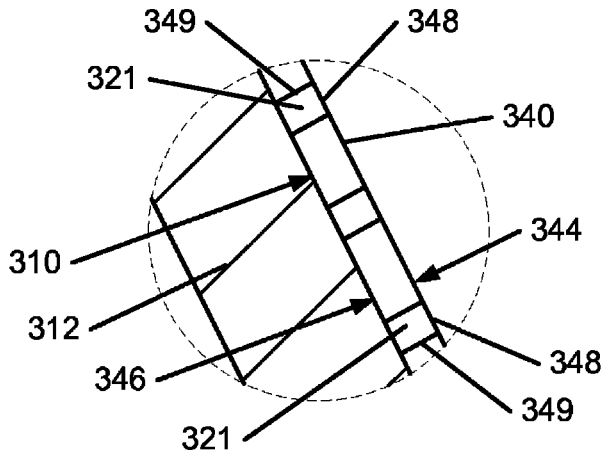
FIG. 15A is a magnified view of a portion of the head as shown in FIG. 15.

In this arrangement, the outer surface 344 of the face mask 340 forms the entire ball striking surface 342 of the head 302. As shown in FIG. 15A, the slots 348 extend completely through the face mask 340, from the inner surface 346 to the outer surface 344. In this embodiment, the slots 348 have side walls 349 configured similarly to the slots 148 of FIGS. 2-6, extending from the inner surface 346 to the outer surface 344. The slots 348 of the face mask 340 form the grooves 321 on the ball striking surface 342, such that the grooves are defined by the side walls 349 of the slots 348 and portions of the outer surface 310 of the face, as also shown in FIG. 15A.

The face mask 340 can be connected to the face 312 in any manner described above. In the embodiment shown, the face mask 340 is connected to the face 312 by a bonding material, as described above. In this embodiment, the bonding material 358 connects the inner surface 346 of the face mask 340 at the raised portions 362 to the recessed surfaces 356 of the face 312, but is not present between the recessed portion 360 of the face mask 340 and the raised portion 354 of the face 312, as shown in FIGS. 15-16.

Figure 18:
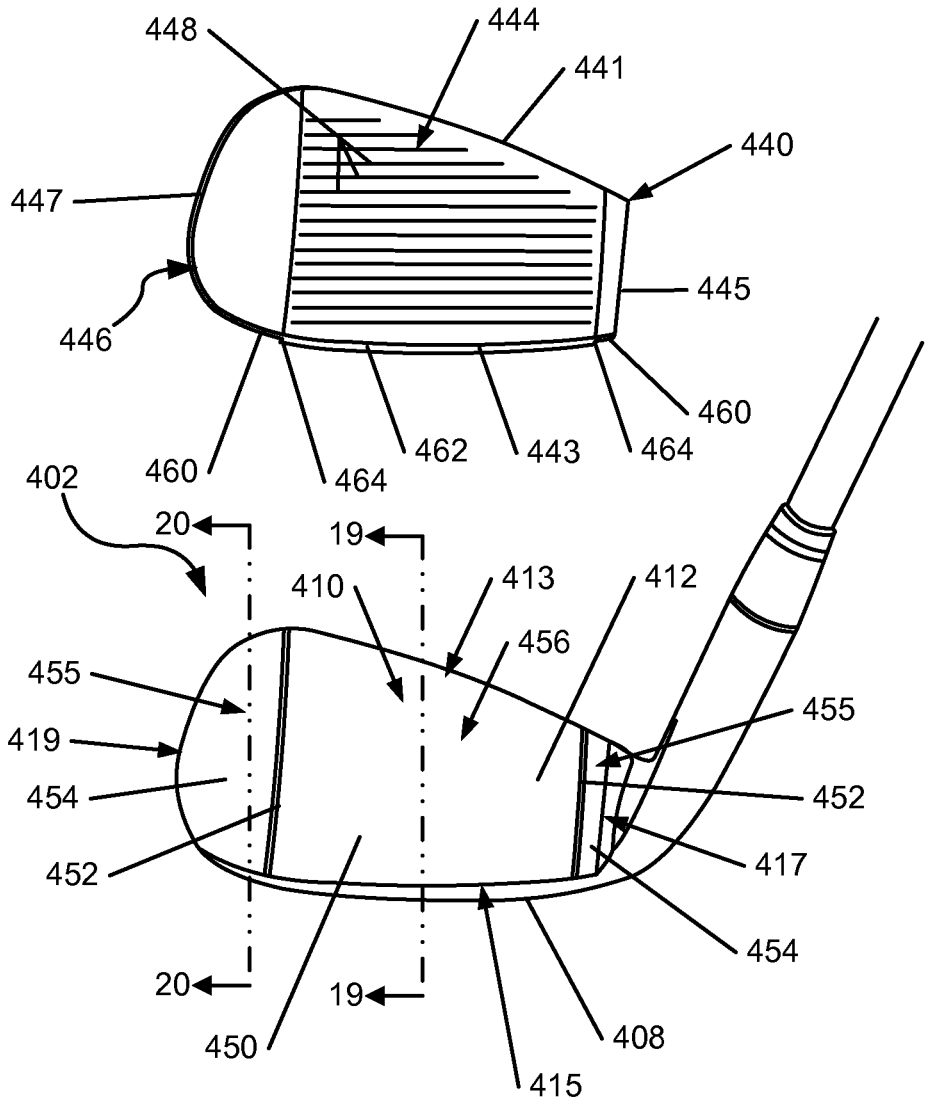
FIG. 18 is an exploded front view of a fourth illustrative embodiment of a head of an iron-type ball striking device according to aspects of the present invention.
Figure 20:
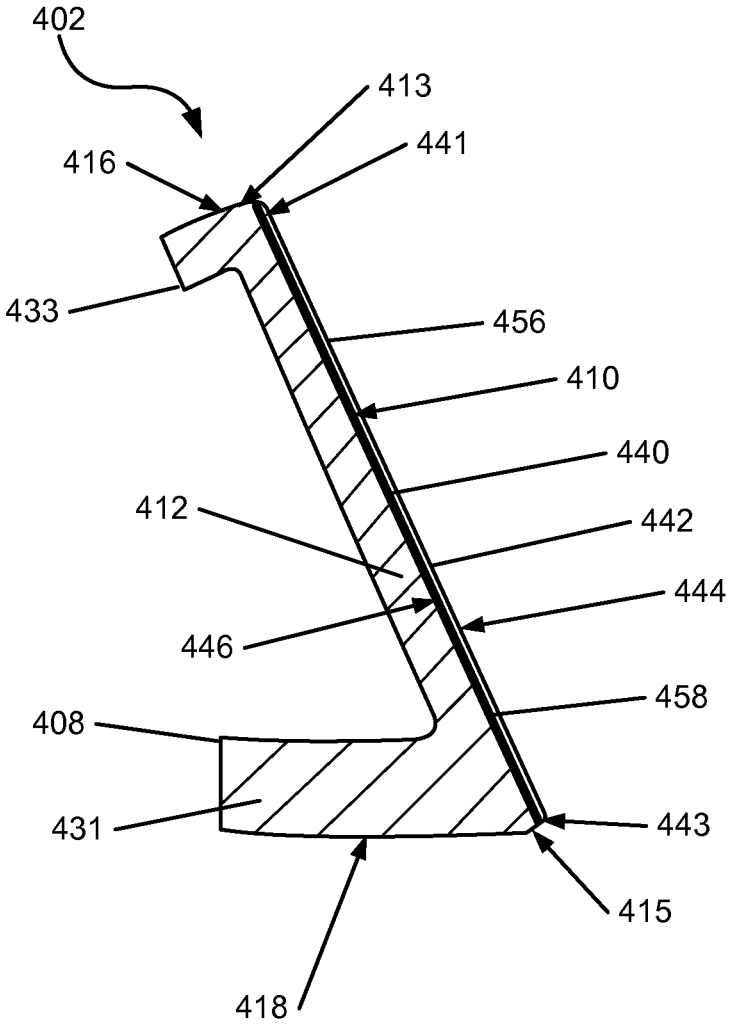
FIG. 20 is a cross-section view of the head of FIG. 18, taken along lines 20-20 of FIG. 18.

FIGS. 18-20 illustrate another embodiment of a head 402 in accordance with the present invention. Many features of the head 402 of FIGS. 18-20 are similar to the features of the heads 102, 202, 302 shown in FIGS. 2-6, 8-11, and 13-17 and such similar features are identified by similar reference numerals in FIGS. 18-20 using the "4xx" series of reference numerals. Accordingly, certain features of the head 402 of FIGS. 18-20 that are already described above may described below using less detail, or may not be described at all.

The head 402 of FIGS. 18-20 has a face 412 and a face mask 440 that have complementary interlocking shapes for connection of the face mask 440 to the face 412. The face 412 and body 408 of the head 402 are configured similarly to the head 102 of FIGS. 2-6. As such, the outer surface 410 of the face 412 has a recess 450 proximate the center of the face 412 with raised portions 454 located proximate the heel 420 and toe 422 of the head 402, with substantially vertical edges 452 separating the raised portions 454 from the recess 450. As a result, the outer surface 410 of the face 412 has a recessed surface 456 within the recess 450 and raised surfaces 455 on the raised portions 454 that are raised with respect to the recessed surfaces 456.

The head 402 also includes a face mask 440 that is configured for attachment to the face 412, and is defined by a top side 441, a bottom side 443, a heel side 445, and a toe side 447, as illustrated in FIGS. 18-20. In this embodiment, the inner surface 446 of the face mask 440 has a raised portion 462 proximate the center and recessed portions 460 proximate the heel side 445 and toe side 447, with substantially vertical edges 464 separating the recessed portions 460 from the raised portion 462. The thickness of the face mask 440 is smaller at the recessed portions 460 than at the raised portion 462. Accordingly, the raised portion 462 may be alternately described as a projecting portion that has two thinned portions (i.e. the recessed portions 460) extending from opposite sides thereof. In this embodiment, the face mask 440 is positioned to cover all or substantially all of the outer surface 410 of the face 412. The top side 441, the bottom side 443, the heel side 445, and the toe side 447 of the face mask 440 are contoured similarly to the top edge 413, the bottom edge 415, the heel edge 417, and the toe edge 419 of the face 412, respectively, and are substantially flush with the top, bottom, heel, and toe edges 413, 415, 417, 419 of the face 412. Additionally, the raised portion 462 of the face mask 440 is received in the recess 450 on the face 412, and the raised portions 454 of the face 412 are received within the recessed portions 460 of the face mask 440. The inner surface 446 of the face mask 440 is arranged in confronting relation to the outer surface 410 of the face 412 and engages the outer surface 410 in surface-to-surface contact. FIGS. 19-20 illustrate the engagement of the inner surface 446 of the face mask 440 and the outer surface 410 of the face 412, and also illustrate the difference in thickness of the face mask 440 at the recessed portions 460 and the raised portion 462.

In this arrangement, the outer surface 444 of the face mask 440 forms the entire ball striking surface 442 of the head 402. As shown in FIG. 19A, the slots 448 extend completely through the face mask 440, from the inner surface 446 to the outer surface 444. In this embodiment, the slots 448 have side walls 449 configured similarly to the slots 148 of FIGS. 2-6, extending from the inner surface 446 to the outer surface 444. The slots 448 of the face mask 440 form grooves on the ball striking surface 442, such that the grooves are defined by the side walls 449 of the slots 448 and portions of the outer surface 410 of the face, as also shown in FIG. 19A.

The face mask 440 can be connected to the face 412 in any manner described above. In the embodiment shown, the face mask 440 is connected to the face 412 by a bonding material, as described above. In this embodiment, the bonding material 458 connects the inner surface 446 of the face mask 440 at the recessed portion 460 to the raised portions 454 of the face 412, but is not present between the raised portion 462 of the face mask 440 and the recess 450 of the face 412, as shown in FIGS. 19-20.

Figure 21:
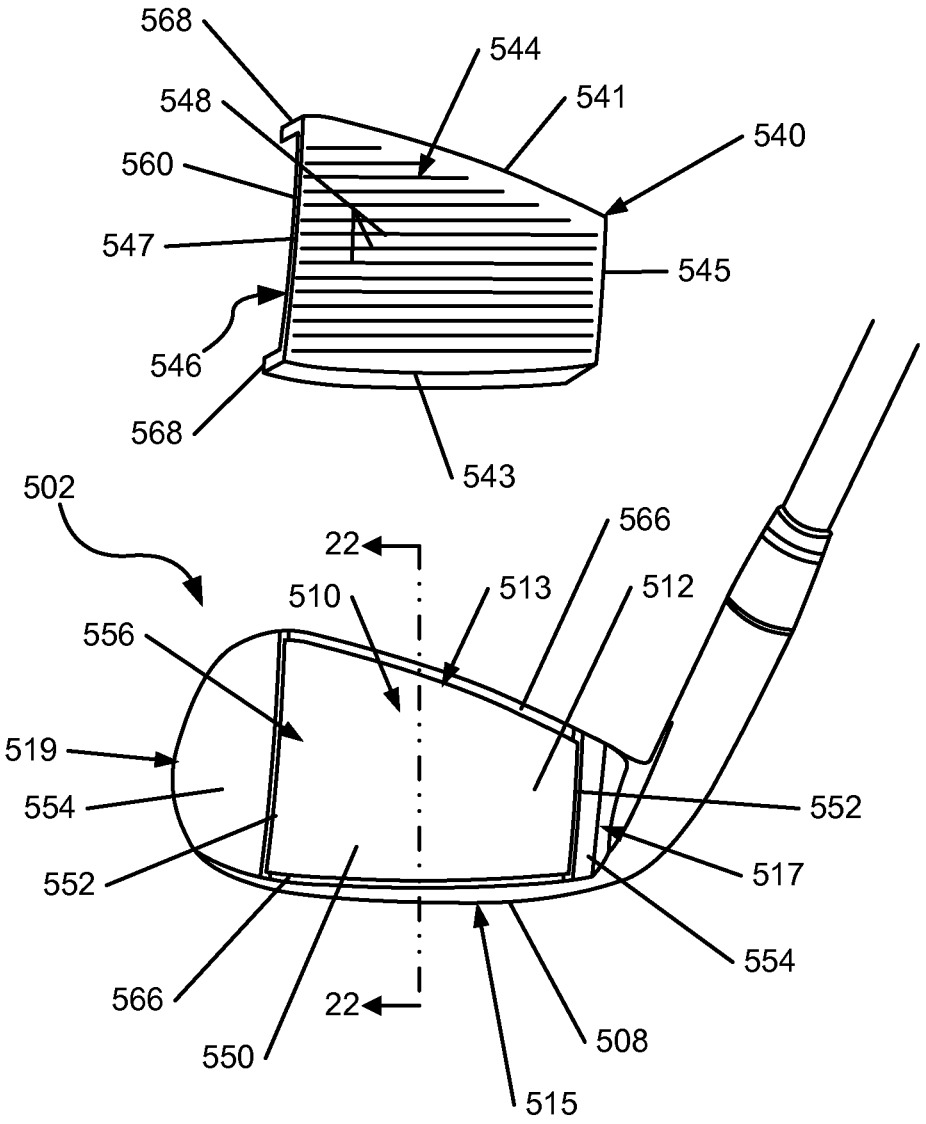
FIG. 21 is an exploded front view of a fifth illustrative embodiment of a head of an iron-type ball striking device according to aspects of the present invention.
Figure 22:
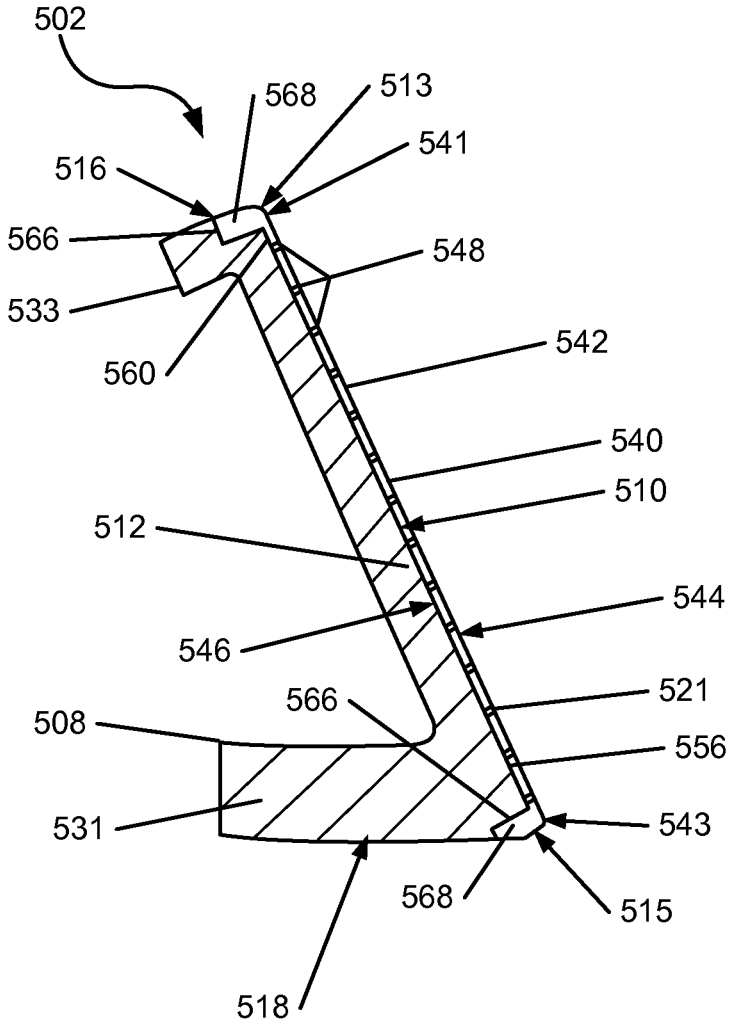
FIG. 22 is a cross-section view of the head of FIG. 21, taken along lines 22-22 of FIG. 21.

FIGS. 21-22 illustrate another embodiment of a head 502 in accordance with the present invention. Many features of the head 502 of FIGS. 21-22 are similar to the features of the heads 102, 202, 302, 402 shown in FIGS. 2-6, 8-11, and 13-20 and such similar features are identified by similar reference numerals in FIGS. 21-22 using the "5xx" series of reference numerals. Accordingly, certain features of the head 502 of FIGS. 21-22 that are already described above may described below using less detail, or may not be described at all.

The head 502 of FIGS. 21-22 has a face 512 and a face mask 540 that have complementary interlocking shapes for connection of the face mask 540 to the face 512. The outer surface 510 of the face 512 has a recess 550 positioned proximate the center of the face 512, with edge recesses 566 positioned along the top edge 513 and the bottom edge 515 of the face 512 within the recess 550. The recess 550 has substantially vertical edges 552 separating the recessed surface 556 of the recess 550 from raised portions 554 located proximate the heel 520 and toe 522 of the head 502. The edge recesses 566 are further recessed with respect to the recessed surface 556.

The head 502 also includes a face mask 540 that is configured for attachment to the face 512, and is defined by a top side 541, a bottom side 543, a heel side 545, and a toe side 547, as illustrated in FIGS. 21-22. In this embodiment, the inner surface 546 of the face mask 540 has peripheral walls 568 extending rearward from the top side 541 and bottom side 543 of the face mask 540, with a recessed portion 560 between the peripheral walls 568, giving the face mask 540 a partial cup-like structure. Additionally, in this embodiment, the face mask 540 is positioned at least partially within the recess 550, and the outer surface 544 of the face mask 540 is substantially flush with the raised portions 554 of the outer surface 510 of the face 512. The top side 541 and the bottom side 543 of the face mask 540 are contoured similarly to the top edge 513 and the bottom edge 515 of the face 512, respectively, and are substantially flush with the top and bottom edges 513, 515 of the face 512. The heel and toe sides 545, 547 of the face mask 540 engage the edges 552 of the recess 550. Additionally, the peripheral walls 568 of the face mask 540 are received in the edge recesses 566 on the face 512. The recessed portion 560 of the inner surface 546 of the face mask 540 is arranged in confronting relation to the recessed surface 556 the outer surface 510 of the face 512 and engages the outer surface 510 in surface-to-surface contact. FIG. 22 illustrates the engagement of the inner surface 546 of the face mask 540 and the outer surface 510 of the face 512.

In this arrangement, the outer surface 544 of the face mask 540 forms at least a portion of the ball striking surface 542 of the head 502, similarly to the face mask 140 shown in FIGS. 2-6. The slots 548 extend completely through the face mask 540, from the inner surface 546 to the outer surface 544, and are configured similarly to the slots 148 described above and shown in FIGS. 2-6, as well as other slots 248, 348, 448 described above. The face mask 540 can be connected to the face 512 in any manner described above. In the embodiment shown, the face mask 540 is connected to the face 512 by a bonding material, as described above.

Figure 23:
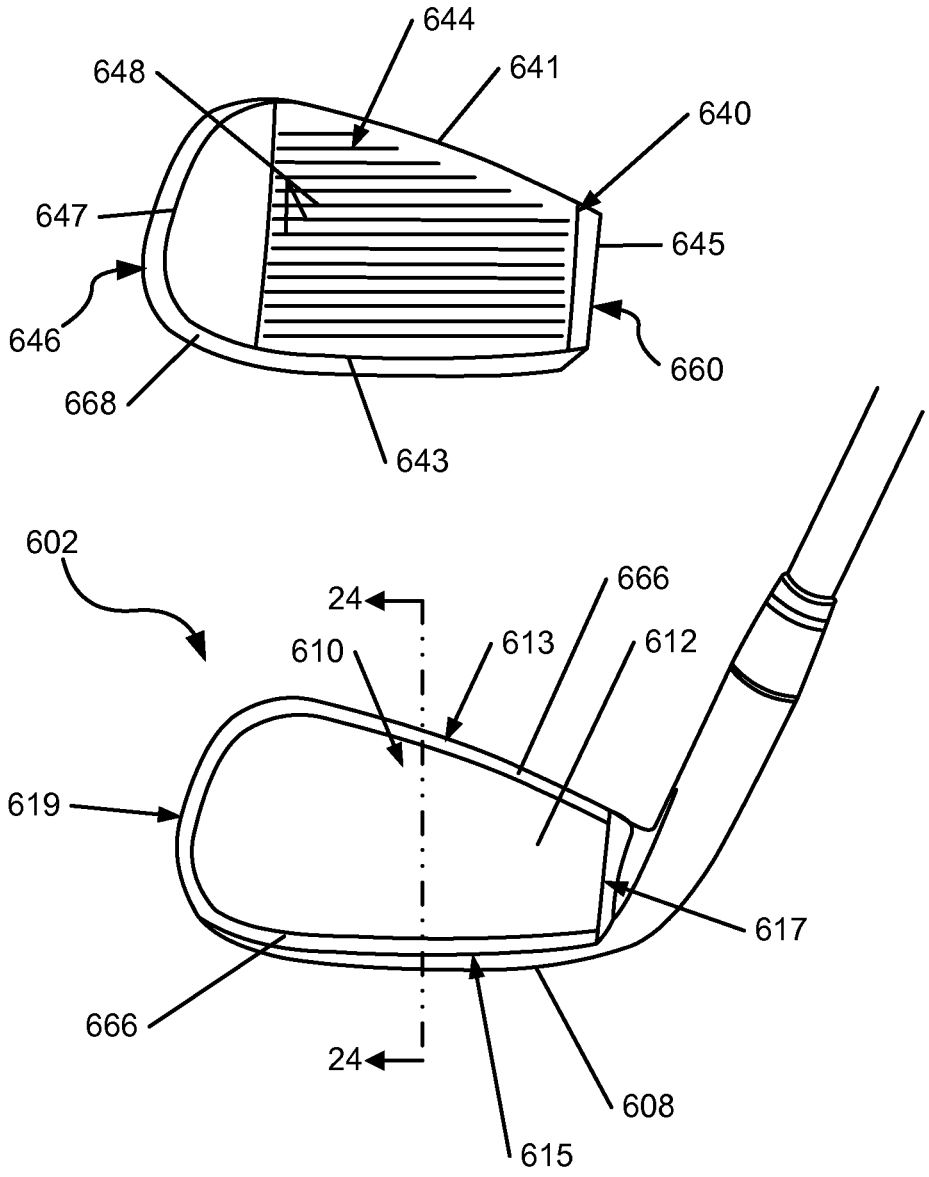
FIG. 23 is an exploded front view of a sixth illustrative embodiment of a head of an iron-type ball striking device according to aspects of the present invention.
Figure 24:
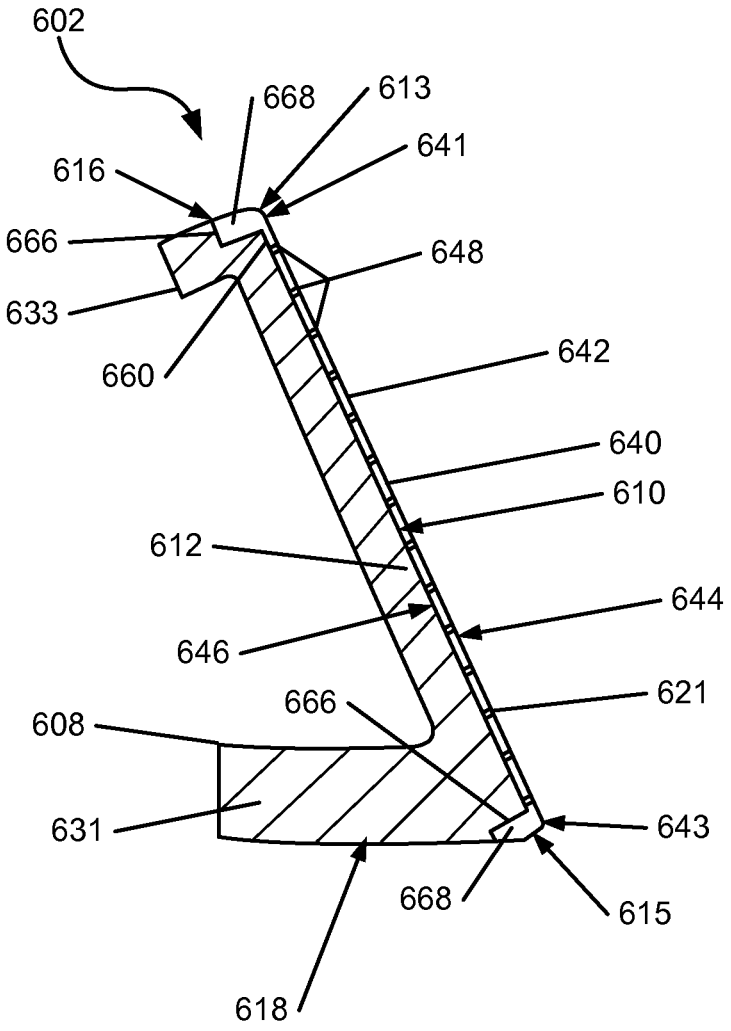
FIG. 24 is a cross-section view of the head of FIG. 23, taken along lines 24-24 of FIG. 23.

FIGS. 23-24 illustrate another embodiment of a head 602 in accordance with the present invention. Many features of the head 602 of FIGS. 23-24 are similar to the features of the heads 102, 202, 302, 402, 502 shown in FIGS. 2-6, 8-11, and 13-22 and such similar features are identified by similar reference numerals in FIGS. 23-24 using the "6xx" series of reference numerals. Accordingly, certain features of the head 602 of FIGS. 23-24 that are already described above may described below using less detail, or may not be described at all.

The head 602 of FIGS. 23-24 has a face 612 and a face mask 640 that have complementary interlocking shapes for connection of the face mask 640 to the face 612. The outer surface 610 of the face 612 is substantially flat, with edge recesses 666 positioned along the top edge 613 and the bottom edge 615 of the face 612. The edge recesses 666 are recessed with respect to the majority of the outer surface 610.

The head 602 also includes a face mask 640 that is configured for attachment to the face 612, and is defined by a top side 641, a bottom side 643, a heel side 645, and a toe side 647, as illustrated in FIGS. 23-24. In this embodiment, the inner surface 646 of the face mask 640 has peripheral walls 668 extending rearward from the top side 641, the bottom side 643, and the toe side 647 of the face mask 640, with a recessed portion 660 between the peripheral walls 668, giving the face mask 640 a partial cup-like structure. Additionally, in this embodiment, the face mask 640 covers substantially the entire outer surface 610 of the face 612. The top side 641, the bottom side 643, the heel side 645, and the toe side 647 of the face mask 640 are contoured similarly to the top edge 613, the bottom edge 615, the heel edge 617, and the toe edge 619 of the face 612, respectively, and are substantially flush with the top, bottom, heel, and toe edges 613, 615, 617, 619 of the face 612. The peripheral walls 668 of the face mask 640 are received in the edge recesses 666 on the face 612, and the majority of the outer surface 610 of the face 612 is received within the recessed portion 660 of the face mask 640. The recessed portion 660 of the inner surface 646 of the face mask 640 is arranged in confronting relation to the outer surface 610 of the face 612 and engages the outer surface 610 in surface-to-surface contact. FIG. 24 illustrates the engagement of the inner surface 646 of the face mask 640 and the outer surface 610 of the face 612.

In this arrangement, the outer surface 644 of the face mask 640 forms the entire ball striking surface 642 of the head 602, similarly to the face mask 240 shown in FIGS. 8-11. The slots 648 extend completely through the face mask 640, from the inner surface 646 to the outer surface 644, and are configured similarly to the slots 148 described above and shown in FIGS. 2-6, as well as other slots 248, 348, 448, 548 described above. The face mask 640 can be connected to the face 612 in any manner described above. In the embodiment shown, the face mask 640 is connected to the face 612 by a bonding material, as described above.

Figure 25:
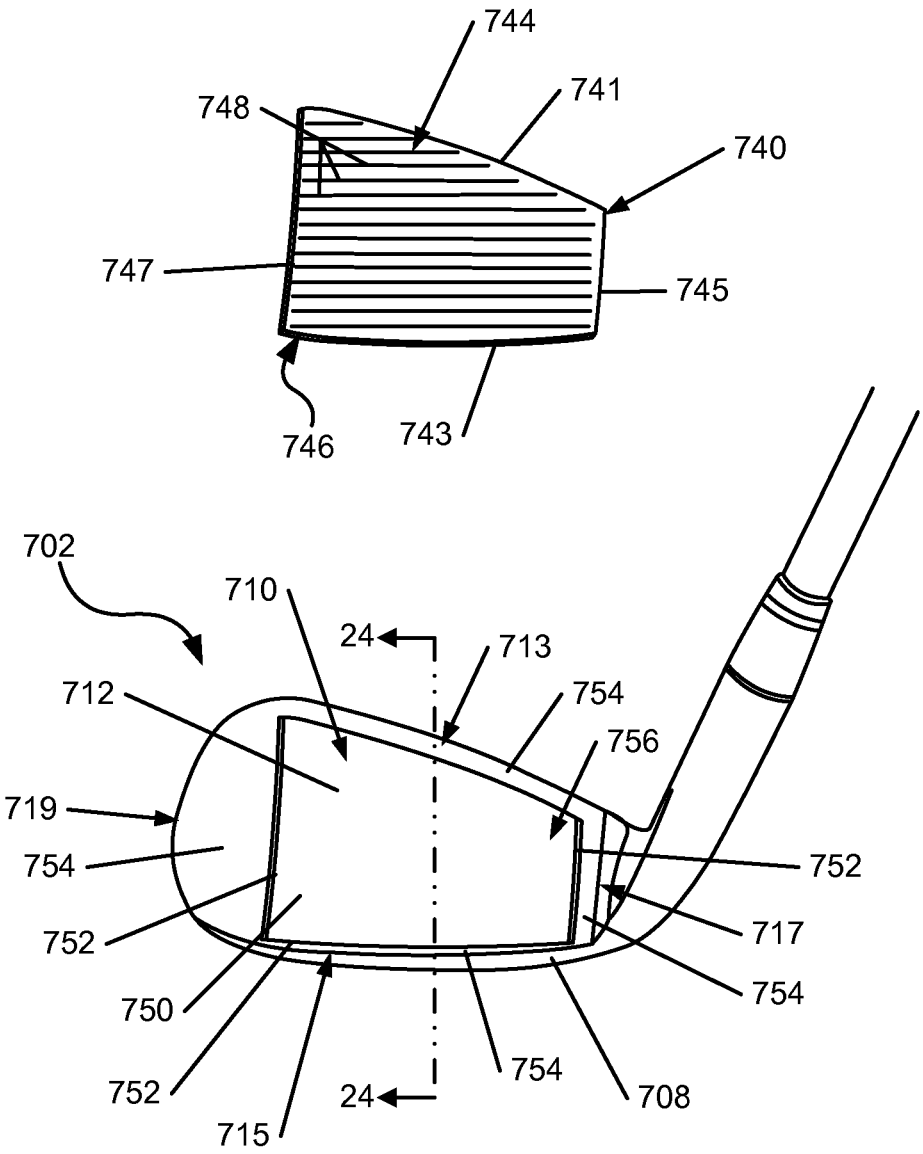
FIG. 25 is an exploded front view of a seventh illustrative embodiment of a head of an iron-type ball striking device according to aspects of the present invention.
Figure 26:
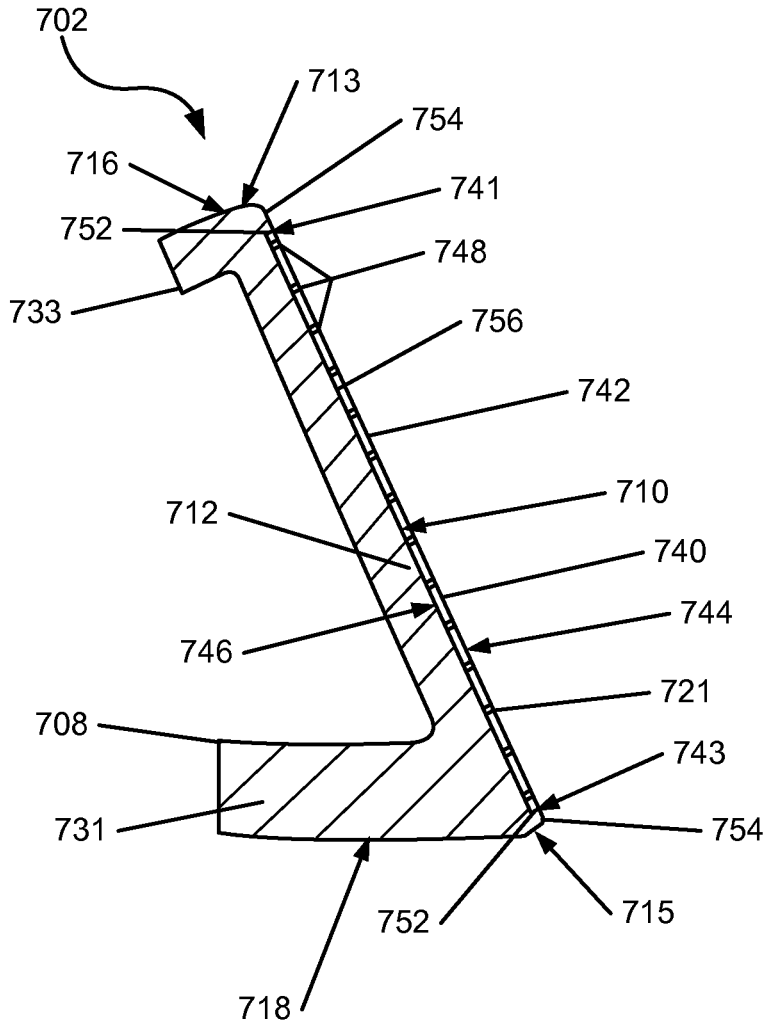
FIG. 26 is a cross-section view of the head of FIG. 25, taken along lines 26-26 of FIG. 25.

FIGS. 25-26 illustrate another embodiment of a head 702 in accordance with the present invention. Many features of the head 702 of FIGS. 25-26 are similar to the features of the heads 102, 202, 302, 402, 502, 602 shown in FIGS. 2-6, 8-11, and 13-24 and such similar features are identified by similar reference numerals in FIGS. 25-26 using the "7xx" series of reference numerals. Accordingly, certain features of the head 702 of FIGS. 25-26 that are already described above may described below using less detail, or may not be described at all.

The head 702 of FIGS. 25-26 has a face 712 having a recess 750 and a face mask 740 configured to be received in the recess 750. The outer surface 710 of the face 712 has a recess 750 with a recessed surface 756 proximate the center of the face 712 and raised portions 754 proximate the heel 720 and toe 722. The recess 750 is defined within the face 712 by a plurality of substantially vertical edges 752 located inwardly from the top, bottom, heel, and toe edges 713, 715, 717, 719 of the face 712.

The head 702 also includes a face mask 740 that is configured for attachment to the face 712, and is defined by a top side 741, a bottom side 743, a heel side 745, and a toe side 747, as illustrated in FIGS. 25-26. In this embodiment, the face mask 740 is received at least partially in the recess 750 and covers a portion of the outer surface 710 of the face 712. The top side 741, bottom side 743, heel side 745, and toe side 747 of the face mask 740 are all in engagement with the edges 752 defining the recess 750. The outer surface 744 of the face mask 740 is substantially flush with the raised portions 754 of the outer surface 710 of the face 712. The inner surface 746 of the face mask 740 is arranged in confronting relation to the recessed surface 756 of the outer surface 710 of the face 712 and engages the outer surface 710 in surface-to-surface contact. FIG. 26 illustrates the engagement of the inner surface 746 of the face mask 740 and the outer surface 710 of the face 712.

In this arrangement, the outer surface 744 of the face mask 740 forms at least a portion of the ball striking surface 742 of the head 702. The slots 748 extend completely through the face mask 740, from the inner surface 746 to the outer surface 744, and are configured similarly to the slots 148 described above and shown in FIGS. 2-6, as well as other slots 248, 348, 448, 548, 648 described above. The face mask 740 can be connected to the face 712 in any manner described above. In the embodiment shown, the face mask 740 is connected to the face 712 by a bonding material, as described above.

Figure 27:
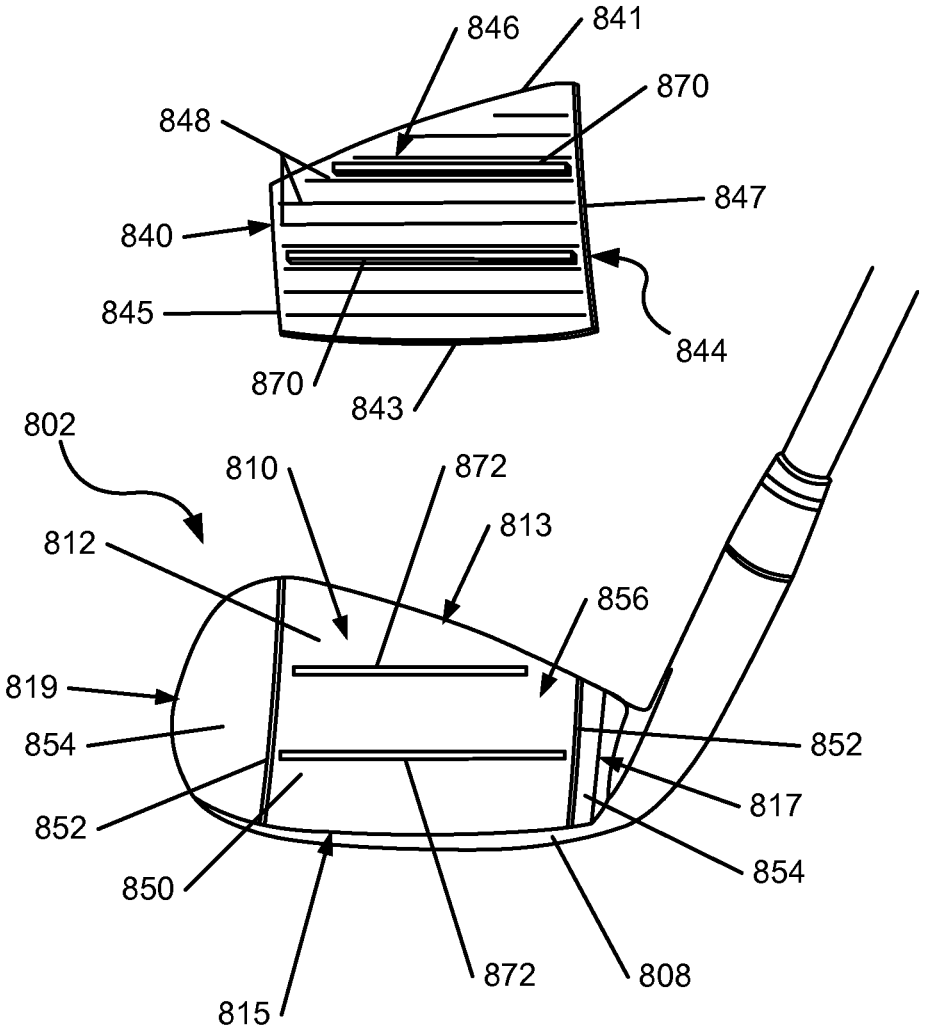
FIG. 27 is an exploded front view of an eighth illustrative embodiment of a head of an iron-type ball striking device according to aspects of the present invention.
Figure 28:
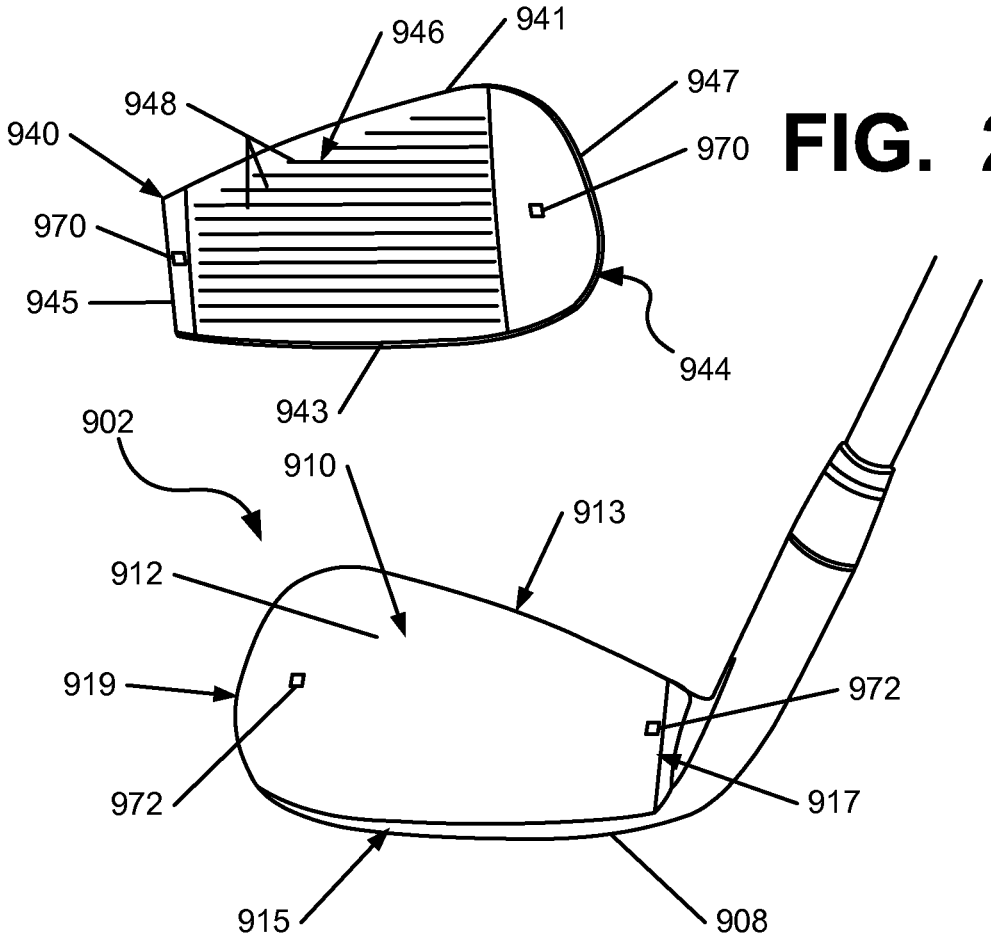
FIG. 28 is an exploded front view of a ninth illustrative embodiment of a head of an iron-type ball striking device according to aspects of the present invention.
Figure 29:
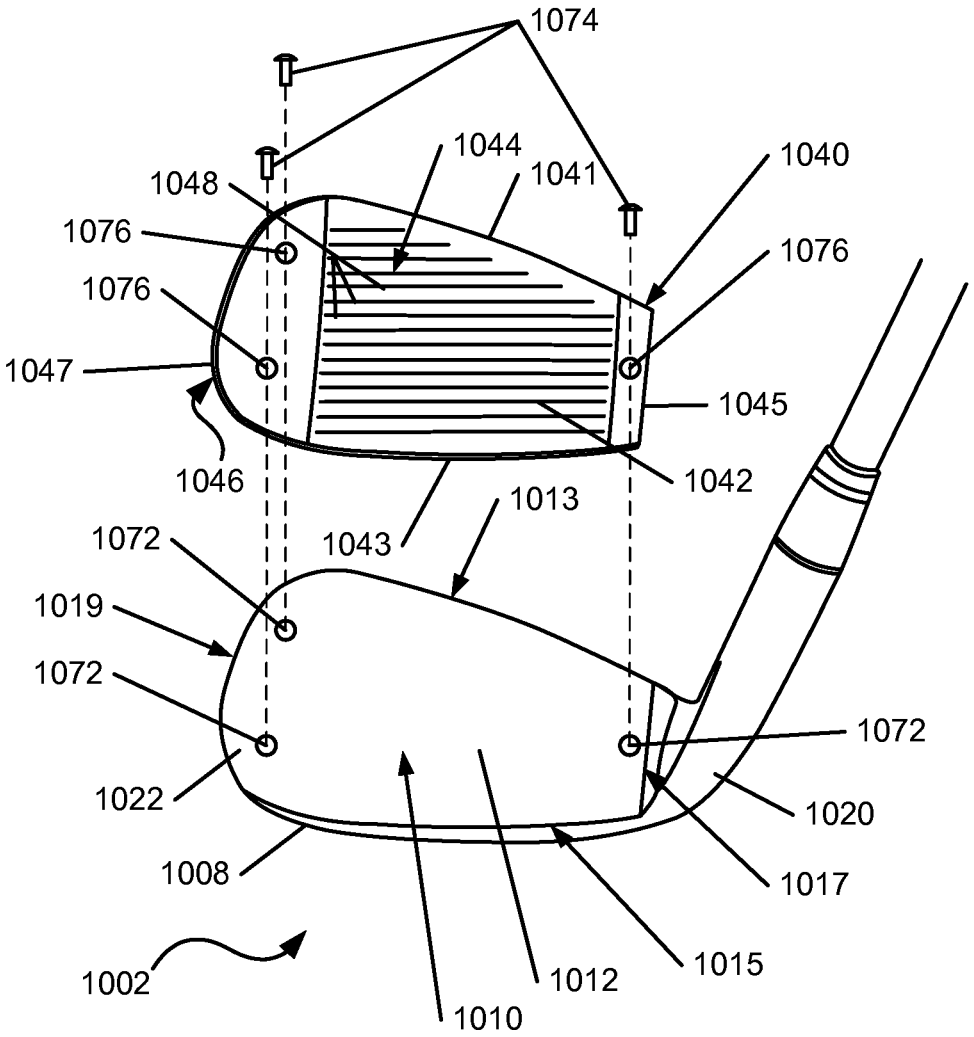
FIG. 29 is an exploded front view of a tenth illustrative embodiment of a head of an iron-type ball striking device according to aspects of the present invention.

FIGS. 27-29 illustrate alternate mounting configurations for connecting face masks 840, 940, 1040 to the face 812, 912, 1012, which can be used in connection with any of the various embodiments described above. The head 802 of FIG. 27 is similar to the head 102 shown in FIGS. 2-6 and contains features generally similar thereto, and such similar features are identified by similar reference numerals in FIG. 27 using the "8xx" series of reference numerals. The head 902 of FIG. 28 is similar to the head 202 shown in FIGS. 8-11 and contains features generally similar thereto, and such similar features are identified by similar reference numerals in FIG. 28 using the "9xx" series of reference numerals. The head 1002 of FIG. 29 is similar to the head 202 shown in FIGS. 8-11 and contains features generally similar thereto, and such similar features are identified by similar reference numerals in FIG. 29 using the "10xx" series of reference numerals.

In the embodiment shown in FIG. 27, the head 802 is structured similarly to the head 102 in FIGS. 2-6, with the outer surface 810 of the face 812 having a recess 850 proximate the center of the face 812, raised portions 854 proximate the heel 820 and toe 822, and substantially vertical edges 852 defining the recess 850 and separating the recessed surface 856 of the recess 850 from the raised portions 854. The face mask 840 is also structured similarly to the face mask 140 in FIGS. 2-6, and is configured to be received in the recess 850, such that the inner surface 846 of the face mask 840 confronts and engages the recessed surface 856 of the outer surface 810 of the face 812, and the outer surface 844 of the face mask 840 is substantially flush with the raised portions 854 of the outer surface 810 of the face 812. The face mask 840 forms at least a portion of the ball striking surface 842 of the head 802, and the slots 848 extend completely through the face mask 840. In this embodiment, the face 812 and the face mask 840 have a plurality of complementary interlocking structures for connecting the face mask 840 to the face 812. The face mask 840 has two elongated projections 870 extending from the inner surface 846, and the outer surface 810 of the face 812 has two complementary receivers in the form of elongated channels 872 on the recessed surface 856. The projections 870 are received in the channels 872 to connect the face mask 840 to the face 812. In some embodiments, the projections 870 and/or the channels 872 may have additional interlocking structures, such as tabs, slots, grooves, etc., to enhance the connection. In other embodiments, a bonding material may additionally or alternately be used to enhance the connection between the projections 870 and the channels 872. It is understood that the projections 870 and channels 872 may be differently shaped, configured, and positioned in other embodiments, and that a larger or smaller number of projections 870 and channels 872 may be used. For example, in one embodiment, one or more projections may be located on the face 812 instead of the face plate 840, and the face plate 840 may contain a complementary receiver that receives the projection.

Figure 28A:
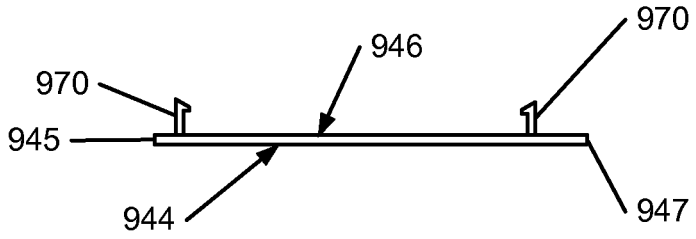
FIG. 28A is a top view of a face mask of the head of FIG. 28.

In the embodiment shown in FIGS. 28 and 28A, the head 902 is structured similarly to the head 202 in FIGS. 8-11, with the outer surface 910 of the face 912 being substantially flat. The face mask 940 is also structured similarly to the face mask 240 in FIGS. 8-11, and is configured to be positioned to cover the outer surface 910 of the face 912 and to form the entire ball striking surface 942, such that the inner surface 946 of the face mask 940 confronts and engages the outer surface 910 of the face 912, and the top, bottom, heel, and toe sides 941, 943, 945, 947 of the face mask 940 are substantially contiguous with the top, bottom, heel, and toe edges 913, 915, 917, 919 of the face 912. The slots 948 extend completely through the face mask 940. In this embodiment, the face 912 and the face mask 940 have a plurality of complementary interlocking structures for connecting the face mask 940 to the face 912. The face mask 940 has two projections 970 extending from the inner surface 946, and the outer surface 910 of the face 912 has two complementary receivers in the form of apertures 972. The projections 970 are received in the apertures 972 to connect the face mask 940 to the face 912. Additionally, the projections 970 are resiliently flexible and have ramped engaging tabs 971 thereon, as shown in FIG. 28A, allowing the face mask 940 to be "snapped" onto the face 912. In some embodiments, the projections 970 and/or the apertures 972 may have additional interlocking structures, and a bonding material may additionally or alternately be used, to enhance the connection between the projections 970 and the apertures 972. It is understood that the projections 970 and apertures 972 may be differently shaped, configured, and positioned in other embodiments, and that a larger or smaller number of projections 970 and apertures 972 may be used. For example, in one embodiment, one or more projections may be located on the face 912 instead of the face plate 940, and the face plate 940 may contain a complementary receiver that receives the projection.

In the embodiment shown in FIG. 29, the head 1002 is structured similarly to the head 202 in FIGS. 8-11, with the outer surface 1010 of the face 1012 being substantially flat. The face mask 1040 is also structured similarly to the face mask 1040 in FIGS. 8-11, and is configured to be positioned to cover the outer surface 1010 of the face 1012 and to form the entire ball striking surface 1042, such that the inner surface 1046 of the face mask 1040 confronts and engages the outer surface 1010 of the face 1012, and the top, bottom, heel, and toe sides 1041, 1043, 1045, 1047 of the face mask 1040 are substantially contiguous with the top, bottom, heel, and toe edges 1013, 1015, 1017, 1019 of the face 1012. The slots 1048 extend completely through the face mask 1040. In this embodiment, the face mask 1040 is connected to the face 1012 by a plurality of fasteners 1074. The face mask 1040 has three holes 1076 extending therethrough, and the outer surface 1010 of the face 1012 has three complementary receivers in the form of apertures 1072. In this embodiment, the fasteners 1074 are screws that are configured to extend through the holes 1076 in the face mask 1040 and to be received in the apertures 1072 in the face 1012 to connect the face mask 1040 to the face 1012. The holes 1076 and/or the apertures 1072 may be complementarily threaded with the fasteners 1074 to secure the connection. Additionally, the peripheries of the holes 1076 may be countersunk in order to receive the heads of the fasteners 1074. In other embodiments, a different type of fasteners 1074 may be used, and the configuration of the face mask 1040 and/or the face 1012 may be differently configured for connection to the different fasteners 1074. It is understood that a larger or smaller number of fasteners 1074, holes 1076, and apertures 1072 may be used.

Figure 31:
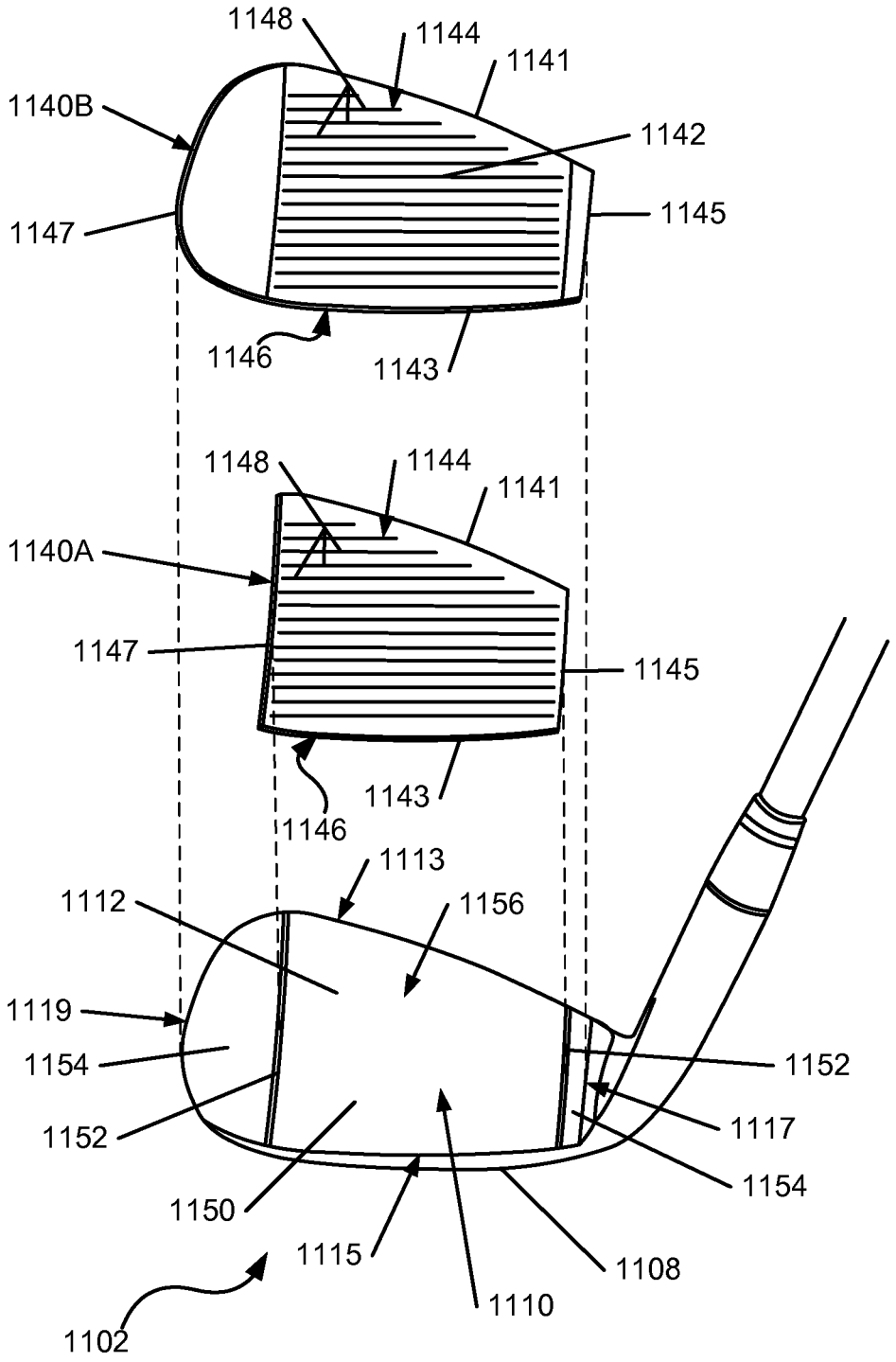
FIG. 31 is an exploded front view of a twelfth illustrative embodiment of a head of an iron-type ball striking device according to aspects of the present invention.
Figure 32:
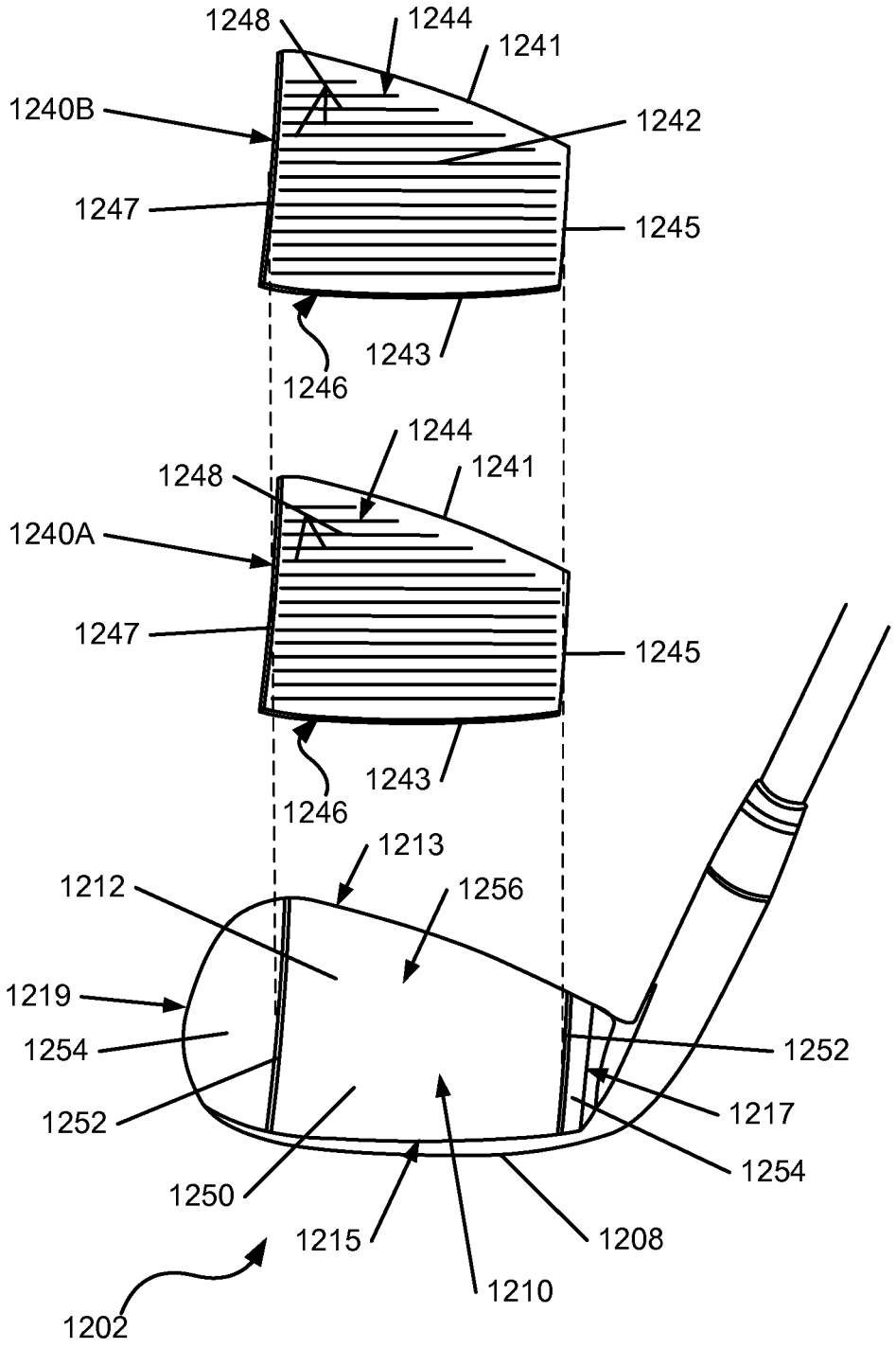
FIG. 32 is an exploded front view of a thirteenth illustrative embodiment of a head of an iron-type ball striking device according to aspects of the present invention.
Figure 33:
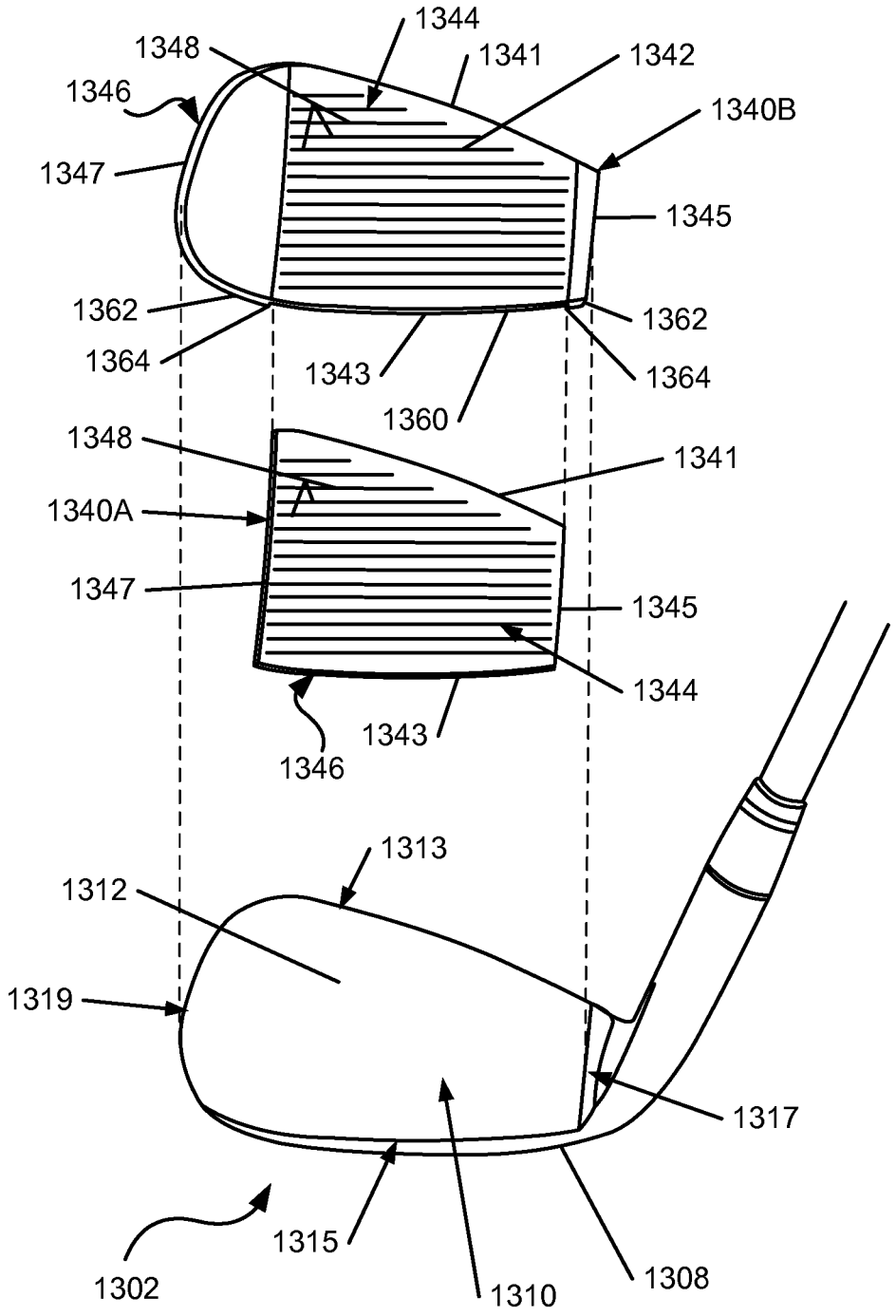
FIG. 33 is an exploded front view of a fourteenth illustrative embodiment of a head of an iron-type ball striking device according to aspects of the present invention.

FIGS. 31-33 illustrate several embodiments of heads 1102, 1202, 1302 in accordance with the present invention, having multiple face masks connected to the face 1112, 1212, 1312 thereof. The head 1102 of FIG. 31 is similar to the head 102 shown in FIGS. 2-6 and contains features generally similar thereto, and such similar features are identified by similar reference numerals in FIG. 31 using the "11xx" series of reference numerals. The head 1202 of FIG. 32 is similar to the head 102 shown in FIGS. 2-6 and contains features generally similar thereto, and such similar features are identified by similar reference numerals in FIG. 32 using the "12xx" series of reference numerals. The head 1302 of FIG. 33 is similar to the head 202 shown in FIGS. 8-11 and contains features generally similar thereto, and such similar features are identified by similar reference numerals in FIG. 33 using the "13xx" series of reference numerals.

In the embodiment illustrated in FIG. 31, the head 1102 is structured similarly to the head 102 in FIGS. 2-6, with the outer surface 1110 of the face 1112 having a recess 1150 proximate the center of the face 1112, raised portions 1154 proximate the heel 1120 and toe 1122, and substantially vertical edges 1152 defining the recess 1150 and separating the recessed surface 1156 of the recess 1150 from the raised portions 1154. In this embodiment, the recess 1150 has a shallower depth than the recess 150 in FIGS. 2-6. The head 1102 includes two face masks 1140A-B both connected to the face 1112 in a stacked orientation. The first or inner face mask 1140A is received within the recess 1150, such that the inner surface 1146 of the inner face mask 1140A confronts and engages the recessed surface 1156 of the outer surface 1110 of the face 1112 in surface-to-surface contact and the outer surface 1144 of the first face mask 1140A is substantially flush with the raised portions 1154 of the outer surface 1110 of the face 1112. The second or outer face mask 1140B is positioned over the inner face mask 1140A and covers the outer surface 1110 of the face 1112, such that the inner surface 1146 of the outer face mask 1140B confronts and engages the raised portions 1154 of the outer surface 1110 of the face 1112 and the outer surface 1144 of the first face mask 1140A in surface-to-surface contact. In this embodiment, the two face masks 1140A-B have smaller thicknesses than the face mask 140 in FIGS. 2-6, so that the thicknesses of the two face masks 1140A-B combined are similar to the thickness of the single face mask 140 in FIGS. 2-6. The outer face mask 1140B forms the entire ball striking surface 1142 of the head 1102 in this embodiment. Additionally, the inner face mask 1140A and the outer face mask 1140B each have a plurality of slots 1148, and the slots 1148 of the inner face mask 1140A and the slots 1148 of the outer face mask 1140B are aligned with each other and combine to form the grooves (not shown) in the ball striking surface 1142. The slots 1148 may be configured in many different ways, such as in the embodiments shown in FIGS. 34-36 and described below. Further, the face masks 1140A-B may be connected to the face 1112 and to each other in any of the configurations described above, including by the use of a bonding material, interlocking structures, fasteners, etc.

In the embodiment illustrated in FIG. 32, the head 1202 is structured similarly to the head 102 in FIGS. 2-6, with the outer surface 1210 of the face 1212 having a recess 1250 proximate the center of the face 1212, raised portions 1254 proximate the heel 1220 and toe 1222, and substantially vertical edges 1252 defining the recess 1250 and separating the recessed surface 1256 of the recess 1250 from the raised portions 1254. The head 1202 includes two face masks 1240A-B both connected to the face 1212 in a stacked orientation. The first or inner face mask 1240A is received within the recess 1250, such that the inner surface 1246 of the inner face mask 1240A confronts and engages the recessed surface 1256 of the outer surface 1210 of the face 1212 in surface-to-surface contact. The second or outer face mask 1240B is positioned over the inner face mask 1240A and is also received within the recess 1250, such that the inner surface 1246 of the outer face mask 1240B confronts and engages the outer surface 1244 of the inner face mask 1240A in surface-to-surface contact and the outer surface 1244 of the outer face mask 1240B is substantially flush with the raised portions 1254 of the outer surface 1210 of the face 1212. In this embodiment, the two face masks 1240A-B have smaller thicknesses than the face mask 140 in FIGS. 2-6, so that the thicknesses of the two face masks 1240A-B combined are similar to the thickness of the single face mask 140 in FIGS. 2-6. The outer face mask 1240B forms at least a portion of the ball striking surface 1242 of the head 1202 in this embodiment. Additionally, the inner face mask 1240A and the outer face mask 1240B each have a plurality of slots 1248, and the slots 1248 of the inner face mask 1240A and the slots 1248 of the outer face mask 1240B are aligned with each other and combine to form the grooves (not shown) in the ball striking surface 1242. The slots 1248 may be configured in many different ways, such as in the embodiments shown in FIGS. 34-36 and described below. Further, the face masks 1240A-B may be connected to the face 1212 and to each other in any of the configurations described above, including by the use of a bonding material, interlocking structures, fasteners, etc.

In the embodiment illustrated in FIG. 33, the head 1302 is structured similarly to the head 202 in FIGS. 8-11, with the face 1312 having a substantially flat outer surface 1310. The head 1302 includes a first or inner face mask 1340A and a second or outer face mask 1340B both connected to the face 1312 in a stacked orientation, with the inner face mask 1340A received within a recessed portion 1360 of the outer face mask 1340B. In this embodiment, the outer face mask 1340B is structured similarly to the face mask 340 in FIGS. 13-17, such that the inner surface 1346 of the outer face mask 1340B has a recessed portion 1360 with raised portions 1362 on both sides of the recessed portion 1360B and substantially vertical edges 1364 separating the recessed portion 1360 from the raised portions 1362. The inner surface 1346 of the inner face mask 1340A confronts and engages the outer surface 1310 of the face 1312 in surface-to-surface contact, and the inner face mask 1340A is received within the recessed portion 1360 of the outer face mask 1340B. The second or outer face mask 1340B is positioned over the inner face mask 1340A, and the outer surface 1344 of the inner face mask 1340A confronts and engages the inner surface 1346 of the outer face mask 1340B within the recessed portion 1360 in surface-to-surface contact. In this embodiment, the two face masks 1340A-B have smaller thicknesses than the face mask 240 in FIGS. 8-11, so that the thicknesses of the two face masks 1340A-B combined are similar to the thickness of the single face mask 240 in FIGS. 8-11. The outer face mask 1340B forms the entire ball striking surface 1342 of the head 1302 in this embodiment. Additionally, the inner face mask 1340A and the outer face mask 1340B each have a plurality of slots 1348, and the slots 1348 of the inner face mask 1340A and the slots 1348 of the outer face mask 1340B are aligned with each other and combine to form the grooves (not shown) in the ball striking surface 1342. The slots 1348 may be configured in many different ways, such as in the embodiments shown in FIGS. 34-36 and described below. Further, the face masks 1340A-B may be connected to the face 1312 and to each other in any of the configurations described above, including by the use of a bonding material, interlocking structures, fasteners, etc.

Figure 34:
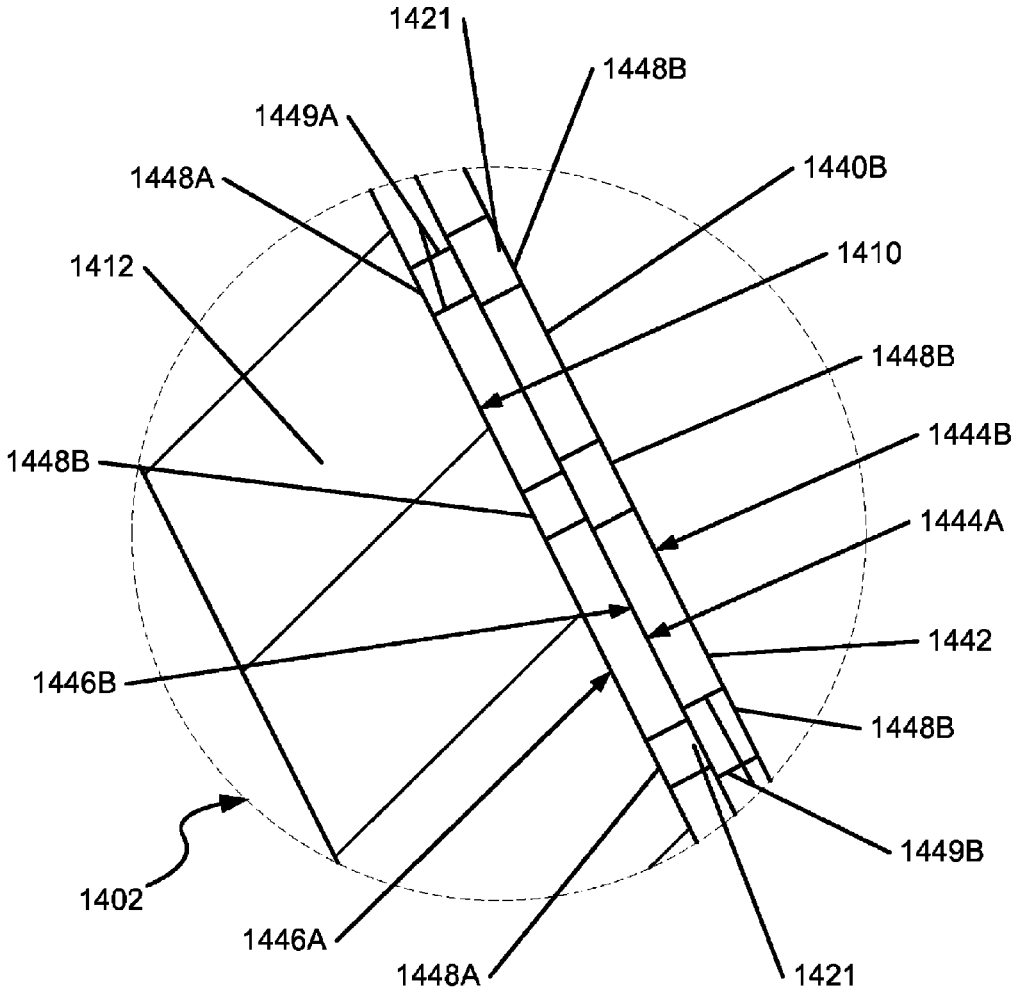
FIG. 34 is a magnified cross-section view of one illustrative embodiment of a head of a ball striking device as shown in FIGS. 31-33.
Figure 35:
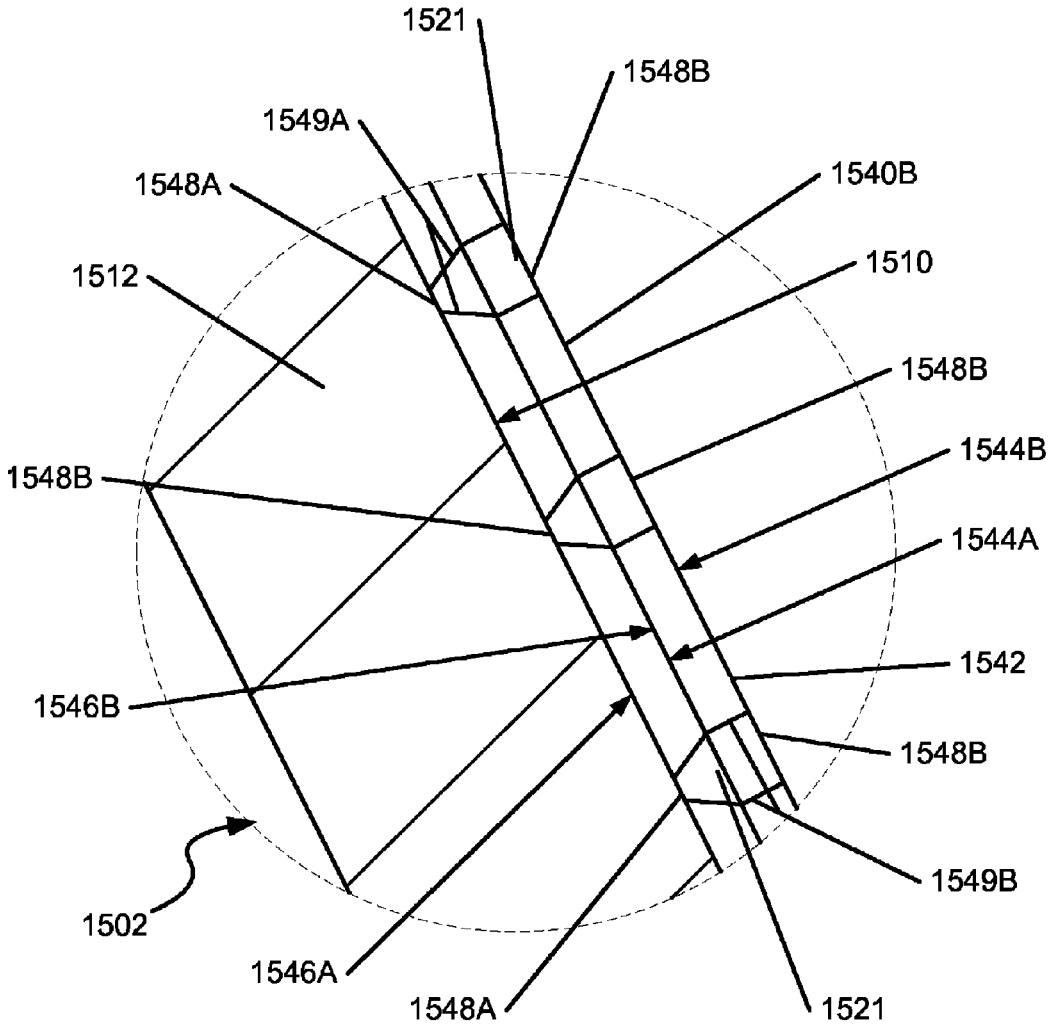
FIG. 35 is a magnified cross-section view of another illustrative embodiment of a head of a ball striking device as shown in FIGS. 31-33.
Figure 36:
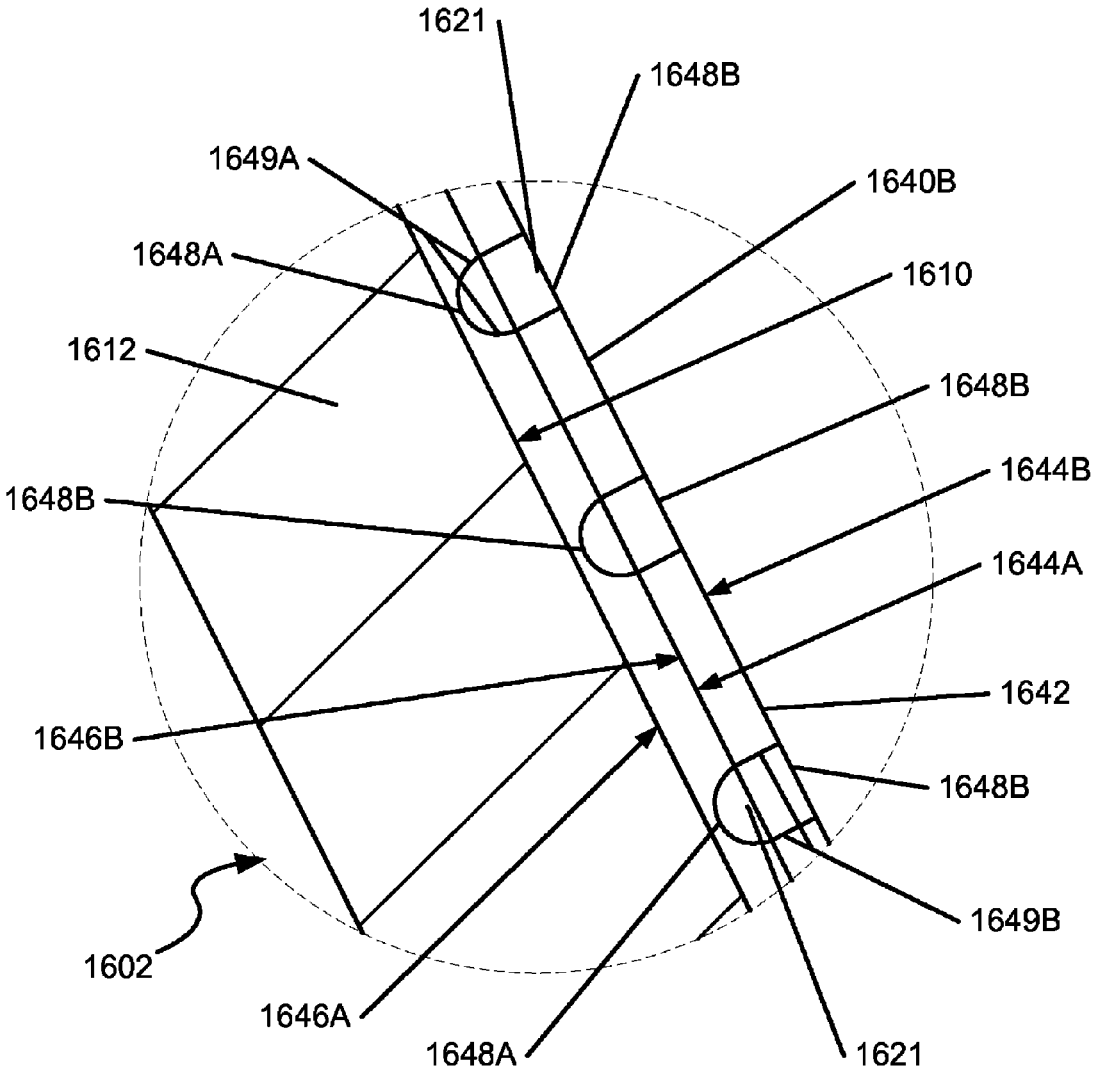
FIG. 36 is a magnified cross-section view of a further illustrative embodiment of a head of a ball striking device as shown in FIGS. 31-33.

FIGS. 34-36 illustrate several different embodiments of heads 1402, 1502, 1602 having two face masks 1440A-B, 1540A-B, 1640A-B arranged in stacked orientation as described above and shown in FIGS. 31-33, having different configurations of aligned slots 1448, 1548, 1648 forming face grooves 1421, 1521, 1621. In each of these embodiments, the inner face mask 1440A, 1540A, 1640A has an inner surface 1446, 1546, 1646 in surface-to-surface engagement with the outer surface 1410, 1510, 1610 of the face 1412, 1512, 1612, and the outer surface 1444, 1544, 1644 of the inner face mask 1440A, 1540A, 1640A is in surface-to-surface engagement with the inner surface 1446, 1546, 1646 of the outer face mask 1440B, 1540B, 1640B. The embodiments described above and shown in FIGS. 31-33 can incorporate any of the configurations of the grooves 1421, 1521, 1621 in FIGS. 34-36, or may be configured differently.

In the embodiment shown in FIG. 34, the slots 1448B of the outer face mask 1440B have side walls 1449B that are generally parallel to each other and generally perpendicular to the outer and inner surfaces 1444, B 1446B of the outer face mask 1440B. The slots 1448A of the inner face mask 1440A are aligned with the slots 1448B of the outer face mask 1440B, and also have side walls 1449A that are generally parallel to each other and generally perpendicular to the outer and inner surfaces 1444A, 1446A of the inner face mask 1440A. The slots 1448A of the inner face mask 1440A have a width that is narrower than the width of the slots 1448B of the outer face mask 1440B, thus forming grooves 1421 that have a decreasing width from the ball striking surface 1442 toward the face 1412. In another embodiment, the slots 1448A-B of both the inner and outer face masks 1440A-B may have the same or substantially the same widths.

In the embodiment shown in FIG. 35, the slots 1548B of the outer face mask 1540B have side walls 1549B that are generally parallel to each other and generally perpendicular to the outer and inner surfaces 1544B, 1546B of the outer face mask 1540B. The slots 1548A of the inner face mask 1540A are aligned with the slots 1548B of the outer face mask 1540B, and have side walls 1549A that are tapered inwardly from the outer surface 1544A to the inner surface 1546A. This configuration forms grooves 1521 that have a decreasing width from the ball striking surface 1542 toward the face 1512. In another embodiment, the slots 1548B of the outer face mask 1540B may additionally or alternatively have tapered widths.

In the embodiment shown in FIG. 36, the slots 1648B of the outer face mask 1640B have side walls 1649B that are generally parallel to each other and generally perpendicular to the outer and inner surfaces 1644B, 1646B of the outer face mask 1640B. The slots 1648A of the inner face mask 1640A are aligned with the slots 1648B of the outer face mask 1640B. However, the slots 1648A do not extend through the entire thickness of the inner face mask 1640A from the outer surface 1644A to the inner surface 1646A, and the side walls 1649A of the inner face mask 1640A form a trough shape. As a result, the face grooves 1621 of the head 1602 in FIG. 36 are not defined in part by the outer surface 1610 of the face 1612. In another embodiment, the slots 1648A of the inner face mask 1640A may have a different cross-sectional shape.

Figure 37:
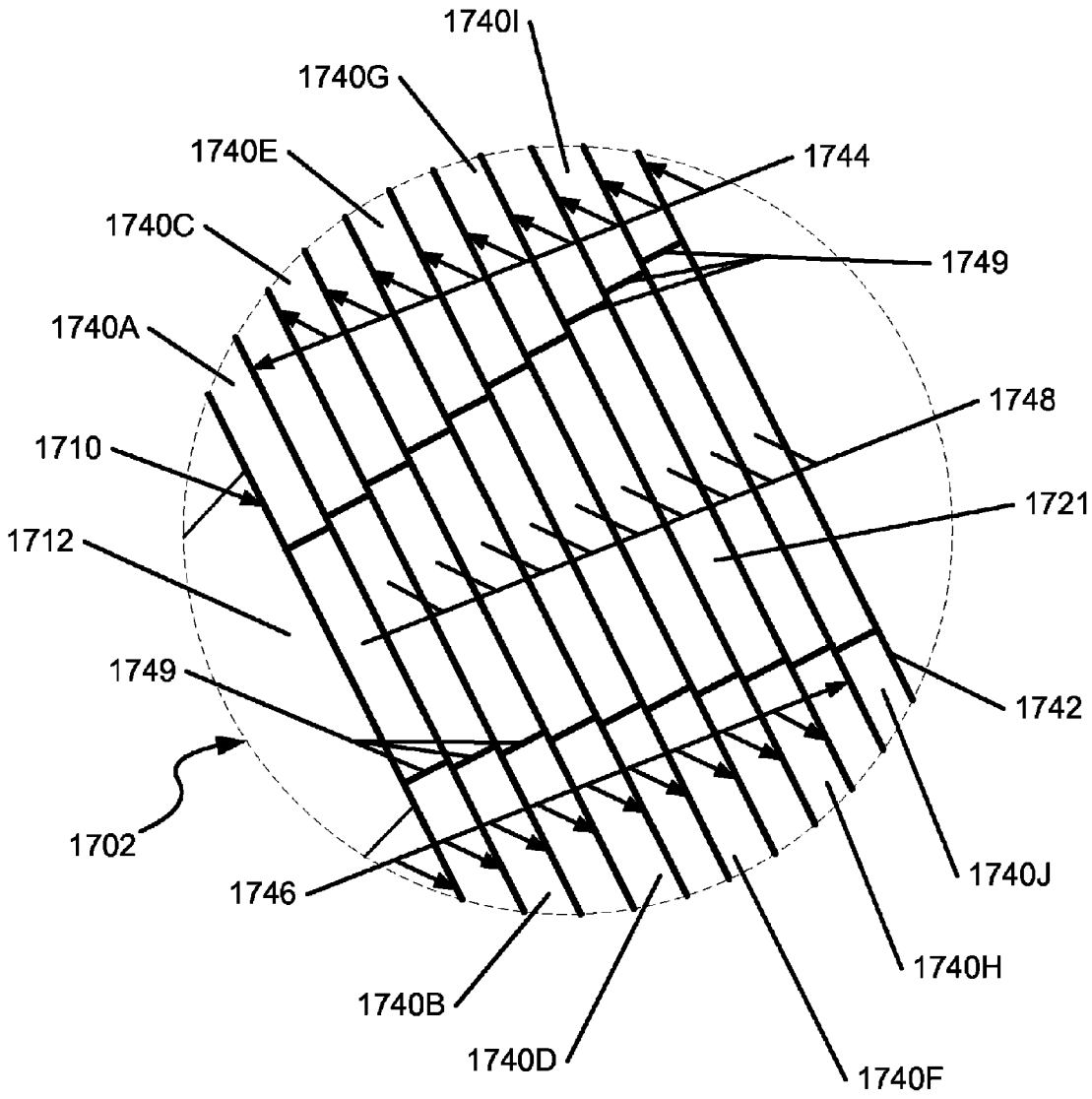
FIG. 37 is a magnified cross-section view of a fifteenth illustrative embodiment of a head of a ball striking device according to aspects of the present invention.

FIG. 37 illustrates another embodiment of a head 1702 having a plurality of face masks 1740A-J arranged in stacked orientation. In this embodiment, the head 1702 has ten face masks 1740A-J stacked on top of each other, such that the inner surfaces 1746 of each of the nine outer face masks 1740B-J engages and confronts the outer surfaces 1744 of the next inwardly adjacent face mask 1740A-J in surface-to-surface contact. Additionally, the inner surface 1746 of the innermost face mask 1740A confronts and engages the outer surface 1710 of the face 1712 in surface-to-surface contact, and the outer surface 1744 of the outermost face mask 1740J forms at least a portion of the ball striking surface 1742 of the head 1702. Each of the face masks 1740A-J includes at least one slot 1748, and the face masks 1740A-J are positioned so the slots 1748 of the plurality of face masks 1740A-J are in alignment with each other. As seen in FIG. 37, the face masks 1740A-J have slots 1748 of differing widths, and each slot 1748 has side walls 1749 that are generally parallel to each other and generally perpendicular to the outer and inner surfaces 1744, 1746 of the face mask 1740A-J. Further, the face masks 1740A-J are arranged so that the outermost plate 1740J has the slot 1748 with the greatest width and the innermost plate 1740A has the slot 1748 with the smallest width, and the remaining face masks 1740B-I are sequentially arranged so that each of the face masks 1740A-I has a slot 1748 that is incrementally narrower than the slot 1748 of the immediately outwardly adjacent face mask 1740B-J. The slots 1748 combine with the outer surface 1710 of the face 1712 to define at least one face groove 1721, and the narrowing arrangement of the slots 1748 creates an inwardly-tapered width of the face groove 1721. In this embodiment, the face masks 1740A-J all have small thicknesses, such that the combination of all the face masks 1740A-J in FIG. 37 have substantially the same width as the face mask 140 in FIGS. 2-6. For example, the face mask 140 in FIGS. 2-6 may be 0.20" thick, and each of the ten face masks 1740A-J in FIG. 37 may be 0.02" thick. The large number of face masks 1740A-J in this embodiment allows a large number of options for creation of face grooves 1721 that have customized characteristics, including customized widths, customized shapes, and customized cross-sectional profiles.

The embodiment shown in FIG. 37, and variations thereof, can be used in connection with various heads described herein, including the heads 102, et seq., described above and the head 1802 described below and shown in FIGS. 40-41, and can utilize any of the different mounting configurations described herein, including a bonding material, interlocking structures, and/or fasteners. Additionally, in other embodiments, a different number of face masks 1740A-J may be utilized. In one embodiment, at least 3 or at least 5 stacked face masks may be used, and in another embodiment, at least stacked 10 face masks may be used. The large number of face masks 1740A-J in this embodiment allows a large number of options for creation of face grooves 1721 that have customized characteristics, including customized widths, customized shapes, and customized cross-sectional profiles. Further, in other embodiments, the widths and configurations of the slots 1748 may be different, and the widths of the slots 1748 may be the same or more similar, or may vary more greatly. In yet another embodiment, the side walls 1749A-J of the slots 1748 may be tapered or may be irregular or asymmetrical in configuration. Still further embodiments and variations are contemplated, including variations incorporating features of any of the other embodiments described herein.

Figure 40:
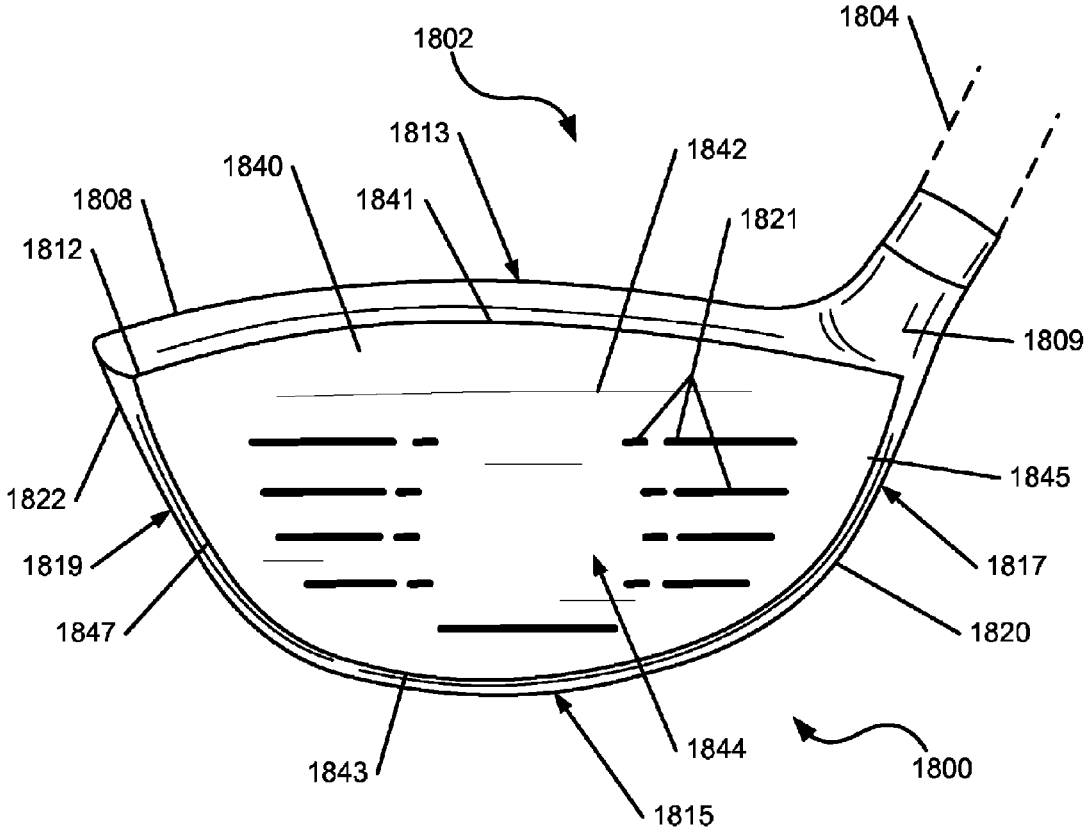
FIG. 40 is a front view of an illustrative embodiment of a head of a wood-type ball striking device according to aspects of the present invention.
Figure 41:
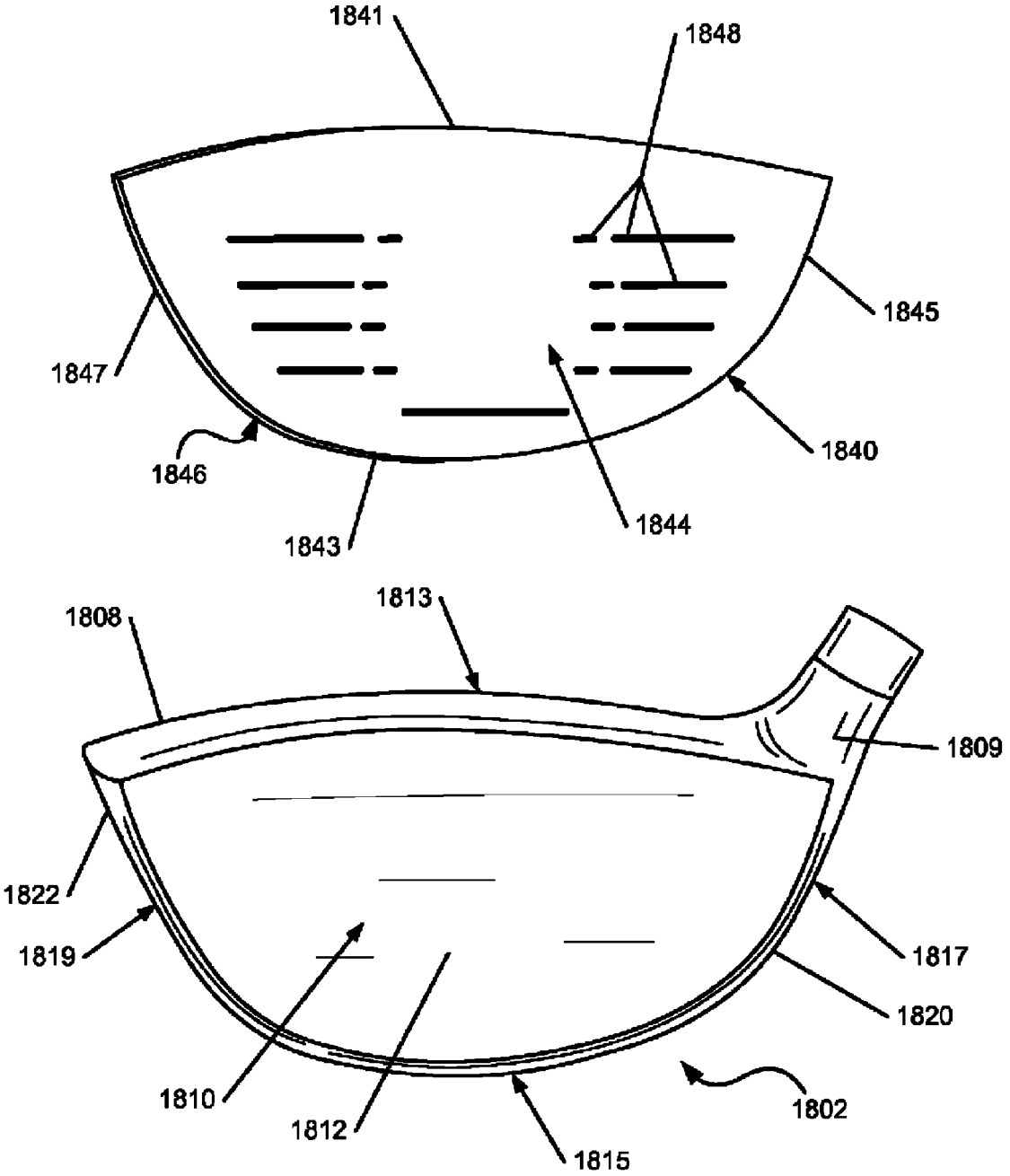
FIG. 41 is an exploded front view of the head of FIG. 40.

FIGS. 40-41, illustrate another example embodiment of a ball striking device 1800 in the form of a wood golf club (such as a driver) or other wood-type club, including fairway wood, a hybrid club, etc. The golf club 1800 shown in FIGS. 40-41 includes a ball striking head 1802 configured to strike a ball in use and a shaft 1804 connected to the ball striking head 1802 and extending therefrom. Although the head 1802 is a wood-type head, which differs from the iron type heads 102, et seq., described above, many features of the head 1802 of FIGS. 40-41 are similar to the features of the head 102 shown in FIGS. 2-6, and such similar features are identified by similar reference numerals in FIGS. 40-41 using the "18xx" series of reference numerals. Accordingly, certain features of the head 1802 of FIGS. 40-41 that are already described above may described below using less detail, or may not be described at all.

The ball striking head 1802 of the golf club 1800 of FIGS. 40-41 has a face 1812 connected to a body 1808, with a hosel 1809 extending therefrom. Any desired hosel and/or head/shaft interconnection structure may be used without departing from this invention, including those described above. The head 1802 has an enclosed volume, as the club head 1802 is a wood-type club head designed for use as a driver, intended to hit the ball accurately over long distances. In other applications, such as for a different type of golf club, the head 1802 may be designed to have different dimensions and configurations. For example, in the embodiment shown in FIGS. 40-41, the club head 1802 may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

The body 1808 of the head 1802 can have various different shapes, including a rounded shape, a squared or rectangular shape, or other any of a variety of other shapes. It is understood that such shapes may be configured to distribute weight away from the face 1812 and/or the geometric/volumetric center of the head 1802, in order to create a lower center of gravity and/or a higher moment of inertia. The golf club 1800 may include a shaft 1804 connected to or otherwise engaged with the ball striking head 1802 as illustrated schematically in FIGS. 40-41, and as similarly shown in FIGS. 1-2 and described above.

In the illustrative embodiment illustrated in FIGS. 40-41, the head 1802 has a hollow structure defining an inner cavity (not shown) with a plurality of inner surfaces defined therein. In one embodiment, the inner cavity may be filled with air. However, in other embodiments, the head could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 1812 in FIGS. 40-41 is located at the front 1824 of the head 1802, and has an outer surface 1810 and an inner surface (not shown) opposite the outer surface 1810. As shown, the outer surface 1810 of the face 1812 is substantially flat, and has a plurality of outer or peripheral edges, including a top edge 1813, a bottom edge 1815, and lateral edges (including heel edge 1817 and toe edge 1819). In the illustrative embodiment shown in FIGS. 40-41, the outer surface 1810 of the face 1812 is inclined (i.e., at a loft angle), to give the ball a desired lift and spin when struck. The loft angle of the face 1812 may be different in different embodiments, to affect the trajectory of the ball.

It is understood that the face 1812, the body 1808, and/or the hosel 1809 can be formed as a single piece or as separate pieces that are joined together. The face 1812 may be formed as part of a face frame member with the body 1808 being partially or wholly formed by one or more separate pieces connected to the face frame member, with a wall or walls extending rearward from the edges of the face 1812. This configuration (not shown) is also known as a "cup face" structure. Additionally, at least a portion of the body 1808 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining Other known techniques for joining these parts can be used as well, including many mechanical joining techniques, including releasable mechanical engagement techniques. If desired, the hosel 1809 may be integrally formed as part of the face frame member. Further, a gasket (not shown) may be included between the cup face structure and the backbody member.

The head 1802 of FIGS. 40-41 has a face 1812 with a substantially flat outer surface 1810 and a face mask 1840 that is configured for attachment to the face 1812. The face mask 1810 is defined by a top side 1841, a bottom side 1843, a heel side 1845, and a toe side 1847, as illustrated in FIGS. 40-41. In this embodiment, the face mask 1840 is positioned to cover all or substantially all of the outer surface 1810 of the face 1812. The top side 1841, the bottom side 1843, the heel side 1845, and the toe side 1847 of the face mask 1840 are contoured similarly to the top edge 1813, the bottom edge 1815, the heel edge 1817, and the toe edge 1819 of the face 1812, respectively, and are substantially flush with the top, bottom, heel, and toe edges 1813, 1815, 1817, 1819 of the face 1812. Additionally, both the inner surface 1846 of the face mask 1840 and the outer surface 1810 of the face 1812 are substantially flat, and the inner surface 1846 of the face mask 1840 is arranged in confronting relation to the outer surface 1810 of the face 1812 and engages the outer surface 1810 in surface-to-surface contact. In this arrangement, the outer surface 1844 of the face mask 1840 forms the entire ball striking surface 1842 of the head 1802. As similarly described above, the slots 1848 extend completely through the face mask 1840, from the inner surface 1846 to the outer surface 1844. In this embodiment, the slots 1848 have side walls (not shown) configured similarly to the slots 148 of FIGS. 2-6, extending from the inner surface 1846 to the outer surface 1844. The slots 1848 of the face mask 1840 form the grooves 1821 on the ball striking surface 1842, such that the grooves are defined by the side walls of the slots 1848 and portions of the outer surface 1810 of the face 1812. The face mask 1840 can be connected to the face 1812 in any manner described above. In the embodiment shown, the face mask 1840 is connected to the face 1812 by a bonding material, as described above. In other embodiments, the face 1812 and the face mask 1840 may be configured similarly to any of the embodiments of iron-type golf club heads 102, et seq., described above. For example, the face 1812 and the face mask 1840 may have complementary structures such as recesses and/or projecting portions, and portions of the face 1812 and/or the face mask 1840 may be received in such recesses. As another example, the face mask 1840 may also have a coating material thereon. As a further example, the face mask 1840 may occupy less than the entire ball striking surface 1842. Still other examples are recognizable to those skilled in the art.

Figure 42:
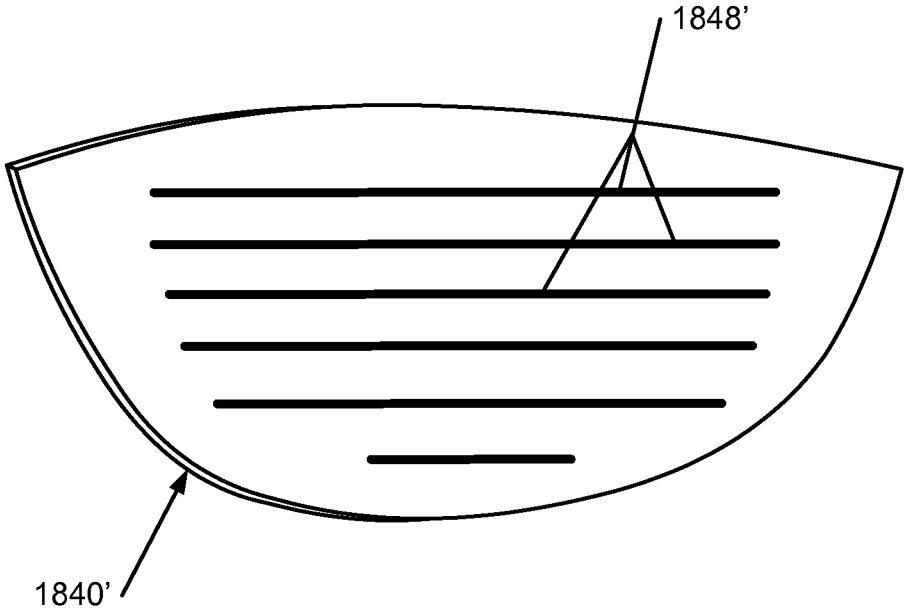
FIG. 42 is a front view of one embodiment of a face mask suitable for use in connection with the head of FIG. 40.
Figure 43:
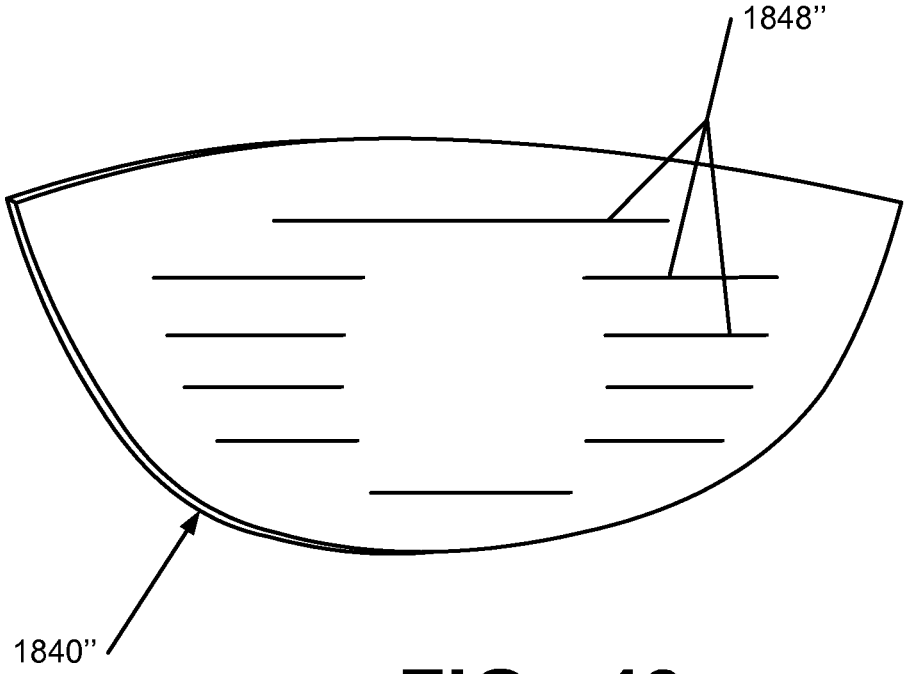
FIG. 43 is a front view of another embodiment of a face mask suitable for use in connection with the head of FIG. 40.

As also similarly described above with respect to FIG. 7, the head 1802 may be configured for connection to a plurality of different face masks 1840. FIGS. 40-41 illustrates a head 1802 with a first embodiment of a face mask 1840, and FIGS. 42-43 illustrate additional embodiments of face masks 1840', 1840" configured for connection to the face 1812 in FIGS. 40-41. The first face mask 1840 includes a plurality of slots 1848 arranged in a circular configuration. The second and third face masks 1840', 1840" have slots 1848', 1848" with patterns, arrangements, and/or characteristics that are different from those of the first face mask 1840. The slots 1848' of the second face mask 1840' in FIG. 42 extend across the center of the face mask 1840'. The slots 1848" of the third face mask 1840" of FIG. 43 are arranged in a circular pattern like the slots 1848 of the first face mask 1840, but are thinner in width. It is also understood that the interchangeable face masks 1840, 1840', 1840" may be differently configured in other embodiments.

Several different embodiments have been described above, including the various embodiments of golf clubs 100, 1800 and heads 102, 202, 302, 402, 502, 602, 702, 802, 902, 1002, 1102, 1202, 1302, 1402, 1502, 1602, 1703, 1802 and portions thereof described herein. It is understood that any of the features of these various embodiments may be combined and/or interchanged. For example, as described above, various different combinations of club heads 102, et seq. with differently configured face masks 140, et seq. may be used, including the configurations described herein, variations or combinations of such configurations, or other configurations. In further embodiments, at least some of the features described herein can be used in connection with other configurations of iron-type clubs, wood-type clubs, other golf clubs, or other types of ball-striking devices.

The face masks 140, et seq. described herein can be formed of a variety of different materials. In some embodiments, the face masks 140, et seq. can be made entirely or partially of a relatively hard and/or wear-resistant material, such as materials developed for edge retention. For example, in one embodiment, the face mask can be made of a cemented carbide material, such as WC-Co (tungsten carbide in a cobalt matrix). In another example, the face mask can be made of a knife blade alloy, such as the CTS family of alloys (typically stainless or other high-chromium steels) from Carpenter Technology Corporation, or similar alloys. In further examples, the face mask can be made from another material, such as a metallic material (including metal alloys), a ceramic material, a polymer material, wood, or any of a variety of composite materials or other combinations of such materials. The material(s) of the face mask may impart one or more different properties to the face mask, including hardness, toughness, strength, and/or wear-resistance, as well as a particular density or weight, hydrophilic or hydrophobic properties, altered rebound or COR response effect, etc., depending on the desired performance characteristics of the resultant club head. As stated above, the face mask 140 may have a coating material 159 thereon that may affect one or more properties of the face mask 140. The face masks 140, et seq. can be formed using one or more of a number of different forming techniques, including molding/casting, forging, pressing, extrusion, etc., as well as prepreg processing and a number of other composite formation techniques. The method of forming the face masks may depend on the material(s) used, and any known forming method may be used with any suitable material.

The slots 148, et seq. can be formed in one of many different manners, including being formed along with the face mask 140, et seq., such as in a casting/molding or forging process, or being formed in a post-manufacture process, such as cutting, milling, machining, etc. In one embodiment, where the face mask 140, et seq. is made from a WC-Co material, the slots 148, et seq. can be formed using a water jet, a high-powered laser, or other suitable method. It is understood that different techniques can be used in other embodiments, and that suitable techniques may depend on the identity of the material(s) of the face mask 140, et seq. Additionally, in one embodiment, the slots 148, et seq. may be formed in the face mask 140, et seq. prior to any coating material or bonding material being connected to the face mask 140 et seq.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. Manufacturing the head 102, et seq. may also include forming one or more slots 148, et seq. in the face mask 140, et seq., or connecting a face mask 140, et seq. to the face 112, et seq. In other embodiments, different types of ball striking devices can be manufactured according to the principles described herein. Additionally, the head 102, et seq., golf club 100, et seq., or other ball striking device may be fitted or customized for a person by custom fitting, which may include selecting a face mask 140, et seq. with one or more particular characteristics that are suited for a particular golfer, and connecting the face mask 140, et seq. to the head 102, et seq. Such customization may also include removing a first face mask 140, et seq., and connecting another face mask to the head, such as the face masks 140, 140', 140" in FIG. 7, the face masks 240, 240', 240" in FIG. 12, and the face masks 1840, 1840', 1840" in FIGS. 41-43. The new face mask may have at least one characteristic that is different from the previous face mask, such as one or more different physical properties, slots with a different configuration and/or arrangement, etc. Various other different configurations are possible, and various other club heads may be designed for various performance characteristics.

The ball striking devices and heads therefor as described herein provide many benefits and advantages over existing products. For example, the face mask(s) may impart one or more beneficial properties or characteristics to the head. In one embodiment, the face mask may increase the wear-resistance of the ball striking face, particularly the wear-resistance of the face grooves. In turn, this increased wear resistance allows the grooves to function more effectively over a long period of time, and in particular, increase the ability of the grooves to impart spin on the ball during impact, even after repeated use over a long period of time. As described above, the face mask(s) may impart other beneficial properties to the head and the ball striking surface thereof, for example, a surface texture may create a different frictional effect, which can in turn impart different spin on the ball upon impact. In some embodiments, the use of different face masks allows for customization of the ball striking face for a specific user, including imparting one or more of the properties associated with a particular face mask to the head. For example, a face mask may have strength and resilience properties that alter the COR or other impact characteristics at that location on the ball striking surface. As a further example, the various possible connection methods permit a greater number of configuration options for designers of club heads and associated face masks. Still further benefits and advantages are recognizable by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A head for a ball striking device, comprising:

a face having an outer surface located at a front of the head;

a body connected to the face and extending rearward from the face; and a face mask connected to the outer surface of the face, the face mask having a first surface configured for forming at least a portion of a ball striking surface of the head configured for striking a ball, a second surface opposite the first surface and confronting the outer surface of the face, and a plurality of elongated slots extending at least partially through the face mask, wherein the slots combine with the outer surface of the face to form a plurality of face grooves on the ball striking surface, wherein the face has a recess in the outer surface, wherein at least a portion of the face mask is received within the recess, wherein the face mask has a projecting portion projecting from the second surface of the face mask, the projecting portion being received in the recess when the face mask is connected to the face, and wherein the projecting portion is located proximate a center of the face mask, and the face mask further comprises two thinned portions extending from opposed sides of the projecting portion, the thinned portions having a smaller thickness than the projecting portion.

2. The head of claim 1, wherein the outer surface of the face is substantially flat, and the second surface of the face mask is positioned in surface-to-surface engagement with the outer surface of the face.

3. The head of claim 1, wherein the face mask covers the entire outer surface of the face and forms the entire ball striking surface.

4. The head of claim 1, wherein the face mask further comprises a coating of a hard material having a hardness greater than a material of the face mask, the coating covering at least a portion of the first surface of the face mask.

5. The head of claim 1, wherein the face mask is connected to the outer surface of the face by a bonding material bonded to the outer surface of the face and the second surface of the face mask.

6. The head of claim 1, wherein the head further comprises an edge recess extending around at least a portion of a peripheral edge of the face, and the face mask further comprises a peripheral wall extending rearward from at least a portion of an outer periphery of the face mask, and wherein the peripheral wall of the face mask is received within the edge recess when the face mask is connected to the face.

7. The head of claim 6, wherein the edge recess extends around a majority of the peripheral edge of the face, and the peripheral wall extends from a majority of the outer periphery of the face mask.

8. The head of claim 1, wherein one of the face and the face mask has a projection and the other of the face and the face mask has a receiver, wherein the projection and the receiver have complementary mating structure, and wherein the projection is received in the receiver when the face mask is connected to the face.

9. The head of claim 1, wherein the face mask is connected to the face by at least one removable fastener.

10. A golf club comprising the head of claim 1 and a shaft connected to the head.

11. The head of claim 1, wherein the plurality of elongated slots extend completely through the face mask, from the first surface to the second surface.

12. A head for a ball striking device, comprising:

a face having an outer surface located at a front of the head;

a body connected to the face and extending rearward from the face; and a face mask connected to the outer surface of the face, the face mask having a first surface configured for forming at least a portion of a ball striking surface of the head configured for striking a ball, a second surface opposite the first surface and confronting the outer surface of the face, and a plurality of elongated slots extending through at least a portion of a thickness of the face mask, wherein the face mask is formed of a metallic material and the face mask further comprises a coating of a hard non-metallic material having a hardness greater than the metallic material, wherein the coating covers the first surface of the face mask, and the coating does not cover the second surface of the face mask, and wherein the second surface of the face mask is positioned in surface-to-surface engagement with the outer surface of the face and is connected to the outer surface of the face.

13. The head of claim 12, wherein the face has a recess in the outer surface, wherein at least a portion of the face mask is received within the recess.

14. The head of claim 13, wherein the face mask has a projecting portion projecting from the second surface of the face mask, the projecting portion being received in the recess when the face mask is connected to the face.

15. The head of claim 14, wherein the projecting portion is located proximate a center of the face mask, and the face mask further comprises two thinned portions extending from opposed sides of the projecting portion, the thinned portions having a smaller thickness than the projecting portion.

16. The head of claim 13, wherein the recess is defined by a peripheral boundary, and wherein the entire face mask is received within the peripheral boundary of the recess.

17. A golf club comprising the head of claim 12 and a shaft connected to the head.

18. The head of claim 12, wherein each of the plurality of elongated slots comprises side walls extending inwardly from the first surface, and wherein the coating further covers the side walls of the slots.

19. The head of claim 12, wherein the face mask further comprises:

a first plate member and a second plate member, the second plate member being stacked upon the first plate member such that the first surface of the face mask is located on the second plate member and the second surface of the face mask is located on the first plate member, wherein the first plate member has a first plurality of elongated slots extending at least partially through the first plate member, and the second plate member has a second plurality of elongated slots extending completely through the second plate member, wherein each of the second plurality of slots has a greater width than each of the first plurality of slots, wherein the each of the first plurality of slots is aligned with one of the second plurality of slots when the second plate member is stacked upon the first plate member, such that the first plurality of slots and the second plurality of slots combine to form the plurality of slots of the face mask.

20. A member configured for connection to a face of a head for a ball striking device, comprising:

a plate member comprising a first surface, a second surface opposite the first surface, and a peripheral edge extending between the first and second surfaces;

a plurality of elongated slots extending completely through the plate member, from the first surface to the second surface, wherein the plate member is configured for connection to the face, such that the second surface of the plate member is configured to confront an outer surface of the face and the first surface of the plate member is configured to form at least a portion of a ball striking surface on the head configured for striking a ball; and a projecting portion projecting from the second surface of the plate member, the projecting portion configured to be received in a recess in the outer surface of the face when the plate member is connected to the face, wherein the projecting portion is located proximate a center of the plate member, and the member further comprises two thinned portions extending from opposed sides of the projecting portion, the thinned portions having a smaller thickness than the projecting portion.

21. The member of claim 20, further comprising a coating of a hard material having a hardness greater than a material of the plate member, the coating covering at least a portion of the first surface of the plate member.

22. The member of claim 20, further comprising a passage extending through the plate member, the passage configured to receive a removable fastener therethrough to connect the member to the face.

23. A head for a ball striking device, comprising:

a face having an outer surface located at a front of the head;

a body connected to the face and extending rearward from the face;

a first plate member connected to the outer surface of the face, the first plate member having a first surface and a second surface opposite the first surface and confronting the outer surface of the face, and a first plurality of elongated slots extending completely through the first plate member, from the first surface to the second surface thereof, wherein a first slot of the first plurality of slots has a first width; and a second plate member connected to the first plate member, the second plate member having a first surface and a second surface opposite the first surface, the second plate member being stacked upon the first plate member such that the second surface of the second plate member confronts the first surface of the first plate member and the first surface of the second plate member forms at least a portion of a ball striking surface of the head configured to strike a ball, and the second plate member further having a second plurality of elongated slots extending completely through the second plate member, from the first surface to the second surface thereof, wherein a second slot of the second plurality of slots has a second width that is greater than the first width, wherein the first slot is aligned with the second slot when the second plate member is stacked upon the first plate member, such that the first slot and the second slot combine to form a face groove on the ball striking surface.

24. The head of claim 23, wherein the outer surface of the face, the first and second surfaces of the first plate member, and the first and second surfaces of the second plate member are each substantially flat, and wherein the second surface of the first plate member is positioned in surface-to-surface engagement with the outer surface of the face and the first surface of the first plate member is positioned in surface-to-surface engagement with the second surface of the second plate member.

25. The head of claim 23, wherein the face has a recess in the outer surface, and wherein at least a portion of the first plate member and at least a portion of the second plate member are positioned within the recess.

26. The head of claim 23, wherein the first plate member has a recess in the first surface, and wherein at least a portion of the second plate member is positioned within the recess.

27. The head of claim 23, wherein the second plate member further comprises a coating of a hard material having a hardness greater than a material of the second plate member, the coating covering at least a portion of the first surface of the second plate member.

28. The head of claim 23, wherein the first plate member is connected to the outer surface of the face and the second plate member is connected to the first plate member by a bonding material.

29. A golf club comprising the head of claim 23 and a shaft connected to the head.

30. A kit comprising:

a head for a ball striking device, the head comprising a face having an outer surface located at a front of the head and a body connected to the face and extending rearward from the face;

a plurality of face plates each configured for connection to the outer surface of the face, each face plate having a first surface configured for forming at least a portion of a ball striking surface of the head configured for striking a ball, a second surface opposite the first wherein when each of the face plates is connected to the head, the slots of the respective face plate combine with the outer surface of the face to form a plurality of face grooves on the ball striking surface, and wherein each of the plurality of face plates has an arrangement of the slots that is different from the arrangement of the slots of each other face plate of the plurality of face plates.

31. The kit of claim 30, wherein each of the plurality of face plates is configured for alternate connection to the head, and the plurality of face plates are configured to be removable from the head and interchangeable with each other.

32. The kit of claim 30, further comprising a shaft connected to the head.

33. A method comprising:

providing a head for a ball striking device, the head comprising a face having an outer surface located at a front of the head and a body connected to the face and extending rearward from the face; and connecting a face plate to the outer surface of the face, the face plate having a first surface, a second surface opposite the first surface, and a plurality of elongated slots extending completely through the face plate, from the first surface to the second surface, wherein when the face plate is connected to the face, the first surface forms at least a portion of a ball striking surface of the head configured for striking a ball, the second surface confronts the outer surface of the face, and the slots combine with the outer surface of the face to form a plurality of face grooves on the ball striking surface, wherein the method further comprises:

removing the face plate from the face; and connecting a second face plate to the outer surface of the face, the second face plate having a first surface, a second surface opposite the first surface, and a plurality of elongated slots extending completely through the second face plate, from the first surface to the second surface, wherein the slots of the second face plate are arranged differently from the slots of the face plate, wherein when the second face plate is connected to the face, the first surface forms at least a portion of a ball striking surface of the head configured for striking a ball, the second surface confronts the outer surface of the face, and the slots combine with the outer surface of the face to form a plurality of face grooves on the ball striking surface.

34. The method of claim 33, further comprising, prior to connecting the face plate to the face:

selecting the face plate from a plurality of face plates each configured for connection to the face, based on a characteristic of a prospective user of the ball striking device.

* * * * *